US008076051B2

(12) United States Patent
Saito et al.

(10) Patent No.: US 8,076,051 B2
(45) Date of Patent: Dec. 13, 2011

(54) METHOD FOR PREPARING RESIN AND PARTICULATE MATERIAL, TONER PREPARED BY THE METHOD, DEVELOPER INCLUDING THE TONER, TONER CONTAINER, AND PROCESS CARTRIDGE, IMAGE FORMING METHOD AND APPARATUS USING THE DEVELOPER

(75) Inventors: Takuya Saito, Numazu (JP); Chiaki Tanaka, Tagata-gun (JP); Masayuki Ishii, Numazu (JP); Naohiro Watanabe, Sunto-gun (JP); Kei Naitoh, Sunto-gun (JP)

(73) Assignee: Ricoh Company Limited, Tokyo (JP)

( * ) Notice: Subject to any disclaimer, the term of this patent is extended or adjusted under 35 U.S.C. 154(b) by 1778 days.

(21) Appl. No.: 11/151,709

(22) Filed: Jun. 14, 2005

(65) Prior Publication Data

US 2005/0277045 A1 Dec. 15, 2005

(30) Foreign Application Priority Data

Jun. 15, 2004 (JP) ..... 2004-177499

(51) Int. Cl.
*G03G 9/087* (2006.01)

(52) U.S. Cl. ..... 430/137.1; 430/109.1; 430/109.4; 430/137.15; 430/137.17

(58) Field of Classification Search ..... 430/109.1, 430/109.4, 137.1, 137.15, 137.17
See application file for complete search history.

(56) References Cited

U.S. PATENT DOCUMENTS

| | | | | |
|---|---|---|---|---|
| 4,071,670 | A | 1/1978 | Vanzo et al. | |
| 4,613,559 | A | 9/1986 | Ober et al. | |
| 5,552,502 | A * | 9/1996 | Odell et al. | 526/234 |
| 5,725,987 | A | 3/1998 | Combes et al. | |
| 5,952,144 | A | 9/1999 | Hasegawa et al. | |
| 6,464,797 | B1 | 10/2002 | Sugiyama et al. | |
| 6,596,454 | B2 | 7/2003 | Adachi et al. | |
| 6,858,369 | B1 | 2/2005 | Adachi et al. | |
| 7,182,861 | B2 | 2/2007 | Sugiyama et al. | |

FOREIGN PATENT DOCUMENTS

| | | |
|---|---|---|
| JP | 36-10231 | 7/1961 |
| JP | 47-51830 | 12/1972 |
| JP | 51-14895 | 5/1976 |
| JP | 53-17735 | 2/1978 |
| JP | 53-17736 | 2/1978 |
| JP | 53-17737 | 2/1978 |
| JP | 61-228458 | 10/1986 |
| JP | 4-306664 | 10/1992 |
| JP | 5-181315 | 7/1993 |
| JP | 5-265252 | 10/1993 |
| JP | 6-329947 | 11/1994 |
| JP | 7-92731 | 4/1995 |
| JP | 8-160660 | 6/1996 |
| JP | 9-15904 | 1/1997 |
| JP | 10-133417 | 5/1998 |
| JP | 2001-281931 | 10/2001 |
| JP | 2001-290311 | 10/2001 |
| JP | 2001-312098 | 11/2001 |
| JP | 2002-40711 | 2/2002 |
| JP | 2002-82490 | 3/2002 |
| JP | 2002-91067 | 3/2002 |
| JP | 2002-91070 | 3/2002 |
| JP | 2002-108015 | 4/2002 |
| JP | 2002-131981 | 5/2002 |
| JP | 2002-131982 | 5/2002 |
| JP | 2002-131983 | 5/2002 |
| JP | 2002-131985 | 5/2002 |
| JP | 2002-139863 | 5/2002 |
| JP | 2002-244351 | 8/2002 |
| JP | 2003-98744 | 4/2003 |
| JP | 2003-98745 | 4/2003 |
| JP | 2003-149861 | 5/2003 |
| JP | 2003-330226 | 11/2003 |
| WO | WO 97/01131 | 1/1997 |

OTHER PUBLICATIONS

U.S. Appl. No. 11/685,872, filed Mar. 14, 2007, Uchinokura, et al.
U.S. Appl. No. 11/687,372, filed Mar. 16, 2007, Yamada, et al.
U.S. Appl. No. 11/685,969, filed Mar. 14, 2007, Uchinokura, et al.
U.S. Appl. No. 11/513,175, filed Aug. 31, 2006, Ohki, et al.
U.S. Appl. No. 11/522,936, filed Sep. 19, 2006, Ishii, et al.
U.S. Appl. No. 11/852,778, filed Sep. 10, 2007, Nagatomo, et al.
U.S. Appl. No. 11/857,791, filed Sep. 19, 2007, Kojima, et al.
U.S. Appl. No. 11/519,893, filed Sep. 13, 2006, Inoue, et al.

* cited by examiner

*Primary Examiner* — Mark F Huff
*Assistant Examiner* — Rachel Zhang
(74) *Attorney, Agent, or Firm* — Oblon, Spivak, McClelland, Maier & Neustadt, L.L.P.

(57) ABSTRACT

A method for preparing a particulate image forming material such as toner, which includes providing a particulate material including a chain transfer agent; and contacting the particulate material with at least one of a supercritical fluid and a sub-critical fluid under pressure to remove the chain transfer agent from the particulate material. A toner prepared by the method. A toner container containing the toner. A developer including the toner. An image forming method including preparing an electrostatic latent image and developing the latent image with the developer. An image forming apparatus including an image bearing member configured to bear an electrostatic latent image, a developing device configured to develop the electrostatic latent image with the developer to form a toner image on the surface of the image bearing member, a transfer device, a fixing device, and a cleaner configured to clean the image bearing member.

8 Claims, 6 Drawing Sheets

METHOD FOR PREPARING RESIN AND PARTICULATE MATERIAL, TONER PREPARED BY THE METHOD, DEVELOPER INCLUDING THE TONER, TONER CONTAINER, AND PROCESS CARTRIDGE, IMAGE FORMING METHOD AND APPARATUS USING THE DEVELOPER

BACKGROUND OF THE INVENTION

1. Field of the Invention

The present invention relates to a method for preparing a resin or a particulate material, and more particularly to a method for preparing a resin or a particulate material such as toner for use in electrophotography, electrostatic recording and electrostatic printing. In addition, the present invention also relates to a toner, a developer including the toner, a toner container containing the toner, and a process cartridge, an image forming method and an image forming apparatus using the developer.

2. Discussion of the Background

Resins such as styrene resins and acrylic resins have a good combination of transparency, rigidity and moldability, and a low cost. Therefore, such resins are broadly used not only for domestic house wares, toys, housing of office automation apparatus, food containers, image projecting screens, magnetic recording media, spacers for LCDs, lighting devices, fillers for columns of analysis devices, carriers of drugs, and resin particles for use in drug delivery systems and bioreactors, but also for binder resins and external additives of image forming materials (such as toners) and coating resins for carriers of two component developers.

In order to control the molecular weight of such resins to impart proper melt viscosity and elasticity to a resin, a chain transfer agent is typically used in the polymerization process. This method has advantages such that the properties and processability of the resultant resins are hardly affected over methods using a lubricant or a plasticizer. However, typical chain transfer agents such as mercaptan type chain transfer agents (e.g., dodecylmercaptan) emit bad smell. Therefore, when a resin in which such a chain transfer agent remains is heated, the chain transfer agent is evaporated, resulting in exudation of bad smell. In particular, this problem is serious when foods wrapped by or contained in a film or a container including such a chain transfer agent are heated in an electronic oven or when a toner including a binder resin including such a chain transfer agent is heated in a fixing process.

In attempting to solve the problem, the following methods have been disclosed:

(1) the added amount of the chain transfer agent is controlled while the polymerization temperature is controlled (for example, published unexamined Japanese patent applications Nos. (hereinafter referred to as JP-As 2001-026619 and 2001-031046);

(2) α-methyl styrene dimmer is used as a chain transfer agent (JP-A 11-292907);

(3) chain transfer agents having a specific molecular structure are used (JP-As 2001-281931, 2002-040711, 2002-091067, 2002-091070 and 2003-330226);

(4) the resultant resins are washed with a washing liquid including a specific material (JP-As 2002-131981-3, 2002-131985, 2002-139863, 2003-098744 and 2003-149861); and (5) deodorants are used (JP-As 2002-108015 and 2003-098745).

However, the bad smell problem cannot be sufficiently solved by these methods.

Resins are also used for image forming fields such as electrophotographic image forming methods.

Various electrophotographic image forming methods including the methods disclosed in U.S. Pat. No. 2,297,691 and published examined Japanese patent application No. (hereinafter referred to as JP-B) 42-23910 have been proposed.

Electrophotographic image forming methods typically include the following processes:

(1) an electrostatic latent image is formed on an image bearing member (e.g., photoreceptors including a photosensitive material) using various devices such as chargers and imagewise light irradiators (latent image forming process):

(2) the electrostatic latent image is developed using a particulate image forming material (e.g., developers including a toner) to form a visual image on the photoreceptor (developing process);

(3) the visual image is then transferred onto a receiving material such as papers (transfer process);

(4) the visual image is fixed on the receiving material upon application of heat, pressure, combination of heat and pressure and solvent vapor (fixing process); and (5) image forming particles remaining on the image bearing member even after the transfer process are removed from the image bearing member (cleaning process).

Various methods for forming a toner which serves as a particulate image forming material have been proposed. At the present time, a need exists for a toner preparation method by which a toner can be prepared with low energy without causing environmental pollution. Specifically, melt-kneading/pulverizing methods in which raw materials of a toner are melted and kneaded to be mixed and then the mixture is pulverized have been conventionally used. However, at the present time, polymerization methods (such as suspension methods, emulsification methods and dispersion methods) in which toner particles are formed in a liquid are mainly used. Among these polymerized toners, a capsule toner and a core/shell toner in which a material capable of exhibiting a desired function is microencapsulated or covered with a shell have been proposed in view of environmental protection.

WO97/01131, JP-B 36-10231 and published unexamined Japanese patent application No. (JP-A) 61-228458 have disclosed polymerization methods for preparing a toner having a core/shell structure. Specifically, a method in which resin particles are subjected to an agglomeration treatment or a salting/fusion treatment optionally together with colorant particles to prepare a toner having irregular forms; a method in which a radical-polymerizable monomer in which a colorant is dispersed is dispersed in an aqueous medium, followed by polymerization to prepare toner particles having a desired particle diameter; and a method in which a radical-polymerizable monomer is polymerized in a solvent which can dissolve the monomer but can hardly dissolve (or can swell) the polymer of the monomer, have been disclosed.

It is necessary for each of these toner manufacturing methods to control the molecular weight distribution of the binder resin (i.e., the polymer) to improve the fixability of the resultant toner. In order to prepare a binder resin having a relatively low molecular weight while controlling the molecular weight distribution thereof, a chain transfer agent such as mercaptan compounds such as dodecylmercaptan is used. However, the mercaptan compounds emit a bad smell, and therefore the resultant toner causes a problem in that when toner images are fixed by a heat fixing device, the toner images emit a bad smell.

Toners prepared by a kneading/pulverizing method hardly cause the bad smell problem because the raw materials including a mercaptan compound are heated in the kneading process, resulting in evaporation of the mercaptan compound. However, since toner particles prepared by a polymerization method are not heated after the toner particles are prepared, the mercaptan compound used remains in the toner particles, and thereby the smell problem is caused in the fixing process.

In attempting to solve this bad smell problem, the following methods have been proposed:

(1) a method in which a chain transfer agent having a specific molecular structure is used (disclosed in, for example, JP-As 2001-281931, 2002-040711, 2002-091067, 2002-091070, and 2003-330226);

(2) a method in which the resultant toner particles are washed in a washing liquid including a specific additive (disclosed in, for example, JP-As 2002-131981-3, 2002-131985, 2002-139863, 2003-098744 and 2003-149861); and (3) a method in which a deodorant is added to the toner particles (disclosed in, for example, JP-A 2002-108015 and 2003-098745).

However, the bad smell problem is not sufficiently solved by these methods.

Because of these reasons, a need exists for an image forming material (a toner) which can produce images having good combination of low temperature fixability, releasability, blocking resistance and high temperature/high humidity durability without causing environmental pollution including the bad smell problem.

SUMMARY OF THE INVENTION

Accordingly, an object of the present invention is to provide a method by which a chain transfer agent included in a resin can be effectively removed therefrom.

Another object of the present invention is to provide a method by which a particulate image forming material (such as toner), which can produce images having good combination of low temperature fixability, releasability, blocking resistance and high temperature/high humidity durability without causing the bad smell problem can be efficiently produced while reducing environmental burdens.

Yet another object of the present invention is to provide a toner which can produce images having good combination of low temperature fixability, releasability, blocking resistance and high temperature/high humidity durability without causing the bad smell problem.

A further object of the present invention is to provide an image forming method and apparatus and a process cartridge by which images having good combination of low temperature fixability, releasability, blocking resistance and high temperature/high humidity durability can be produced without causing the bad smell problem.

Briefly these objects and other objects of the present invention as hereinafter will become more readily apparent can be attained by a method for preparing a method for preparing a resin which includes:

polymerizing a radical-polymerizable monomer in the presence of a chain transfer agent to prepare a resin including the chain transfer agent; and contacting the resin with at least one of a supercritical fluid and a sub-critical fluid under pressure to remove the chain transfer agent from the resin.

Another aspect of the present invention, a resin prepared by the method mentioned above is provided.

Yet another aspect of the present invention, a method for preparing a particulate image forming material is provided which includes:

providing a particulate material including a chain transfer agent; and contacting the particulate material with at least one of a supercritical fluid and a sub-critical fluid to remove the chain transfer agent from the particulate image forming material.

It is preferable that the at least one of the supercritical fluid and sub-critical fluid dissolves the chain transfer agent without dissolving other components of the particulate material.

The supercritical fluid and sub-critical fluid preferably include carbon dioxide and/or an organic solvent.

The contact treatment may be performed on a part or the entire of the particulate material.

It is preferable that the contacting step further includes:

depressurizing the at least one of a supercritical fluid and a sub-critical fluid to separate the chain transfer agent therefrom.

The particulate material is preferably prepared by any one of the following polymerization methods.

(1) a method including:

subjecting a radical polymerizable monomer to emulsification polymerization in an aqueous medium in the presence of a water-soluble polymerization initiator and the chain transfer agent to prepare an emulsion including resin particles;

agglomerating or fusing the resultant resin particles;

separating the resin particles from the aqueous medium; and washing the resin particles.

(2) a method including:

dispersing at least a polymerization monomer, a polymerization initiator, a colorant and a release agent in an aqueous medium including a suspension stabilizer to prepare a suspension;

polymerizing the monomer while agitating the suspension to prepare a particulate polymer; and adding a chain transfer agent to the suspension in at least one of the mixing step and the polymerizing step (i.e., before completion of the polymerization).

(3) a method including:

mixing a hydrophilic organic solvent, a polymer dispersant which can be dissolved in the hydrophilic organic solvent, a radical-polymerizable monomer which can be dissolved in the hydrophilic organic solvent;

polymerizing the radical-polymerizable monomer to prepare a particulate polymer which is hardly dissolved or swells in the hydrophilic organic solvent; and adding a chain transfer agent to the mixture in at least one of the mixing step and the polymerizing step (i.e., before completion of the polymerization).

The polymerizable monomer mentioned above preferably includes one or more vinyl monomers such as styrene and methyl acrylate.

A further aspect of the present invention, a toner which is prepared by the method mentioned above is provided. The toner particles of the toner are preferably prepared by a polymerization method.

As a still further aspect of the present invention, a developer including the toner mentioned above is provided.

As a still further aspect of the present invention, a toner container containing the toner is provided.

As a still further aspect of the present invention, an image forming method is provided which includes:

forming an electrostatic latent image on an image bearing member; and developing the electrostatic latent image with a developer including the toner mentioned above.

As a still further aspect of the present invention, an image forming apparatus is provided which includes:

an image bearing member;

a charger configured to charge the image bearing member;

a light irradiator configured to irradiate the charged image bearing member with imagewise light to form an electrostatic latent image;

a developing device configured to develop the electrostatic latent image with a developer including the toner mentioned above to form a toner image on the surface of the image bearing member;

a transfer device configured to transfer the toner image onto a receiving material;

a fixing device configured to fix the toner image on the receiving material; and a cleaner configured to clean the surface of the image bearing member.

The image bearing member preferably is an amorphous silicone photoreceptor. It is preferable that the fixing device includes a heating member including a heater, a film contacting the heating member, and a pressing member pressing the film to the fixing member, wherein the receiving material bearing a toner image thereon is fed through the nip between the film and the pressing member.

The developing device develops the electrostatic latent image while applying an Ac voltage to a developing member such as a developing roller.

As a still further aspect of the present invention, a process cartridge is provided which includes at least an image bearing member configured to bear an electrostatic latent image thereon and a developing device configured develop the electrostatic latent image with a developer including the toner mentioned above and which can be detachably attached to an image forming apparatus. The process cartridge is preferably attached to the image forming apparatus mentioned above.

These and other objects, features and advantages of the present invention will become apparent upon consideration of the following description of the preferred embodiments of the present invention (taken in conjunction with the accompanying drawings.

DETAILED DESCRIPTION OF THE INVENTION

Figure 1:
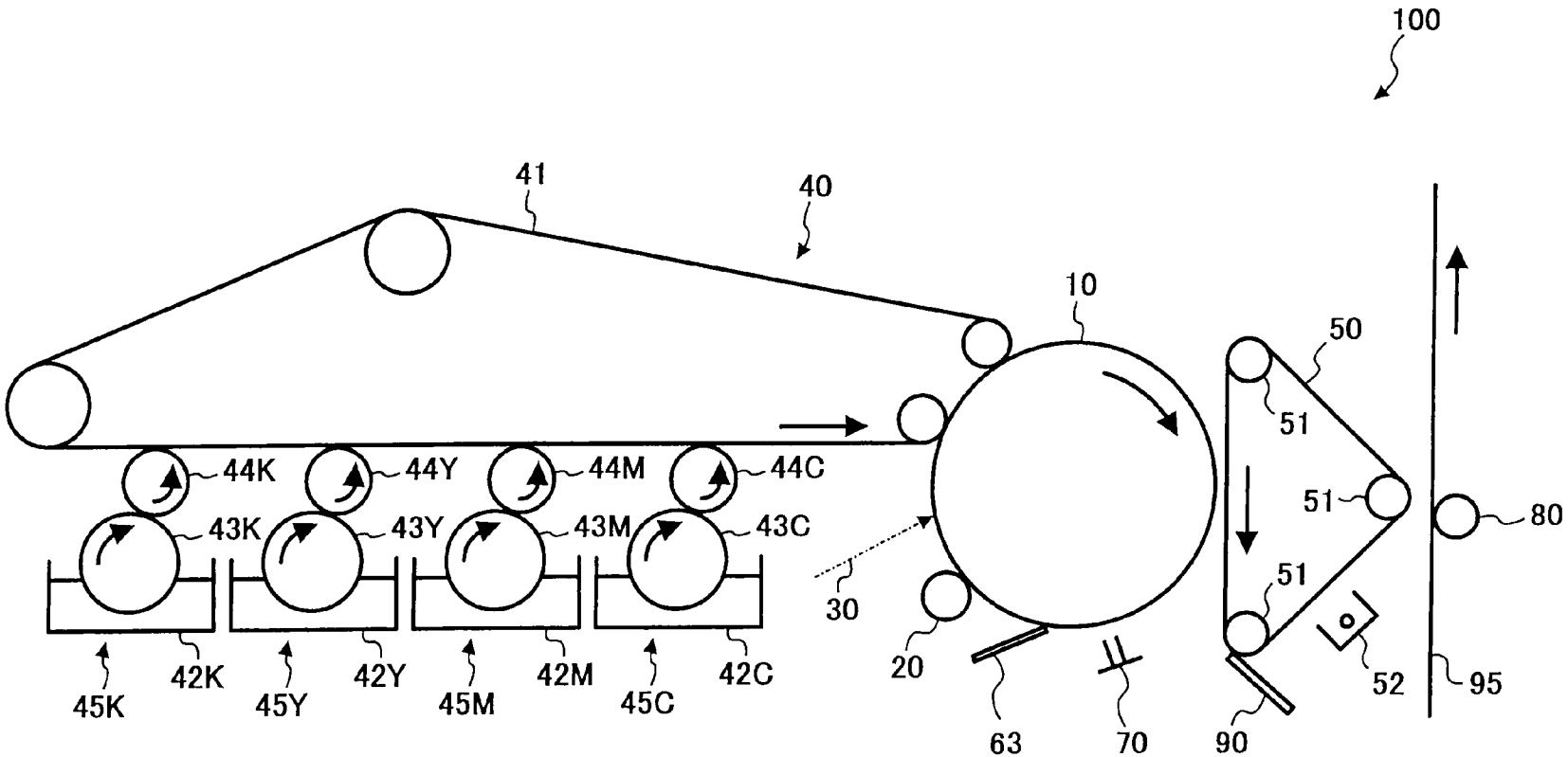
FIG. 1 is a schematic view illustrating an embodiment of the image forming apparatus of the present invention.

At first, the resin preparation method of the present invention will be explained.

The method includes at least a chain transfer agent removing process, and optionally includes other processes. In this regard, specific examples of the resin prepared by the method include polymers which are prepared by radical-polymerizing a radical polymerizable monomer in the presence of a polymerization initiator and a chain transfer agent; resin compositions including such a polymer; materials such as metal, inorganic materials and organic materials, on or in which such a polymer is eccentrically present; etc.

Hereinafter, the method for preparing the resin, and the resin prepared by the method will be explained.

Polymerizable Monomer

Specific examples of the polymerizable monomers for use in preparing the resin include mono- or poly-functional vinyl monomers which can be radically polymerized.

Specific examples of the monofunctional polymerizable monomers include styrene derivatives such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic monomers such as methyl acrylate, ethyl acrylate, n-propyl acrylate, iso-propyl acrylate, n-butyl acrylate, iso-butyl acrylate, tert-butyl acryalte, n-amyl acrylate, n-hexyl acrylate, 2-ethylhexyl acryalte, n-octyl acryalte, n-nonyl acrylate, cyclohexyl acrylate, benzyl acryalte, dimethylphosphate ethyl acylate, diethylphosphate ethyl acylate, dibutylphosphate ethyl acylate, and 2-benzoyloxyethyl acrylate; methacrylic monomers such as methyl methacrylate, ethyl methacrylate, n-propyl methacrylate, iso-propyl methacrylate, n-butyl methacrylate, iso-butyl methacrylate, tert-butyl methacryalte, n-amyl methacrylate, n-hexyl methacrylate, 2-ethylhexyl methacryalte, n-octyl methacryalte, n-nonyl methacrylate, diethylphosphate ethyl methacylate, dibutylphosphate ethyl methacylate; vinyl esters such as methylenealiphaticmonocarboxylic acid esters, vinyl acetate, vinyl propionate, vinyl butyrate, vinyl benzoate, vinyl formate; vinyl ethers such as vinyl methyl ether, vinyl ethyl ether, and vinyl isobutyl ether; vinyl ketones such as vinyl methyl ketone, vinyl hexyl ketone, and vinyl isopropyl ketone; etc.

Specific examples of the polyfunctional polymerizable monomers include diethylene glycol diacryalte, triethylene glycol diacrylate, tetraethylene glycol diacrylate, polyethylene glycol diacrylate, 1,6-hexanediol diacryalte, neopentyl glycol diacrylate, tripropylene glycol diacrylate, polypropylene glycol diacrylate, 2,2'-bis{4-(acryloxydiethoxy)phenyl}propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacryalte, neopentyl glycol dimethacrylate, polypropylene glycol dimethacrylate, 2,2'-bis{4-(methacryloxydiethoxy)phenyl}propane, 2,2'-bis{4-(methacryloxypolyethoxy)phenyl}propane, trimethylolpropane trimethacrylate, tetramethylolmethane tetramethacrylate, divinyl ether, etc.

The monofunctional polymerizable monomers mentioned above can be used alone or in combination. In addition, polyfunctional polymerizable monomers can be used together with one or more of monofunctional monomers. Among the monomers mentioned above, styrene, (meth)acrylic acid and/or their derivatives are preferably used alone or in combination with other monomers in view of developability and durability when the resin is used for toner.

Polymerization Initiator

A polymerization initiator is used when polymerizing polymerizable monomers.

Specific examples of such a polymerization initiator include azo-type polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobismethylbutyronitrile; organic peroxide-type polymerization initiators such as benzoylperoxide, lauroylperoxide, di-α-cumylperoxide, 2,5-dimethyl2,5-bis(benzoylperoxy)hexane, bis(4-tert-butylcyclohexyl)peroxydicarbonate, 1,1-bis(tert-butylperoxy)cyclododecane, tert-butylperoxymaleic acid, bis(tert-butylperoxy)isophthalate, methyl ethyl ketone peroxide, tert-butylperoxy-2-ethylhexanoate, diisopropylperoxycarbonate, cumenehydroperoxide, and 2,4-dichlorobenzoylperoxide; redox initiators such as combinations of oxidizing materials (e.g., inorganic peroxides such as hydrogen peroxide, persulfates (sodium salts, potassium salts, ammonium salts, etc.), and oxidizing metal salts such as tetravalent cerium salts) with reducing materials such as amino compounds (e.g., ammonia, lower amines (such as amines having 1 to about 6 carbon atoms, for example, methyl amine and ethyl amine), and hydroxylamines), reducing sulfur-containing compounds (e.g., sodium thiosulfate, sodium hydrogen sulfite, sodium sulfite, and sodium formaldehyde sulfoxylate), and other reducing materials (such as lower alcohols having 1 to about 6 carbon atoms, ascorbinic acid and its salts, and lower aldehydes having 1 to about 6 carbon atoms); etc.

One or more suitable initiators are selected and used while considering the 10-hour half-life temperature thereof. The added amount of the initiator is determined while considering the target polymerization degree of the resultant binder resin, but is generally from 0.1 to 20% by weight and preferably from 0.5 to 5% by weight based on the weight of the polymerizable monomer used.

Chain Transfer Agent

Specific examples of the chain transfer agents include compounds having the following formula (i) or (ii):

$$HS—R1—COOR2 \quad (i)$$

wherein R1 represents a hydrocarbon group having 1 to 10 carbon atoms, which is optionally substituted, and R2 represents a hydrocarbon group having 2 to 20 carbon atoms, which is optionally substituted, wherein R2 may be the same as or different from R1;

$$HS—R3 \quad (ii)$$

wherein R3 represents a hydrocarbon group having 1 to 20 carbon atoms, which is optionally substituted.

Suitable compounds having formula (i) include thioglycolic acid esters and 3-mercaptopropionic acid esters. Specific examples of the thioglycolic acid esters include ethyl thioglycollate, n-butyl thioglycollate, t-butyl thioglycollate, 2-ethylhexyl thioglycollate, octyl thioglycollate, isooctyl thioglycollate, decyl thioglycollate, dodecyl thioglycollate, ethylene glycol esters of thioglycolic acid, neopentyl glycol esters of thioglycolic acid, trimethylol propane esters of thioglycolic acid, pentaerythritol esters of thioglycolic acid, sorbitol esters of thioglycolic acid, etc.

Specific examples of the 3-mercaptopropionic acid esters include ethyl 3-mercaptopropionate, octyl 3-mercaptopropionate, decyl 3-mercaptopropionate, dodecyl 3-mercaptopropionate, pentaerythritol tetrakis esters of 3-mercaptopropionic acid, ethylene glycol esters of 3-mercaptopropionic acid, neopentyl glycol esters of 3-mercaptopropionic acid, trimethylol propane esters of 3-mercaptopropionic acid, pentaerythritol esters of 3-mercaptopropionic acid, sorbitol esters of 3-mercaptopropionic acid, etc.

Specific examples of the compounds having formula (ii) include n-octylmercaptan, 2-ethylhexylmercaptan, n-dodecylmercaptan, sec-dodecylmercaptan, t-dodecylmercaptan, etc.

Specific examples of other chain transfer agents include disulfides such as diisopropylxanthogen disulfide; halogenated hydrocarbons such as carbon tetrachloride, carbon tetrabromide, ethyl dibromoacetate, ethyl tribromoacetate, dibromoethylbenzene, dibromoethane, and dichloroethane; diazothioether; hydrocarbons such as benzene, ethyl benzene and isopropyl benzene; etc.

The content of the chain transfer agent in the particulate image forming material is preferably from 0.01 to 10% by weight, and more preferably from 0.05 to 5% by weight.

Crosslinking Agent

When monomers are polymerized, one or more of the following crosslinking agents can be used.

Specific examples of the crosslinking agents include known crosslinking agents such as divinyl benzene, divinyl naphthalene, divinyl ether, divinyl sulfone, diethylene glycol dimethacrylate, triethylene glycol dimethacrylate, ethylene glycol dimethacrylate, polyethylene glycol dimethacrylate, diethylene glycol diacrylate, triethylene glycol diacrylate, 1,3-butylene glycol dimethacrylate, 1,6-hexanediol dimethacrylate, neopentyl glycol dimethacrylate, dipropylene glycol dimethacrylate, polypropylene glycol dimethacrylate, 2,2'-bis(4-methacryloxydiethoxyphenyl) propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and allyl phthalate.

Method for Preparing Resin

Then the method for preparing a polymer which is the resin of the present invention itself or a part of the resin will be explained.

The resin of the present invention is not particularly limited except that the resin is prepared by a radical polymerization method. Specific examples of the resin preparation methods include suspension polymerization methods, bulk polymerization methods, and solution polymerization methods. Among these polymerization methods, suspension polymerization methods are preferably used. The resin of the present invention may be particulate. The particulate resin (polymer) will be explained later.

The resin of the present invention can include additives such as antioxidants, lubricants, release agents, plasticizers, pigments, pigment dispersants, dyes, dyeing assistants, fade preventing agents, foaming agents, foam core agents, inorganic fillers, charge controlling agents, antistatic agents, sliding agents, fine pore forming agents, drugs, enzymes, coenzymes, antibodies, binding proteins, lectin, and hormone acceptors. In addition, the resin of the present invention can be used in combination with other resins such as GP-PS, HI-PS, MS resins, MBS resins, AS resins, ABS resins, PE resins, PP resins, and PPO resins.

In order to include such additives and resins (hereinafter referred to as additives) in the resin, a first method in which one or more monomers in which an additive is dispersed are polymerized; a second method in which an additive is mixed with the resultant polymer; and combination methods thereof can be used.

Specific examples of the second method include a kneading method in which an additive is kneaded with the resultant polymer; a method in which an additive is mixed with the resultant polymer and the mixture is kneaded; etc. The latter method is preferably used. The kneaded mixture can be then subjected to a treatment such as pulverization, molding and classification treatments.

Specifically, for example, the following method can be used. At first, the resultant polymer is mixed with an additive using a mixer such as HENSCHEL MIXERS, and then the mixture is kneaded using a kneader such as batch kneaders (e.g., two roll mills and BUMBURYS MIXERS), continuous double-axis extruders (e.g., KTK double-axis extruders manufactured by Kobe Steel, Ltd., TEM double-axis extruders manufactured by Toshiba Machine Co., Ltd., TEX double-axis extruders manufactured by Japan Steel Works, Ltd., PCM double-axis extruders manufactured by Ikegai Corp., and KEX double-axis extruders manufactured by Kurimoto, Ltd.), and continuous single-axis kneaders (e.g., KO-KNEADER manufactured by Buss AG).

In addition, the composition including the polymer and an additive can be subjected to a treatment using a machine such as injection molding machines, followed by cooling so as to have a pellet form or a sheet form. Further, the composition can be crushed and/or pulverized using a crusher such as hammer mills and a pulverizer such as pulverizers using a jet air or mechanical pulverizers. The thus crushed and/or pulverized composition can be optionally classified to prepare a particulate material having a desired particle diameter distribution.

Chain Transfer Agent Removing Process

In the resin preparation method of the present invention, the chain transfer agent remaining in the resultant resin is removed using at least one of a supercritical fluid and a sub-critical fluid.

Supercritical Fluid and Sub-Critical Fluid

The supercritical fluid is defined as a material which is present as a noncondensable high density fluid under temperature/pressure conditions higher than a critical point below which the materials can have both a gas state and a liquid state at the same time, i.e., a material which is present as a fluid under a condition in which the temperature is not lower than the critical temperature thereof and the pressure is not lower than the critical pressure, wherein the fluid is not condensed even when further compressed. Any known supercritical fluids can be used for the resin preparation method of the present invention. Preferably, supercritical fluids which do not dissolve the constituents of the resin and which can dissolve the chain transfer agent included in the resin are used. In addition, supercritical fluids having a relatively low critical temperature are preferably used.

The sub-critical fluid is defined as a material which is present as a high pressure liquid under a temperature/pressure condition in the vicinity of the critical point of the material. Any known sub-critical fluids can be used for the resin preparation method of the present invention.

Specific examples of the materials for use as the supercritical fluid and sub-critical fluid in the method of the present invention include carbon monoxide, carbon dioxide, ammonia, nitrogen, water, methanol, ethanol, ethane, propane, 2,3-dimethylbutane, benzene, chlorotrifluoromethane, dimethyl ether, etc. Among these materials, carbon dioxide is preferably used because of having a critical point near room temperature and good handling property. When a supercritical fluid such as carbon dioxide and carbon monoxide, which have a critical temperature near room temperature (specifically, from 30 to 40° C.), is used, the supercritical fluid is preferably used under conditions of from 25 to 100° C. in temperature and from 5 to 50 MPa in pressure. When the temperature is lower than 25° C., or the pressure is lower than 5 MPa, carbon monoxide and carbon dioxide cannot achieve a supercritical state. In contrast, when the temperature is too high, there is a possibility that the resin treated generates a gas or is decomposed. When the pressure is too high, a problem in that the pump used for transporting the supercritical fluid is damaged tends to occur. Carbon dioxide has a critical temperature of 31° C., and a critical pressure of 7.53 MPa. Carbon monoxide has a critical temperature of 37° C., and a critical pressure of 7.26 MPa.

The materials mentioned above for use as the supercritical fluid can be used as sub-critical fluids under a temperature slightly lower than the critical temperature thereof or a pressure slightly lower than the critical pressure. For example, the chain transfer agent included in a resin can be extracted and removed by contacting the resin with a sub-critical fluid such as sub-critical carbon dioxide. In a case where the properties of the resin (such as formula and shape) are changed when the resin is contacted with a supercritical fluid, it is preferable to use a sub-critical fluid instead of the supercritical fluid. Thus, the supercritical fluids can be used as sub-critical fluids.

The supercritical fluids and sub-critical fluids mentioned above can be used alone or in combination.

The critical temperature and critical pressure of the materials for use as the supercritical fluid in the resin preparation method of the present invention are not particularly limited. However, the critical temperature is preferably from −273 to 400° C. and more preferably from 0 to 200° C. In this case, the critical pressure is not particularly limited if the materials can achieve a supercritical state, but is preferably from not less than 1 MPa and more preferably not less than 7.2 MPa.

Other fluids (hereinafter referred to as second fluids) can be used in combination with the supercritical (or sub-critical) fluids mentioned above. Suitable materials for use as the second fluids include materials which have good affinity for the materials having a low softening point (i.e., the chain transfer agent to be removed) and which do not dissolve the material forming the shell of the particulate image forming material having a core-shell structure. Specific examples of the second fluids include nitrogen monoxide, ethane, propane, ethylene, etc.

The mixing ratio of a supercritical (or sub-critical) fluid to a second fluid is not particularly limited, namely, the mixing ratio is determined depending on the application of the mixed fluid.

Polar materials such as organic solvents and ammonia can be used in combination with the supercritical (or sub-critical) fluids mentioned above as entrainers. By using such an entrainer in combination with a supercritical (or sub-critical) fluid, a chain transfer agent included in a particulate image forming material can be easily removed. The added amount of the entrainer is generally few percent by weight of the supercritical (or sub-critical) liquid used.

Specific examples of the entrainers include methanol, ammonia, melamine, urea, thiodiethylene glycol, chloroform, etc., but are not limited thereto.

Among these solvents, chloroform is preferably used because of being able to dissolve polymerizable monomers remaining in the particulate image forming material. In addition, by using chloroform, the chain transfer agent in the image forming material can be well removed.

Chain Transfer Agent Removing Process

The chain transfer agent removing process is performed on the chain transfer agent included in the resin. When the portion of the resin to be treated and/or the treatment degree are changed, treatment conditions such as the treatment temperature and pressure and the species of the supercritical (or sub-critical) fluid used are changed.

The chain transfer agent removing method for use in the resin preparation method the present invention includes at least a process in which the resin is brought into contact with a supercritical fluid (or a sub-critical fluid). Other processes can be performed if desired.

The contacting process is performed, for example, as follows:

(1) The resin from which a chain transfer agent is to be removed is contained in a container through which the supercritical (or sub-critical) fluid used can pass but from which the resin cannot be discharged, and the resin is contacted with the supercritical fluid (or the sub-critical fluid) in the container; or (2) The resin from which a chain transfer agent is to be removed and a material are contained in a closed container and the mixture is heated and pressed so that the material can achieve a supercritical (or sub-critical) state.

The shape of the resin to be treated is not particularly limited. For example, resins having a shape such as particle, powder, granule, pellet, sphere, plate, sheet, rod, cylinder, polyhedral cylinder, and irregular forms can be used. However, in view of handling and chain transfer removing efficiency, the shape of particles and pellets is preferable.

The apparatus for use in the chain transfer agent removing process is not particularly limited, as long as the apparatus has a pressure-resistant container in which a resin is subjected to a chain transfer agent removing treatment, a pressure pump configured to feed a supercritical (or sub-critical) fluid, and a separation vessel in which the collected gas is separated into the chain transfer agent and the material used as the supercritical (or sub-critical) fluid using a decompression valve.

One example of the chain transfer removing method is as follows. At first, a resin from which a chain transfer agent is to be removed is contained in a pressure-resistant container. Then a supercritical (or sub-critical) fluid is fed into the pressure-resistant container using a pressure pump to contact the supercritical fluid with the resin such that the chain transfer agent in the resin is removed therefrom. Then the mixture of the chain transfer agent and the supercritical fluid (or sub-critical fluid) is discharged from the container. When the thus discharged supercritical fluid (or sub-critical fluid) is present under normal temperature/normal pressure conditions, the fluid achieves a gaseous state. Therefore, it is not necessary to dispose of a waste liquid. In this case, the mixture can be subjected to a pressure reduction treatment using a decompression valve to separate the chain transfer agent from the supercritical fluid, i.e., to reuse the supercritical fluid. Thus, the chain transfer removing method of the present invention is environment-friendly.

The treatment temperature is not particularly limited as long as the temperature is higher than the critical temperature of the supercritical (or sub-critical) fluid. The critical temperature is preferably not higher than the melting points of the resin, i.e., a temperature at which the resin does not cause an agglomeration problem in that particles of the resin do not adhere to each other. The critical temperature is preferably a temperature at which the second fluids and solvents used in combination with the supercritical (or sub-critical) fluid achieve a gaseous state.

Particulate Resin and Method for Preparing the Particulate Resin

The resin may be a particulate resin. The method for preparing such a particulate resin is not particularly limited. Specific examples of the particulate resin include pulverized resins, polymerized particulate resins, and microcapsule resins which are prepared by a method such as spray-drying methods and coacervation methods, etc. Among the particulate resins, the following particulate resins are preferable.

(1) particulate resins prepared by an emulsion polymerization method in which a radical-polymerizable monomer dissolved or emulsified in an aqueous medium including a water soluble polymerization initiator is polymerized;

(2) particulate resins prepared by a suspension polymerization method in which a mixture including at least a polymerizable monomer and a polymerization initiator is added in an aqueous medium including a suspension stabilizer, and the mixture is subjected to a polymerization reaction-while the suspension is agitated;

(3) particulate resins prepared by a dispersion polymerization method in which a mixture of a hydrophilic organic solvent and a polymer dispersant which can be dissolved in the organic solvent is mixed with a radical-polymerizable monomer which can be dissolved in the organic solvent but whose polymer is swelled or is hardly dissolved in the organic solvent, and then the mixture is subjected to a polymerization reaction; and (4) particulate resins prepared by a seed polymerization method in which a particulate resin is dispersed in an aqueous medium or an organic solvent, and polymerization is performed using the particulate resin as seed particles.

The thus prepared particulate resins of the present invention preferably have a ratio (Me/Mo) of the median particle diameter (Me) of the particulate resin to the mode diameter (Mo) of not greater than 1.10, and preferably not greater than 1.05. The median particle diameter means a 50% cumulative particle diameter on a volume basis, and the mode particle diameter means a particle diameter at which the particle content is maximum in the particle diameter distribution curve. When the ratio is 1, the particulate resin is a mono-disperse particle with respect to the particle diameter. Such particulate resins can exhibit good performance. The median particle diameter and the mode particle diameter of a particulate resin can be determined by a laser diffraction particle diameter distribution measuring instrument SALD-2000 manufactured by Shimadzu Corp.

The thus prepared particulate resins have a wide range of application such as screens, magnetic recording media, spacers for LCDs, lighting devices, fillers for columns of analysis devices, carriers of drugs, resin particles for use in drug delivery systems and bioreactors, image forming materials (such as toners and carriers) for use in electrophotography, electrostatic recording and electrostatic printing, binder resins and external additives of the image forming materials and coating resins for the image forming materials.

The particulate resin can be used with or without modified. When the particulate resin is modified, for example, a method in which the particulate resin is mixed with an additive so that the surface of the resin is modified by the additive, optionally followed by an additive fixation treatment can be used. In addition, an additive can be added to the particulate resin by a method such as dipping, extraction and coating in the presence of a supercritical (or sub-critical) fluid.

Then the emulsion polymerization method, suspension polymerization method, and dispersion polymerization method will be explained.

At first, the emulsion polymerization will be explained.

In an emulsion polymerization method, a particulate resin can be prepared by dissolving or emulsifying a radical polymerizable monomer in an aqueous medium including a polymerization initiator and then polymerizing the monomer in the aqueous medium. In this regard, the aqueous medium includes water in an amount of not less than 50%. Specific examples of the emulsion polymerization methods include methods described in U.S. Pat. Nos. 4,247,434, 4,339,337, 4,358,388, 5,496,897 and 4,336,173, and Journal of Applied Polymer Science vol. 51, 1-11 (1994). A method in which an emulsion polymerization method is combined with a seed polymerization method mentioned below to prepare a particulate resin having a desired particle diameter can also be used.

Surfactant

In the emulsion polymerization, a surfactant is used for accelerating emulsification of the monomer used. The added amount of the surfactant is from 0.001 to 0.1% by weight based on the monomer used. Known surfactants such as ionic surfactants and nonionic surfactants can be used as the surfactant.

Specific examples of the ionic surfactants sulfonates (e.g., sodium dodecylbenzenesulfonate, sodium arylalkylpolyether sulfonate, sodium 3,3-disulfonediphenylurea-4,4-diazo-bis-amino8-naphthol-6-sulfonate, o-carboxylbenzene-azo-dimethylaniline, and sodium 2,2,5,5-tetramethyl-triphenylmethane-4,4-diazo-bis-β-naphthol-6-sulfonate); sulfates (e.g., sodium dodecylsulfate, sodium tetradecylsulfate, sodium pentadecylsulfate and sodium octylsulfate); salts of fatty acid (e.g., sodium oleate, sodium laurate, sodium caprate, sodium caprylate, sodium caproate, potassium stearate and calcium oleate; etc.

Specific examples of the nonionic surfactants include polyethylene oxide, polypropylene oxide, combinations of polyethylene oxide and polypropylene oxide, esters of polyethylene glycol and higher fatty acids, alkylphenolpolyethylene glycol, esters of polypropylene oxide and higher fatty acids, sorbitan esters, etc.

In this case, a water-soluble polymerization inhibitor such as metal salts can be added to prevent the emulsion polymerization in the aqueous phase. In addition, alcohols such as glycerin and glycols can be added to prevent agglomeration of resultant particles by increasing the viscosity of the continuous phase (i.e., the dispersion medium). Further, salts such as NaCl, KCl and $Na_2SO_4$ can be added to decrease the solubility of a water-soluble monomer to water.

Then the suspension polymerization method will be explained.

A typical method of the suspension polymerization method is that a polymerizable composition including at least a polymerizable monomer and a polymerization initiator is added to an aqueous dispersion medium including a suspension stabilizer, and the mixture is polymerized while the mixture is agitated.

Dispersion Stabilizer

In order to well disperse a polymerizable monomer in an aqueous medium, one or more dispersion stabilizers can be used.

Specific examples of inorganic dispersion stabilizers include particles (having a particle diameter not greater than 1 μm) of metals such as cobalt, iron, nickel, aluminum, copper, tin, lead and magnesium, and metal alloys thereof, particulate inorganic compounds such as tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, titania, iron oxide, copper oxide, nickel oxide, and zinc oxide. In addiiton, pigments and dyes such as carbon black, Nigrosine dyes, Aniline Blue, Chrome Yellow, Phthalocyanine Blue and Rose Bengale can also be used as the dispersion stabilizer.

Specific examples of the organic dispersion stabilizers include polymers and copolymers prepared using one or more monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate), acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the dispersant.

Further, copolymers of the above-mentioned hydrophilic monomers with monomers having a benzene ring or the derivatives of the monomers; copolymers of the above-mentioned hydrophilic monomers with derivatives of acrylic acid or methacrylic acid, such as acrylonitrile, methacrylonitrile and acrylamide; and copolymers of the above-mentioned hydrophilic monomers with one or more of crosslinking monomers such as ethylene glycol dimethacrylate, diethylene glycol methacrylate, ally methacrylate, and divinyl benzene, can also be used as the dispersion stabilizer.

In addition, particulate resins can also be used as the dispersion stabilizer. Suitable resins for use as the dispersion stabilizer include any known thermoplastic or thermosetting resins which can form a dispersion in an aqueous medium. Specific examples of such resins include vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resin dispersion stabilizers, one or more of vinyl resins, polyurethane resins, epoxy resins, and polyester resins are preferably used because an aqueous resin dispersion including fine spherical resin particles can be prepared.

Specific examples of the vinyl resins include homopolymers and copolymers of one or more vinyl monomers, such as styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylate copolymers, etc.

Copolymers obtained from a monomer having two or more unsaturated groups therein can be preferably used as the resin dispersion stabilizer. Specific examples of such a monomer include sodium salts of sulfates of ethylene oxide adducts of methacrylic acid (for example, ELEMINOL RS-30 from Sanyo Chemical Industries Ltd.), divinyl benzene, 1,6-hexanediol diacrylate, etc.

The particulate resin for use as the dispersion stabilizer preferably has a volume average particle diameter of form 1 nm to 1 μm, and more preferably from 10 nm to 500 nm.

The added amount of the dispersion stabilizer is preferably from 0.2 to 10.0 parts by weight per 100 parts by weight of the monomer used.

Marketed dispersion stabilizers can be used without modification. When an inorganic dispersion stabilizer is used, a method in which an inorganic dispersion stabilizer is prepared in a dispersion medium can also be used. For example, an aqueous sodium phosphate solution and an aqueous calcium chloride solution are added into water while agitating to produce tricalcium phosphate dispersion, which can be used as a dispersion stabilizer.

Surfactant

When an inorganic dispersion stabilizer is used, a surfactant is preferably used in an amount of from 0.001 to 0.1% by weight based on the weight of the monomers used to assist the inorganic dispersion stabilizer in dispersing the monomers. Suitable surfactants include the ionic surfactants and nonionic surfactants mentioned above.

When a water-soluble monomer is used, emulsion polymerization is caused at the same time and thereby a problem in that the resultant suspension-polymerization polymer particles include emulsion-polymerization polymer particles is caused. In this case, a water-soluble polymerization inhibitor such as metal salts can be added to prevent the emulsion polymerization in the aqueous phase. In addition, alcohols such as glycerin and glycols can be added to prevent agglomeration of resultant particles by increasing the viscosity of the continuous phase (i.e., the dispersion medium). Further, salts such as NaCl, KCl and $Na_2SO_4$ can be added to decrease the solubility of a water-soluble monomer to water. These materials are mainly used for emulsion polymerization methods, but can be used for other polymerization methods or for other purposes.

Then the dispersion polymerization method will be explained.

A typical dispersion polymerization method is as follows. A radical polymerizable monomer and a polymerization initiator are polymerized in an organic solvent, resulting in preparation of a particulate polymer, wherein the monomer is not dissolved in an organic solvent but whose polymer is swelled by or is hardly dissolved in the organic solvent.

Specific examples of the dispersion polymerization methods include the method (styrene-methyl methacrylate dispersion polymerization) described in "Kinetics of Polymerization in Disperse Systems" by Levy et al., Impac Macro p 76 (1982); the method described in "Monodisperse Polymeric Spheres in the Micron Size Range by a Single Step Process", The British Polymer Journal, pp 131-136 (December 1982); the method described in "Polyelectrolyte Stabilized Lactices Part 1, Preparation" by Corner, Elsvier Scientific Publishing Company PP 119-129 (1981); and the method described in "Absorption of Low Molecular Weight Compounds in Aqueous Dispersions by Poltmer-Oligomer Particles", 2a, Makromol Chem. 180, pp 737-744 (1979).

Organic Solvent

Specific examples of the organic solvents for use in the dispersion polymerization methods include alcohols such as methyl alcohol, ethyl alcohol, denatured alcohol, isopropyl alcohol, n-butyl alcohol, isobutyl alcohol, tert-butyl alcohol, sec-butyl alcohol, tert-amyl alcohol, 3-pentanol, octyl alcohol, benzyl alcohol, cyclohexanol, furfuryl alcohol, tetrahydrofurfuryl alcohol, ethylene glycol, glycerin, and diethylene glycol; ether alcohols such as methylcellosolve, cellosolve, isopropyl cellosolve, butyl cellosolve, ethylene glycol monomethyl ether, ethylene glycol monoethyl ether, diethylene glycol monomethyl ether, and diethylene glycol monoethyl ether; etc. These solvents are used alone or in combination.

By using a second organic solvent in combination with the above-mentioned alcohols and ether alcohols, it becomes possible to perform polymerization under conditions in which generated particles are insoluble in the mixture solvent by properly controlling the SP value of the mixture solvent and polymerization conditions. By using this method, problems in that the generated particles are adhered to each other, resulting in agglomeration of the particles, and new particles are generated can be avoided.

Specific examples of such second organic solvents include hydrocarbons such as hexane, octane, petroleum ether, cyclohexane, benzene, toluene and xylene; halogenated hydrocarbons such as carbon tetrachloride, trichloroethylene, and tetrabromoethane; ethers such as ethyl ether, dimethyl glycol, trioxane, and tetrahydrofuran; acetals such as methylal and diethyl acetal; ketones such as acetone, methyl ethyl ketone, methyl isobutyl ketone and cyclohexanone; esters such as butyl formate, butyl acetate, ethyl propionate, and cellosolve acetate; acids such as formic acid, acetic acid and propionic acid; compounds having a sulfur atom or a nitrogen atom such as nitropropene, nitrobenzene, dimethylamine, monoethanolamine, pyridine, dimethylsulfoxide and dimethylformamide; water; etc.

When the polymerization is performed, an inorganic ion such as $SO_4^{2-}$, $NO_2^-$, $PO_4^{3-}$, $Cl^-$, $Na^+$, $K^+$, $Mg^{2+}$ and $Ca^{2+}$ can be included in the dispersion.

If desired, one or more dispersion stabilizers and surfactants such as those mentioned above can be added to the dispersion to well disperse monomers in an aqueous medium.

The polymerization conditions such as choice of dispersion stabilizers and surfactants, concentration of monomers and mixing ratio of the compounds are properly determined so that the resultant particulate resin has a desired average particle diameter and a particle diameter distribution. When it is desired to prepare a particulate resin having a relatively small average particle diameter, the concentration of the dispersion stabilizer and surfactant used is increased. In contrast, when it is desired to prepare a particulate resin having a relatively large average particle diameter, the concentration of the dispersion stabilizer and surfactant used is decreased. When it is desired to obtain a particulate resin having a sharp particle diameter distribution, the concentration of the monomers is decreased. In contrast, a particulate resin having a broad particle diameter distribution can be prepared by increasing the concentration of the monomers.

In general, when the added amount of the dispersion stabilizer is not less than 2% by weight of the monomers used, it is difficult to prepare a particulate resin having a particle diameter distribution such that particles having a particle diameter within a range of ±25% of the average particle diameter are included in the particulate polymer in an amount not less than 90%. The added amount of the dispersion stabilizer is preferably changed depending on the species of the monomers used, but is generally from 0.1 to 10% by weight, and preferably from 1 to 5% by weight, based on the hydrophilic organic solvent used. When the added amount of the dispersion stabilizer is small, the resultant particulate resin has a relatively large particle diameter. In contrast, when the added amount of the dispersion stabilizer is large, the resultant particulate resin has a relatively small particle diameter. However, even when the added amount is greater than 10% by weight, the particle diameter of the resultant particulate resin hardly changes.

Then the seed polymerization method will be explained. In the seed polymerization method, a monomer and an initiator are polymerized in an aqueous medium or an organic solvent in the presence of the particulate resin prepared above, which serves as seed particles. In this case, one or more of the dispersion stabilizers and the surfacatants mentioned above can be used.

In order to prepare a particulate resin having a sharp particle diameter distribution by a seed polymerization method, the seed particles preferably have a sharp particle diameter distribution. Specifically, the seed particles are preferably subjected to sieving or classification so that the particles have a particle diameter distribution such that all the particles have a particle diameter within a range of ±20% of the average particle diameter thereof.

The added amount of the seed particles is preferably from 10 to 75% by weight, and more preferably from 15 to 50% by weight, based on the total weight of the resultant particulate resin. When the added amount is too small, problem in that the resultant resin has too high a molecular weight and a large amount of fine particles are produced, resulting in deterioration of productivity occur. When the added amount is too large, the resultant resin has poor moldability.

In the seed polymerization method, the added polymerization initiator is hardly absorbed by the seed particles when directly added into the aqueous suspension including the seed particles. Therefore, it is preferably to add a solution, suspension or emulsion of the initiator to the aqueous suspension. In this case, it is preferable that the initiator is dispersed into the inside of the seed particles to prepare a particulate resin having uniform molecular weight. In order to disperse the initiator into the seed particles, it is preferable to previously soften the seed particles with the polymerizable monomer used. From this point of view, the amount of the polymerizable monomer added to the suspension including the seed particles before the polymerization reaction is preferably not less than 25% by weight.

In the seed polymerization method, additives for use in preparing foamed resin particles such as plasticizers, foam forming agents, fillers, fire retardants, auxiliary agents for fire retardants, lubricants, and colorants can be optionally used.

When the particle diameter of the seed particles is large, the molecular weight of the resultant particulate resin increases. When the content of the seed particles is low, it is difficult to control the molecular weight of the resultant particulate resin. In order to control the molecular weight of the resultant particulate resin, it is important to allow the initiator to efficiently act. Specifically, it is important to add the initiator such that the initiator efficiently generates radicals during the polymerization reaction and to properly control (i.e. to balance) the conditions such as polymerization temperature, monomer feeding speed and polymerization degree. In order that the initiator used efficiently acts (i.e., in order to control the molecular weight of the resultant resin), a method in which addition of the polymerizable monomer is continuously performed while the system is heated from a low temperature to a high temperature is preferably used.

Then the method for polymerizing a monomer in a liquid will be explained.

One or more monomers are dispersed in an aqueous medium using a dispersing machine such as general agitators, high shearing force type agitators (e.g., TK HOMOMIXERS from Tokushu Kika kogyo and CLEAR MIX from M Tech Co.), and ultrasonic dispersing machines to prepare a monomer composition dispersion. In this case, agitating blades having a turbine form are more preferable than agitating blades having a paddle form. Alternatively, a method in which a dispersion phase is added upon application of pressure to a continuous phase through a porous material such as porous glass can be used to prepare a monomer composition dispersion.

When a dispersion is prepared by applying a shearing force thereto, the agitation speed and time are controlled so that the dispersed monomers have a particle diameter not greater than 30 μm. Specifically, the rotation speed of the turbine and the agitation time are preferably controlled so as to be from 10 to 30 m/s and from 5 to 60 minutes, respectively.

The mixing ratio (M/D) of the monomers (M) to the dispersion medium (D) is preferably from 100/200 to 100/3,000 by weight. When the monomers are polymerized, the air in the reaction vessel is preferably replaced with an inert gas such as nitrogen gas or argon gas. In the oxygen purging is insufficient, small particles tend to be formed.

By polymerizing the monomer composition thus granulized, a resin is prepared. In this polymerization process, the polymerization reaction proceeds while the dispersing state is maintained due to the action of the dispersion stabilizer. Therefore, the dispersion is preferably agitated to an extent such that the particles do not precipitate. The polymerization temperature is preferably not lower than 40° C. (more preferably from 60 to 90° C.). The polymerization is generally performed until the polymerization reaction is completed, and the polymerization time is generally from 2 to 48 hours. If desired, the polymerization reaction can be stopped when the resultant particulate polymer has a desired particle diameter and/or a desired particle diameter distribution. In addition, it is possible to sequentially add one or more polymerization initiators to increase the polymerization speed.

If desired, the thus prepared particulate resin is washed by a method using an acid, an alkali or water to remove the dispersant from the particulate resin.

Then the particulate image forming material of the present invention will be explained. Hereinafter, toner which is one example of the particulate image forming material will be mainly explained, but the particulate image forming material is not limited to the toner.

At first, the method of the present invention for preparing a particulate image forming material will be explained. The method includes at least a particulate image forming material providing step and a chain transfer agent removing step and optionally includes other steps.

Chain Transfer Agent Removing Step

In the method of the present invention, the chain transfer agent remaining in a particulate image forming material is removed using at least one of a supercritical fluid and a sub-critical fluid.

The particulate image forming material of the present invention is not particularly limited. Specific examples of the particulate image forming material include toners and carriers for use in the developers used for developing electrostatic latent images formed by a method such as electrophotography, electrostatic recording and electrostatic printing. The particulate image forming material is preferably prepared by the particle preparing method mentioned below. However, particles prepared by other methods or marketed products can also be used as long as the particles include a chain transfer agent.

Chain Transfer Agent

Specific examples of the chain transfer agents include compounds having the following formula (i) or (ii):

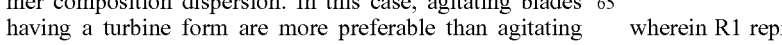

$$HS—R1—COOR2 \quad (i)$$

wherein R1 represents a hydrocarbon group having 1 to 10 carbon atoms which is optionally substituted, and R2 represents a hydrocarbon group having 2 to 20 carbon atoms which is optionally substituted, wherein R2 may be the same as or different from R1;

HS—R3 (ii)

wherein R3 represents a hydrocarbon group having 1 to 20 carbon atoms which is optionally substituted.

Suitable compounds having formula (i) include thioglycolic acid esters and 3-mercaptopropionic acid esters. Specific examples of the thioglycolic acid esters include ethyl thioglycollate, n-butyl thioglycollate, t-butyl thioglycollate, 2-ethylhexyl thioglycollate, octyl thioglycollate, isooctyl thioglycollate, decyl thioglycollate, dodecyl thioglycollate, ethylene glycol esters of thioglycolic acid, neopentyl glycol esters of thioglycolic acid, trimethylol propane esters of thioglycolic acid, pentaerythritol esters of thioglycolic acid, sorbitol esters of thioglycolic acid, etc.

Specific examples of the 3-mercaptopropionic acid esters include ethyl 3-mercaptopropionate, octyl 3-mercaptopropionate, decyl 3-mercaptopropionate, dodecyl 3-mercaptopropionate, pentaerythritol tetrakis esters of 3-mercaptopropionic acid, ethylene glycol esters of 3-mercaptopropionic acid, neopentyl glycol esters of 3-mercaptopropionic acid, trimethylol propane esters of 3-mercaptopropionic acid, pentaerythritol esters of 3-mercaptopropionic acid, sorbitol esters of 3-mercaptopropionic acid, etc.

Specific examples of the compounds having formula (ii) include n-octylmercaptan, 2-ethylhexylmercaptan, n-dodecylmercaptan, sec-dodecylmercaptan, t-dodecylmercaptan, etc.

Specific examples of other chain transfer agents include disulfides such as diisopropylzantogen disulfide; halogenated hydrocarbons such as carbon tetrachloride, carbon tetrabromide, ethyl dibromoacetate, ethyl tribromoacetate, dibromoethylbenzene, dibromoethane, and dichloroethane; diazothioether; hydrocarbones such as benzene, ethyl benzene and isopropyl benzene; etc.

The content of the chain transfer agent in the particulate image forming material is preferably from 0.01 to 10% by weight, and more preferably from 0.05 to 5% by weight.

Supercritical Fluid and Sub-Critical Fluid

The supercritical fluid is defined as a material which is present as a noncondensable high density fluid under temperature/pressure conditions higher than a critical point below which the materials can have both a gas state and a liquid state at the same time, i.e., a material which is present as a fluid under a condition in which the temperature is not lower than the critical temperature thereof and the pressure is not lower than the critical pressure, wherein the fluid is not condensed even when further compressed. Any known supercritical fluids can be used for the method of the present invention. Preferably, supercritical fluids which do not dissolve the constituents of the particulate image forming material and which can dissolve the chain transfer agent included in the particulate image forming material are used. In addition, supercritical fluids having a relatively low critical temperature are preferably used.

The sub-critical fluid is defined as a material which is present as a high pressure liquid under a temperature/pressure condition in the vicinity of the critical point of the material. Any known sub-critical fluids can be used for the method of the present invention.

Specific examples of the materials for use as the supercritical fluid and sub-critical fluid in the method for preparing the image forming material include carbon monoxide, carbon dioxide, ammonia, nitrogen, water, methanol, ethanol, ethane, propane, 2,3-dimethylbutane, benzene, chlorotrifluoromethane, dimethyl ether, etc. Among these materials, carbon dioxide is preferably used because of having a critical point near room temperature and good handling property. When a supercritical fluid such as carbon dioxide and carbon monoxide, which have a critical temperature near room temperature, specifically, from 30 to 40° C., is used, the supercritical fluid is preferably used under conditions of from 25 to 100° C. in temperature and from 5 to 50 MPa in pressure. When the temperature is lower than 25° C., or the pressure is lower than 5 MPa, carbon monoxide and carbon dioxide cannot achieve a supercritical state. In contrast, when the temperature is too high, there is a possibility that the resins included in the particulate image forming material generate a gas or are decomposed. When the pressure is too high, a problem in that the pump used for transporting the supercritical fluid is damaged tends to occur. Carbon dioxide has a critical temperature of 31° C., and a critical pressure of 7.53 MPa. Carbon monoxide has a critical temperature of 37° C., and a critical pressure of 7.26 MPa.

The materials mentioned above for use as the supercritical fluid can be used as sub-critical fluids under a temperature slightly lower than the critical temperature thereof or a pressure slightly lower than the critical pressure. For example, the chain transfer agent included in a particulate image forming material can be extracted and removed by being contacted with a sub-critical fluid such as sub-critical carbon dioxide. In a case where the properties of the image forming material (such as formula and shape) are changed if the image forming material is contacted with a supercritical fluid, it is preferable to use a sub-critical fluid instead of the supercritical fluid. Thus, the supercritical fluids can be used as sub-critical fluids.

The supercritical fluids and sub-critical fluids mentioned above can be used alone or in combination.

The critical temperature and critical pressure of the materials for use as the supercritical fluid used for preparing the particulate image forming material of the present invention are not particularly limited. However, the critical temperature is preferably from −273 to 300° C. and more preferably from 0 to 200° C. In this case, the critical pressure is not particularly limited if the materials can achieve a supercritical state, but is preferably from 1 to 60 MPa.

Other fluids (hereinafter referred to as second fluids) can be used in combination with the supercritical (or sub-critical) fluids mentioned above. Suitable materials for use as the second fluids include materials which have good affinity for the materials having a low softening point (i.e., the chain transfer agent to be removed) and which do not dissolve the material forming the shell of the particulate image forming material having a core-shell structure. Specific examples of the second fluids include nitrogen monoxide, ethane, propane, ethylene, etc.

The mixing ratio of a supercritical (or sub-critical) fluid to a second fluid is not particularly limited, namely, the mixing ratio is determined depending on the application of the mixed fluid.

Polar materials such as organic solvents and ammonia can be used in combination with the supercritical (or sub-critical) fluids mentioned above as entrainers. By using such an entrainer in combination with a supercritical (or sub-critical) fluid, a chain transfer agent included in a particulate image forming material can be easily removed. The added amount of the entrainer is generally few percent by weight of the supercritical (or sub-critical) liquid used.

Specific examples of the entrainers include methanol, ammonia, melamine, urea, thiodiethylene glycol, chloroform, etc., but are not limited thereto.

Among these solvents, chloroform is preferably used because of being able to dissolve polymerizable monomers remaining in the particulate image forming material. In addition, by using chloroform, the chain transfer agent in the image forming material can be well removed.

Removal of Chain Transfer Agent

The chain transfer agent remaining in the particulate image forming material is removed using a supercritical fluid and/or a sub-critical fluid. The portion of the image forming material from which the chain transfer agent is removed is not particularly limited. Namely, it is preferable that not only the chain transfer agent in the surface portion but also the chain transfer agent inside the image forming material are removed. When it is desired to change the removing portion from the outer portion of an image forming material to the inner portion thereof, it is preferable to change, for example, the treatment temperature, treatment pressure and/or species of the supercritical fluid (or sub-critical fluid) used.

The chain transfer agent removing method of the present invention includes at least a process in which the image forming material is brought into contact with a supercritical (or sub-critical) fluid. Other processes can be performed if desired.

The contacting process is performed, for example, as follows:

(1) The particulate image forming material from which a chain transfer agent is to be removed is contained in a container through which the supercritical fluid (or the sub-critical fluid) used can pass but from which the image forming material cannot be discharged, and the particulate image forming material is contacted with the supercritical (or sub-critical) fluid in the container; or (2) The particulate image forming material from which a chain transfer agent is to be removed and a material are contained in a closed container and the mixture is heated and pressed so that the material can achieve a supercritical (or sub-critical) state.

The apparatus for use in the chain transfer agent removing process is not particularly limited, as long as the apparatus has a pressure-resistant container in which a particulate image forming material is subjected to a chain transfer agent removing treatment, a pressure pump configured to feed a supercritical fluid (or a sub-critical fluid), and a separation vessel in which the mixture gas is separated into the chain transfer agent and the material used as the supercritical (or sub-critical) fluid using a decompression valve.

One example of the chain transfer removing method is as follows. At first, a particulate image forming material from which a chain transfer agent is to be removed is contained in a pressure-resistant container. Then a supercritical (or sub-critical) fluid is fed into the pressure-resistant container using a pressure pump to contact the supercritical fluid with the particulate image forming material such that the chain transfer agent in the particulate image forming material is removed therefrom. Then the mixture of the chain transfer agent and the supercritical fluid (or sub-critical fluid) is discharged from the container. When the thus discharged supercritical fluid (or sub-critical fluid) is present under normal temperature/normal pressure conditions, the fluid achieve a gaseous state. Therefore, it is not necessary to dispose of a waste liquid. In contrast, in conventional chain transfer removing methods, it is necessary to dispose of solvents such as water which are used for washing the particulate image forming material. In this case, the mixture can be subjected to a pressure reduction treatment using a decompression valve to separate the chain transfer agent from the supercritical fluid, i.e., to reuse the supercritical fluid. Thus, the chain transfer removing method of the present invention is environment-friendly.

The treatment temperature is not particularly limited as long as the temperature is higher than the critical temperature of the supercritical (or sub-critical) fluid. The critical temperature is preferably not higher than the melting points of the materials constituting the image forming material, i.e., a temperature at which the particulate image forming material does not cause an agglomeration problem in that particles of the image forming material do not adhere to each other. The critical temperature is preferably a temperature at which the second fluids and solvents used in combination with the supercritical (or sub-critical) fluid achieve a gaseous state.

Specifically, the treatment temperature is preferably from 0 to 100° C., more preferably from 20 to 80° C., and even more preferably from 40 to 60° C. When the treatment temperature is too low, it is difficult to remove water adsorbed on the surface of the particulate image forming material. In contrast, when the treatment temperature is too high, the agglomeration problem tends to occur.

Thus, a chain transfer agent remaining in a particulate image forming material is removed using a supercritical (or sub-critical) fluid.

Particulate Image Forming Material Preparation Process

Then the method for preparing the particulate image forming material will be explained.

Particulate Image Forming Material

The particulate image forming material for use in the present invention is not particularly limited. Specific examples of the particulate image forming material include pulverization toners, polymerization toners, microcapsules which are prepared by a method such as spray-drying methods and coacervation methods, carriers, etc. Then a polymerized toner which is a typical example of the particulate image forming material of the present invention will be explained in detail.

Known polymerization toners can be used as the polymerization toner for use in the chain transfer agent removing method of the present invention. However, the polymerization toners prepared by one of the following methods are preferably used.

(1) polymerization toners prepared by emulsified particle agglomeration methods in which a radical-polymerizable monomer is subjected to an emulsification polymerization reaction in an aqueous medium-using water soluble polymerization initiator, and the resultant resin particles are agglomerated or fused to prepare agglomerated resin particles, which are used for toner particles;

(2) polymerization toners prepared by suspension polymerization methods in which a polymerizable mixture including at least a polymerization monomer and a polymerization initiator is added in an aqueous medium including a suspension stabilizer, and the mixture is subjected to a polymerization reaction while the suspension is agitated to prepare toner particles; and (3) polymerization toners prepared by dispersion polymerization methods in which a mixture of a hydrophilic organic solvent and a polymer dispersant which can be dissolved in the organic solvent is mixed with a radical-polymerizable monomer which can be dissolved in the organic solvent but whose polymer is swelled or is hardly dissolved in the organic solvent, and then the mixture is subjected to a polymerization reaction to prepare toner particles.

The toner particles preferably include one or more materials such as colorants, release agents, resins, and charge controlling agents other than the binder resins prepared in the polymerization process.

Polymerization Initiator

In the toner of the present invention, a polymerization initiator is used for polymerizing polymerizable monomers.

Specific examples of the polymerization initiator include azo-type polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobismethylbutyronitrile; organic peroxide-type polymerization initiators such as benzoylperoxide, lauroylperoxide, di-α-cumylperoxide, 2,5-dimethyl2,5-bis(benzoylperoxy)hexane, bis(4-tert-butylcyclohexyl)peroxydicarbonate, 1,1-bis(tert-butylperoxy) cyclododecane, tert-butylperoxymaleic acid, bis(tert-butylperoxy)isophthalate, methyl ethyl ketone peroxide, tert-butylperoxy-2-ethylhexanoate, diisopropylperoxycarbonate, cumenehydroperoxide, and 2,4-dichlorobenzoylperoxide; redox initiators such as combinations of oxidizing materials (e.g., inorganic peroxides such as hydrogen peroxide, persulfates (sodium salts, potassium salts, ammonium salts, etc.), and oxidizing metal salts such as tetravalent cerium salts) with reducing materials such as amino compounds (e.g., ammonia, lower amines (such as amines having 1 to about 6 carbon atoms, for example, methyl amine and ethyl amine), and hydroxylamines), reducing sulfur-containing compounds (e.g., sodium thiosulfate, sodium hydrogen sulfite, sodium sulfite, and sodium formaldehyde sulfoxylate), and other reducing materials (such as lower alcohols having 1 to about 6 carbon atoms, ascorbinic acid and its salts, and lower aldehydes having 1 to about 6 carbon atoms); etc.

One or more suitable initiators are selected and used while considering the 10-hour half-life temperature thereof. The added amount of the initiator is determined while considering the target polymerization degree of the resultant binder resin, but is generally from 0.1 to 20% by weight and preferably from 0.5 to 5% by weight based on the weight of the polymerizable monomer used.

Polymerizable Monomer

Suitable polymerizable monomers for use in the polymerizing mixture include radically polymerizable vinyl monomers including monofunctional polymerizable monomers and polyfunctional polymerizable monomers.

Specific examples of the monofunctional polymerizable monomers include styrene derivatives such as styrene, α-methylstyrene, βmethylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethyl acrylate, diethylphosphate ethyl acrylate, dibutylphosphate ethyl acrylate, and 2-benzoyloxyethyl acrylate; methacrylic monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethyl methacrylate, dibutylphosphate ethyl methacrylate; vinyl esters such as methylenealiphaticmonocarboxylic acid esters, vinyl acetate, vinyl propionate, vinyl butyrate, vinyl benzoate, vinyl formate; vinyl ethers such as vinyl methyl ether, vinyl ethyl ether, and vinyl isobutyl ether; vinyl ketones such as vinyl methyl ketone, vinyl hexyl ketone, and vinyl isopropyl ketone; etc.

Specific examples of the polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis {4-(acryloxydiethoxy) phenyl}propane, trimethylolpropane triacrylate, tetramethylolmethane tetraacrylate, ethylene glycol dimethacrylate, diethylene glycol dimethacrylate,triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis {4-(methacryloxydiethoxy)phenyl} propane, 2,2'-bis {4-(methacryloxypolythoxy)phenyl}propane, trimethylolpropane trimethacrylate, tetramethylolmethane tetramethacrylate, divinyl ether, etc.

The monofunctional polymerizable monomers mentioned above can be used alone or in combination. In addition, polyfunctional polymerizable monomers can be used together with one or more of monofunctional monomers. Among the monomers mentioned above, styrene, and/or styrene derivatives are preferably used alone or in combination with other monomers in view of developability and durability of the resultant toner.

Crosslinking Agent

The binder resin of the toner of the present invention can include a crosslinked polymer, which can be provided by polymerizing one or more of the above-mentioned polymerizable monomers in the presence of a crosslinking agent.

Specific examples of the crosslinking agents include known crosslinking agents such as divinyl benzene, divinyl naphthalene, divinyl ether, divinyl sulfone, diethylene glycol dimethacrylate, triethylene glycol dimethacrylate, ethylene glycol dimethacrylate, polyethylene glycol dimethacrylate, diethylene glycol diacrylate, triethylene glycol diacrylate, 1,3-butylene glycol dimethacrylate, 1,6-hexanediol dimethacrylate, neopentyl glycol dimethacrylate, dipropylene glycol dimethacrylate, polypropylene glycol dimethacrylate, 2,2'-bis(4-acryloxydiethoxyphenyl)propane, -bis(4-methacryloxydiethoxyphenyl) propane, trimethylolpropane trimethacrylate, trimethylolpropane triacrylate, tetramethylolmethane tetraacrylate, dibromoneopentyl glycol dimethacrylate, and allyl phthalate.

When the added amount of the crosslinking agent is too large, the resultant toner is not easily melted, resulting in deterioration of fixability of the toner. In contrast, when the added amount is too small, the blocking resistance and durability of the toner deteriorate. Specifically, an offset problem in that toner particles constituting a toner image are adhered to a fixing member and then the toner particles adhered to the fixing member are re-transferred to another portion of the receiving sheet bearing the toner image or the following receiving sheet, resulting in formation of an undesired image occurs. Therefore, the added amount of the crosslinking agent is preferably from 0.001 to 15% by weight and more preferably from 0.1 to 10% by weight based on the total weight of the monomers used.

Other materials can be used when toner particles are prepared. Specific examples of such materials include colorants, release agents, particulate inorganic materials, particulate resins, charge controlling agents, particulate polymers, fluidity improving agents, cleanability improving agents, magnetic materials, etc.

Colorant

The toner for use in the present invention includes a colorant. Suitable materials for use as the colorant include known dyes and pigments.

Specific examples of the dyes and pigments include carbon black, Nigrosine dyes, black iron oxide, NAPHTHOL YELLOW S (C.I. 10316), HANSA YELLOW 10G (C.I. 11710), HANSA YELLOW 5G (C.I. 11660), HANSA YELLOW G (C.I. 11680), Cadmium Yellow, yellow iron oxide, loess, chrome yellow, Titan Yellow, polyazo yellow, Oil Yellow, HANSA YELLOW GR (C.I. 11730), HANSA YELLOW A (C.I. 11735), HANSA YELLOW RN (C.I. 11740), HANSA YELLOW R (C.I. 12710), PIGMENT YELLOW L (C.I. 12720), BENZIDINE YELLOW G (C.I. 21095), BENZIDINE YELLOW GR (C.I. 21100), PERMANENT YELLOW NCG (C.I. 20040), VULCAN FAST YELLOW 5G (C.I. 21220), VULCAN FAST YELLOW R (C.I. 21135), Tartrazine Lake, QUINOLINE YELLOW LAKE, ANTHRAZANE YELLOW BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, BRILLIANT CARMINE BS, PERMANENT RED F2R (C.I. 12310), PERMANENT RED F4R (C.I. 12335), PERMANENT RED FRL (C.I. 12440), PERMANENT RED FRLL (C.I. 12460), PERMANENT RED F4RH(C.I. 12420), Fast Scarlet VD, VULCAN FAST RUBINE B (C.I. 12320), BRILLIANT SCARLET G, LITHOL RUBINE GX (C.I. 12825), PERMANENT RED F5R, BRILLIANT CARMINE 6B, Pigment Scarlet 3B, Bordeaux 5B, Toluidine Maroon, PERMANENT BORDEAUX F2K (C.I. 12170), HELIO BORDEAUX BL (C.I. 14830), BORDEAUX 10B, BON MAROON LIGHT (C.I. 15825), BON MAROON MEDIUM (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS (C.I. 69800), INDANTHRENE BLUE BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner. When the content is too low, the resultant toner cannot produce images with high image density. When the content is too high, problems in that the resultant toner cannot produce images with high image density and has poor electrostatic properties due to defective dispersion of the colorant in the toner occur.

Masterbatches, which are complexes of a colorant with a resin, can be used as the colorant of the toner of the present invention.

Specific examples of the resins for use as the binder resin of the master batches include polymers of styrene or styrene derivatives, styrene copolymers, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

Specific examples of the polymers of styrene or styrene derivatives include polystyrene, poly-p-chlorostyrene and polyvinyltoluene. Specific examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

Release Agent

The toner of the present invention can include a release agent. Suitable materials for use as the release agent include waxes. Specific examples of the waxes include synthetic waxes such as low molecular weight olefin waxes, synthetic hydrocarbon waxes, natural waxes, petroleum waxes, higher fatty acids and their derivatives, higher fatty acid amide, and modified versions of these waxes. These waxes can be used alone or in combination.

Specific examples of the low molecular weight polyolefin waxes include low molecular weight polyethylene and polypropylene. Specific examples of the synthetic hydrocarbon waxes include Fischer-Tropsch waxes. Specific examples of the natural waxes include bees waxes, carnauba waxes, candelilla waxes, rice waxes, and montan waxes. Specific examples of the petroleum waxes include paraffin waxes and microcrystalline waxes. Specific examples of the higher fatty acids include stearic acid, palmitic acid and myristic acid.

The melting point of the release agent included in the toner of the present invention preferably is not particularly limited but is preferably from 40 to 160° C., more preferably from 50 to 120° C., and even more preferably from 60 to 90° C.

When the melting point is too low, the resultant toner has a poor high temperature preservability. In contrast, when the melting point is too high, the toner causes a cold offset problem in that a part of a toner image is adhered to a fixing roller at a relatively low fixing temperature, resulting in production of abnormal images and/or occurrence of a paper jamming problem in that a receiving sheet bearing the toner image thereon is wound around the fixing roller.

The release agent is typically included in the toner in an amount of from 0 to 40 parts by weight, and preferably from 3 to 30 parts by weight, per 100 parts by weight of the toner. When the added amount is too large, problems in that the resultant toner has poor low temperature fixability and/or the resultant images have too high glossiness occur.

Particulate Inorganic Material

The toner of the present invention can include a particulate inorganic material.

Specific examples of the particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. These are used alone or in combination.

The primary particle diameter of the particulate inorganic material included in the toner of the present invention is preferably from 5 nm to 2 μm, and more preferably from 5 nm to 500 nm. The specific surface area of the particulate inorganic material is preferably from 20 to 500 $m^2/g$ when measured by a BET method.

The content of the particulate inorganic material is preferably from 0.01% to 5.0% by weight, and more preferably from 0.01% to 2.0% by weight, based on the total weight of the toner. It is preferable to use such a particulate inorganic material as an external additive. The external additive will be explained below in detail.

Charge Controlling Agent

The toner of the present invention can include a charge controlling agent, if desired. Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. Among these materials, metal salts of salicylic acid and salicylic acid derivatives are preferably used. These materials can be used alone or in combination.

Specific examples of the metal for use in the metal salts mentioned above include aluminum, zinc, titanium, strontium, boron, silicon, nickel, iron, chromium, zirconium, etc.

Specific examples of the marketed charge controlling agents include BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, a quaternary ammonium group, etc.

The charge controlling agent can be included in the toner by a method in which a mixture of the charge controlling agent and the masterbatch, which have been melted and kneaded, is dissolved or dispersed in a solvent and the resultant solution or dispersion is dispersed in an aqueous medium to prepare a toner dispersion or a method in which the charge controlling agent is dissolved or dispersed together with other toner constituents to prepare a toner constituent mixture liquid and the mixture liquid is dispersed in an aqueous medium to prepare a toner dispersion. Alternatively, the charge controlling agent can be fixed on a surface of the toner after toner particles are prepared.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 1 to 5 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner increases, resulting in deterioration of fluidity and decrease of image density.

Particulate Polymer

Specific examples of the particulate polymer for use in the image forming material of the present invention includes particles of thermoplastic or thermosetting resins such as such as polystyrene, (meth)acrylate copolymers, silicone resins, benzoguanamine resins, nylon resins, etc, which are prepared by a method such as soap-free emulsion polymerization methods, suspension polymerization methods and dispersion polymerization methods, but are not limited thereto. These resins can be used alone or in combination.

Fluidity Improving Agent

The particulate inorganic materials and the particulate polymers mentioned above (i.e., the fluidity improving agent) can be subjected to a surface treatment to impart good hydrophobic property and good charge property to the image forming material even under high humidity conditions. Specific examples of the surface treatment agents include silane coupling agents, silylation agents, silane coupling agents having a fluoroalkyl group, organic titanate coupling agents, aluminum coupling agents, silicone oils, modified silicone oils, etc. These materials can be used alone or in combination.

Cleanability Improving Agent

A cleanability improving agent can be added into the toner so that the toner particles remaining on the surface of an image bearing member such as photoreceptors and intermediate transfer media can be easily removed therefrom by a cleaner. Specific examples of the cleanability improving agents include fatty acids and salts thereof such as stearic acid, zinc stearate and calcium stearate; particles of polymers which are prepared by a method such as soap-free emulsion polymerization methods, such as polymethyl methacrylate and polystyrene; etc. It is preferable for the particulate polymers to have a narrow particle diameter distribution and a volume average particle diameter of from 0.01 to 1 μm. These materials can be used alone or in combination.

Specific examples of the magnetic materials for use in the toner include iron oxides such as magnetite, hematite and ferrite; metals such as iron, cobalt and nickel; alloys of the metals mentioned above with another metal such as aluminum, cobalt, copper, lead, magnesium, tin, zinc, antimony, beryllium, bismuth, cadmium, calcium, manganese, selenium, titanium, tungsten and vanadium; etc. These materials can be used alone or in combination.

When the toner includes a magnetic material, the magnetic material preferably has an average particle diameter not greater than 2 μm, and more preferably from 0.1 to 0.5 μm. The content of the magnetic material in the image forming material is from 20 to 200 parts by weight, and more preferably from 40 to 150 parts by weight, per 100 parts by weight of the polymerizable monomers used.

In addition, it is preferable for the magnetic material to have a coercive force (Hc) of from 1.6 to 24 kA/m, a saturation magnetization (σ s) of from 50 to 200 $Am^2/kg$, and a residual magnetization (σ r) of from 2 to 20 $Am^2/kg$.

In order to improve the dispersibility of the magnetic material in the toner particles, the surface of the magnetic material is preferably hydrophobized. Suitable hydrophobizing agents include coupling agents such as silane coupling agents and titanium coupling agents. Among these coupling agents, silane coupling agents are preferably used. Specific examples of the silane coupling agents include vinyl trimethoxy silane, vinyl triethoxy silane, γ-methacryloxypropyl trimethoxy silane, vinyl triacetoxy silane, methyl trimethoxy silane, methyl triethoxy silane, isobutyl trimethoxy silane, hydroxypropyl trimethoxy silane, phenyl trimethoxy silane, n-hexadecyl trimethoxy silane, n-octadecyl trimethoxy silane, etc.

Then the typical method for preparing the particulate image forming material of the present invention, i.e., the emulsified particle agglomeration method, the suspension polymerization and dispersion polymerization will be explained.

At first, the emulsified particle agglomeration method will be explained.

The emulsified particle agglomeration method includes a process in which a polymerizable monomer is subjected to emulsion polymerization in an aqueous medium including an additive to prepare a particulate polymer; and a process in which an organic solvent or an agglomeration agent is added thereto to agglomerate or fuse the particulate polymer. Other toner constituents such as colorants and release agents can be added in the agglomeration process or dispersed together with the polymerizable monomer in the liquid including the additive before the emulsion polymerization is performed. In the agglomeration (or fusion) process, several polymer particles (and colorant particles) are agglomerated. In this regard, the aqueous medium mentioned above includes water in an amount not less than 50% by weight.

Specific examples of the emulsified particle agglomeration method is include the methods disclosed in JP-A 05-265252, 06-329947 and 09-15904. Specifically, an agglomeration method in which several particles of toner constituents such as binder resins, colorants, and other additives, which are dispersed in a liquid or several particles including at least a binder resin and a colorant are agglomerated can be used. In particular, the following method is preferably used.

(1) a dispersion in which such toner constituents as mentioned above are dispersed in an aqueous medium is subjected to salting-out by adding a coagulant in an amount greater than a critical coagulation concentration of the coagulant while being heated to a temperature not lower than the glass transition temperature of the binder resin so that the dispersed particles are fused, resulting in formation of agglomerated/fused particles of the toner constituents;
(2) when the agglomerated particles have a desired particle diameter, a large amount of water is added to the dispersion to prevent increase of the particle diameter of the particles;
(3) the dispersion is further heated while agitated to smooth the surface of the agglomerated particles (i.e., to control the shape of the particles); and
(4) the dispersion is heated while agitated to evaporate the aqueous medium and to obtain dried toner particles.

When the coagulant is added, an organic solvent which can be mixed with water in any mixing ratio can be used in combination therewith.

Particulate Polymer

The particulate polymer for use in the emulsified particle agglomeration method can be typically prepared by a method such as emulsion polymerization methods, mini-emulsion polymerization methods, suspension polymerization methods, dispersion polymerization methods, precipitation polymerization methods, interfacial polymerization methods, resin particle pulverization methods, etc. Among these methods, emulsion polymerization methods and mini-emulsion methods are preferably used.

In the emulsion polymerization methods, an emulsified polymerizable monomer is polymerized at a predetermined temperature using a polymerization initiator.

The mini-emulsion polymerization methods typically include the following process:

(1) a surfactant is dissolved in an aqueous medium in an amount not higher than the critical micellar concentration (CMC) of the surfactant;
(2) a radical polymerizable composition liquid including at least a radical polymerizable monomer and a release agent is dispersed in the aqueous medium prepared above while the mixture is mechanically agitated such that the dispersed oil drops have a particle diameter of from 10 to 1000 nm, resulting in formation of an emulsion; and
(3) a water soluble polymerization initiator is added to the emulsion and the mixture is subjected to radical polymerization.

When the mini-emulsion polymerization is performed, the conditions such as polymerization temperature, polymerization time, energy of the mechanical agitation, and choice of the polymerization initiator, the chain transfer agent and the polymerization medium are not particularly limited and are determined depending on the targeted polymerization degree and particle diameter of the polymer particles.

In this case, toner constituents such as colorants, release agents, particulate inorganic materials, particulate resins, charge controlling agents, particulate polymers, fluidity improving agents, cleanabililty improving agents and magnetic materials can be previously dispersed in the aqueous medium including a surfactant in an amount higher than the critical micellar concentration (CMC) thereof. Then the dispersion is diluted so that the content of the surfactant is not higher than the CMC of the surfactant, resulting in formation of a complex of the resin and the toner constituents.

The particle diameter of the particulate polymer is not particularly limited if the particle diameter is not less than the desired particle diameter of the toner particles, and is typically from 0.01 to 10 μm.

Coagulant

The coagulant is not particularly limited, but metal salts are preferably used. Specific examples of metals for use as the metal salts include monovalent metals such as alkali metals (e.g., sodium, potassium and lithium); divalent metals such as alkali earth metals (e.g., calcium and magnesium), and manganese and copper; trivalent metals such as iron, and aluminum; etc. Specific examples of the metal salts include sodium chloride, potassium chloride, lithium chloride, calcium chloride, zinc chloride, copper sulfate, magnesium sulfate, manganese sulfate, etc.

The coagulant is preferably added in an amount not lower than the critical coagulation concentration above which the stable aqueous dispersion mixed with the coagulant is coagulated. The critical coagulation concentration changes depending on the species of the emulsified components and choice of the dispersant. The critical coagulation concentration is discussed in detail in POLYMER CHEMISTRY 17, 601 (1960) by Seizo OKAMURA published by Japan Polymer Society, and can be determined by the method described therein. Alternatively, the critical coagulation concentration can be determined by the following method:

(1) a salt is added to the desired particle dispersion while the concentration is changed and the zeta (ζ) potential of the mixture is measured; and (2) the critical coagulation concentration is determined as the point at which the zeta (ζ) potential is sharply changes.

The concentration of the coagulant is not less than the critical coagulation concentration, preferably not less than 1.2 times the critical coagulation concentration, and more preferably not less than 1.5 times the critical coagulation concentration.

Suitable solvents for use as the solvent which can be mixed with water in any mixing ratio include solvents which do not dissolve the resin in the dispersion. Specific examples of such solvents include alcohols such as methanol, ethanol, propanol, isopropanol, t-butanol, methoxyethanol, and butoxyethanol; nitrites such as acetonitrile; ethers such as dioxane; etc. Among these solvents, ethanol, propanol and isopropanol are preferably used.

The added amount of the solvent is from 1 to 100% by volume based on the dispersion to which the coagulant is added.

In order to prepare particles having a uniform shape, it is preferable to dry the slurry, which is obtained by filtering the dispersion and which includes water in an amount not less than 10% by weight, while fluidizing the slurry. In this case, the polymer in the particles preferably includes a polar group because the polymer is slightly swelled by water and thereby the shape of the particles can be uniformed.

Then the suspension polymerization methods will be explained.

In the suspension polymerization methods, a polymerizable composition including a polymerizable monomer, a polymerization initiator, a colorant, a release agent, etc., is added to an aqueous dispersion medium including a suspension stabilizer (preferably an anionic dispersant), and the mixture is polymerized while the mixture is agitated. The polymerizable composition preferably includes a cationic polymer. The thus prepared toner includes a release agent in the particles, and thereby the fixability and offset resistance of the toner can be dramatically improved.

Specific examples of the suspension polymerization methods include methods disclosed in published examined Japanese patent applications Nos. 36-10231, 47-51830 and 51-14895, and JP-As 53-17735, 53-17736 and 53-17737, but are not limited thereto.

Dispersion Stabilizer

In order to well disperse a polymerizable monomer in an aqueous medium, one or more dispersion stabilizers can be used.

Specific examples of inorganic dispersion stabilizers include particles (having a particle diameter not greater than 1 μm) of metals such as cobalt, iron, nickel, aluminum, copper, tin, lead and magnesium, and metal alloys thereof; particulate inorganic compounds such as tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, titania, iron oxide, copper oxide, nickel oxide, and zinc oxide. In addition, pigments and dyes such as carbon black, Nigrosine dyes, Aniline Blue, Chrome Yellow, Phthalocyanine Blue and Rose Bengale can also be used as the dispersion stabilizer.

Specific examples of the organic dispersion stabilizers include polymers and copolymers prepared using one or more monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate), acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the dispersant.

Further, copolymers of the above-mentioned hydrophilic monomers with monomers having a benzene ring or the derivatives of the monomers; copolymers of the above-mentioned hydrophilic monomers with derivatives of acrylic acid or methacrylic acid, such as acrylonitrile, methacrylonitrile and acrylamide; and copolymers of the above-mentioned hydrophilic monomers with one or more of crosslinking monomers such as ethylene glycol dimethacrylate, diethylene glycol methacrylate, ally methacrylate, and divinyl benzene, can also be used as the dispersion stabilizer.

In addition, particulate resins can also be used as the dispersion stabilizer. Suitable resins for use as the dispersion stabilizer include any known thermoplastic or thermosetting resins which can form a dispersion in an aqueous medium. Specific examples of such resins include vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resin dispersion stabilizers, one or more of vinyl resins, polyurethane resins, epoxy resins, and polyester resins are preferably used because an aqueous resin dispersion including fine spherical resin particles can be prepared.

Specific examples of the vinyl resins include homopolymers and copolymers of one or more vinyl monomers, such as styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylate copolymers, etc.

Copolymers obtained from a monomer having two or more unsaturated groups therein can be preferably used as the resin dispersion stabilizer. Specific examples of such a monomer include sodium salts of sulfates of ethylene oxide adducts of methacrylic acid (for example, ELEMINOL RS-30 from Sanyo Chemical Industries Ltd.), divinyl benzene, 1,6-hexanediol diacrylate, etc.

The resin dispersion stabilizers preferably have a volume average particle diameter of from 20 to 400 nm, and preferably from 30 to 350 nm. When the volume average particle diameter is too small, a film of the resin dispersion stabilizer is formed on the particles of the resultant image forming material (i.e., toner), or the resin dispersion stabilizer densely covers the entire surface of the particles of the resultant toner. In this case, adhesion of the binder resin in the toner to image receiving materials such as papers is prevented, and thereby the minimum fixable temperature increases. In contrast, when the volume average particle diameter is too large, the resin dispersion stabilizer prevents the exudation of the wax in the toner in the fixing process, resulting in deterioration of the releasability of the toner, and thereby an offset problem is caused.

The surface of the toner particles is preferably covered with the resin dispersion stabilizer in a covering ratio of from 75 to 100%, and more preferably from 80 to 100%. When the covering ratio is too low, a blocking problem in that the toner particles adhered to each other when the toner is preserved or used is caused. The resin dispersion stabilizer is included in the toner in an amount of from 0.5 to 8.0% by weight, and more preferably from 0.6 to 7.0% by weight, based on the weight of the toner. When the content of the resin dispersion stabilizer is too low, the toner has poor preservability, i.e., the toner tends to cause the blocking problem. When the content is too high, the resin dispersion stabilizer prevents exudation of the wax included in the toner particles, resulting in deterioration of the releasability of the toner, and thereby an offset problem is caused.

The dispersion stabilizer is preferably used in an amount of from 0.2 to 10.0 parts by weight per 100 parts by weight of the monomers used.

Marketed dispersion stabilizers can be used without modification. When an inorganic dispersion stabilizer is used, a method in which an inorganic dispersion stabilizer is prepared in a dispersion medium can also be used. For example, an aqueous sodium phosphate solution and an aqueous calcium chloride solution are added into water while agitating to produce tricalcium phosphate dispersion, which can be used as a dispersion stabilizer. In this case, the resultant tricalcium phosphate can be preferably used as a dispersion stabilizer for the suspension polymerization methods because of having fine particle diameter and uniform particle diameter distribution.

Surfactant

When an inorganic dispersion stabilizer is used, a surfactant is preferably used in an amount of from 0.001 to 0.1% by weight based on the weight of the monomers used to assist the inorganic dispersion stabilizer in dispersing the monomers. Suitable surfactants include the following ionic surfactants but are not limited thereto.

Specific examples of the ionic surfactants include sulfonates (e.g., sodium dodecylbenzenesulfonate, sodium arylalkylpolyether sulfonate, sodium 3,3-disulfonediphenylurea-4,4-diazo-bis-amino8-naphthol-6-sulfonate, o-carboxylbenzene-azo-dimethylaniline, and sodium 2,2,5,5-tetramethyl-triphenylmethane-4,4-diazo-bis-β-naphthol-6-sulfonate); sulfates (e.g., sodium dodecylsulfate, sodium tetradecylsulfate, sodium pentadecylsulfate and sodium octylsulfate); salts of fatty acid (e.g., sodium oleate, sodium laurate, sodium caprate, sodium caprylate, sodium caproate, potassium stearate and calcium oleate; etc.

In addition, nonionic surfactants can be used. Specific examples of the nonionic surfactants include polyethylene oxide, polypropylene oxide, combinations of polyethylene oxide and polypropylene oxide, esters of polyethylene glycol and higher fatty acids, alkylphenolpolyethylene glycol, esters of polypropylene oxide and higher fatty acids, sorbitan esters, etc.

When a water-soluble monomer is used, emulsion polymerization is caused at the same time and thereby a problem in that the resultant suspension-polymerization polymer particles include emulsion-polymerization polymer particles is caused. In this case, a water-soluble polymerization inhibitor such as metal salts can be added to prevent the emulsion polymerization in the aqueous phase. In addition, alcohols such as glycerin and glycols can be added to prevent agglomeration of resultant particles by increasing the viscosity of the continuous phase (i.e., the dispersion medium). Further, salts such as NaCl, KCl and $Na_2SO_4$ can be added to decrease the solubility of a water-soluble monomer to water. These materials are mainly used for emulsion polymerization methods, but can be used for other polymerization methods or for other purposes.

Then the dispersion polymerization methods will be explained.

The dispersion polymerization methods are as follows. A polymer dispersant is dissolved in a hydrophilic organic solvent and then a monomer which is not dissolved in the hydrophilic organic solvent but whose polymer is swelled by or is hardly dissolved in the hydrophilic organic solvent and a polymerization initiator are added thereto, followed by polymerization to prepare a particulate polymer.

Specific examples of the dispersion polymerization methods include methods disclosed in JP-As 04-306664, 05-181315, 07-092731 and 08-160660, but are not limited thereto.

Hydrophilic Organic Solvent

Specific examples of the hydrophilic organic solvents for use in the dispersion polymerization method include alcohols such as methyl alcohol, ethyl alcohol, denatured alcohol, isopropyl alcohol, n-butyl alcohol, isobutyl alcohol, tert-butyl alcohol, sec-butyl alcohol, tert-amyl alcohol, 3-pentanol, octyl alcohol, benzyl alcohol, cyclohexanol, furfuryl alcohol, tetrahydrofurfuryl alcohol, ethylene glycol, glycerin, and diethylene glycol; ether alcohols such as methylcellosolve, cellosolve, isopropyl cellosolve, butyl cellosolve, ethylene glycol monomethyl ether, ethylene glycol monoethyl ether, diethylene glycol monomethyl ether, and diethylene glycol monoethyl ether; etc. These solvents are used alone or in combination.

By using a second organic solvent in combination with the above-mentioned alcohols and ether alcohols, it becomes possible to perform polymerization under conditions in which generated particles are insoluble in the mixture solvent by properly controlling the SP value of the mixture solvent and polymerization conditions. By using this method, problems in that the generated particles are adhered to each other, resulting in agglomeration of the particles, and new particles are generated can be avoided.

Specific examples of such second organic solvents include hydrocarbons such as hexane, octane, petroleum ether, cyclohexane, benzene, toluene and xylene; halogenated hydrocarbons such as carbon tetrachloride, trichloroethylene, and tetrabromoethane; ethers such as ethyl ether, dimethyl glycol, trioxane, and tetrahydrofuran; acetals such as methylal and diethyl acetal; ketones such as acetone, methyl ethyl ketone, methyl isobutyl ketone and cyclohexanone; esters such as butyl formate, butyl acetate, ethyl propionate, and cellosolve acetate; acids such as formic acid, acetic acid and propionic acid; compounds having a sulfur atom or a nitrogen atom such as nitropropene, nitrobenzene, dimethylamine, monoethanolamine, pyridine, dimethylsulfoxide and dimethylformamide; water; etc.

When the polymerization is performed, an inorganic ion such as $SO_4^{2-}$, $NO_2^-$, $PO_4^{3-}$, $Cl^-$, $Na^+$, $K^+$, $Mg^{2+}$ and $Ca^{2+}$ can be included in the dispersion.

If desired, one or more dispersion stabilizers and surfactants such as those mentioned above can be added to the dispersion to well disperse monomers in an aqueous medium.

The polymerization conditions such as choice of dispersion stabilizers and surfactants, concentration of monomers and mixing ratio of the compounds are properly determined so that the resultant particulate polymer has a desired average particle diameter and a particle diameter distribution. When it is desired to prepare a particulate polymer having a relatively small average particle diameter, the concentration of the dispersion stabilizer and surfactant used is increased. In contrast, when it is desired to prepare a particulate polymer having a relatively large average particle diameter, the concentration of the dispersion stabilizer and surfactant used is decreased. When it is desired to obtain a sharp particle diameter distribution, the concentration of the monomers is decreased. In contrast, a particulate polymer having a broad particle diameter distribution can be prepared by increasing the concentration of the monomers.

In general, when the added amount of the dispersion stabilizer is not less than 2% by weight of the monomers used, it is difficult to prepare a particulate polymer having a particle diameter distribution such that particles having a particle diameter within a range of ±25% of the average particle diameter are included in the particulate polymer in an amount not less than 90%. The added amount of the dispersion stabilizer is preferably changed depending on the species of the monomers used, but is generally from 0.1 to 10% by weight, and preferably from 1 to 5% by weight, based on the hydrophilic organic solvent used. When the added amount of the dispersion stabilizer is small, the resultant particulate polymer has a relatively large particle diameter. In contrast, when the added amount of the dispersion stabilizer is large, the resultant particulate polymer has a relatively small particle diameter. However, even when the added amount is greater than 10% by weight, the particle diameter of the resultant particulate polymer hardly changes.

Then the method for polymerizing a monomer in a liquid will be explained.

One or more monomers are dispersed in an aqueous medium using a dispersing machine such as general agitators, high shearing force type agitators (e.g., TK HOMOMIXERS from Tokushu Kika kogyo and CLEAR MIX from M Tech Co.), and ultrasonic dispersing machines to prepare a monomer composition dispersion. In this case, agitating blades having a turbine form are more preferable than agitating blades having a paddle form. Alternatively, a method in which a dispersion phase is added upon application of pressure to a continuous phase through a porous material such as porous glass can be used to prepare a monomer composition dispersion.

When a dispersion is prepared by applying a shearing force, the agitation speed and time are controlled so that the dispersed monomers have a particle diameter not greater than 30 μm. Specifically, the rotation speed of the turbine and the agitation time are preferably controlled so as to be from 10 to 30 m/s and from 5 to 60 minutes, respectively.

The mixing ratio (M/D) of the monomers (M) to the dispersion medium (D) is preferably from 100/200 to 100/3,000 by weight. When the monomers are polymerized, the air in the reaction vessel is preferably replaced with an inert gas such as nitrogen gas or argon gas. In the oxygen purging is insufficient, small particles tend to be formed.

By polymerizing the monomer composition thus granulized, a particulate image forming material (i.e., a toner in this case) is prepared. In this polymerization process, the polymerization reaction proceeds while the dispersing state is maintained due to the action of the dispersion stabilizer. Therefore, the dispersion is agitated to an extent such that the particles do not precipitate. The polymerization temperature is preferably not lower than 40° C. (more preferably from 60 to 90° C.). The polymerization is generally performed until the polymerization reaction is completed, and the polymerization time is generally from 2 to 48 hours. If desired, the polymerization reaction can be stopped when the resultant particulate polymer has a desired particle diameter and/or a desired particle diameter distribution. In addition, it is possible to sequentially add one or more polymerization initiators to increase the polymerization speed.

If desired, the thus prepared particulate material is washed by a method using an acid, an alkali or water to remove the dispersant from the particulate material.

When a fine particulate polymer material is agglomerated, the following method is typically used. At first, a dispersion including a fine particulate polymer material is agitated by a general agitator, or a general agitator applying a high shearing force such as HOMOMIXERS (from Tokushu Kika Kogyo) and CLEAR MIX (from M Technique Co.). Then a colorant, a release agent and coagulant are added to the dispersion to prepare agglomerated particles. The particle diameter of the agglomerated particles is controlled by adjusting the temperature and pH of the dispersion and the rotation speed of the agitator used. The granulation time is not particularly limited but is generally from 5 to 60 minutes.

Toner Properties

The toner of the present invention, which is one embodiment of the particulate image forming material of the present invention, preferably has the following properties.

Volume Average Particle Diameter (Dv), and Dv/Dn Ratio

The toner of the present invention preferably has a volume average particle diameter (Dv) of from 0.1 to 10 μm, and more preferably from 2 to 8 μm. The ratio Dv/Dn of the volume average particle diameter (Dv) to the number average particle diameter (Dn) of the toner is preferably not greater than 1.25 and more preferably from 1.05 to 1.20. The toner having such properties has a good combination of high temperature preservability, low temperature fixability and hot offset resistance and can produce glossy images particularly when used for full color image forming apparatus. In addition, even when the toner is used for a two-component developer for a long period of time while a fresh toner is replenished, the particle diameter of the toner hardly changes. Therefore, the toner can stably produce high quality images even when used for a long period of time. In addition, when the toner is used as a one component developer while a fresh toner is replenished, the average particle diameter of the toner hardly changes. Further, the toner hardly causes a fusion problem in that the toner adheres to the surface of a developing roller and/or a blade which is used for forming a toner layer on the surface of the developing roller. Therefore, the one component developer (i.e., the toner) can stably produce high quality images even when used for a long period of time.

In general, the smaller particle diameter a toner has, the higher resolution images the toner produces. However, the toner has relatively poor transferability and cleaning property. When the toner of the present invention has too small a volume average particle diameter, the toner tends to be fused to the surface of the carrier used for a two component developer in combination with the toner, and thereby the charging ability of the carrier deteriorates. When the toner is used as a one component developer, the toner tends to cause a problem in that the developer is adhered and fused to the developing members used such as a developing roller and a developer layer forming blade. The same is true for a case where the toner includes fine particles in a large amount.

In contrast, when the volume average particle diameter of the toner is too large, high resolution images cannot be produced and in addition a problem in that the particle diameter distribution of the toner changes when the toner is used while a fresh toner is replenished occurs. The same is true for a case where the ratio (Dv/Dn) is too large. When the ratio (Dv/Dn) is too small, the toner cannot be sufficiently charged and the cleanability of the toner deteriorates although the resultant toner has advantages such that the behavior of the toner can be stabilized and the toner has uniform charge quantity.

The volume average particle diameter and the Dv/Dn ratio of a toner can be determined using, for example, a particle diameter measuring instrument COULTER COUNTER TA II manufactured by Coulter Electronics, Inc.

Molecular Weight

The toner of the present invention preferably has a weight average molecular weight not lower than 1,000, more preferably from 2,000 to 10,000,000 and even more preferably from 3,000 to 1,000,000. When the weight average molecular weight is too low, the hot offset resistance of the toner deteriorates.

Glass Transition Temperature (Tg)

The toner of the present invention preferably has a glass transition temperature (Tg) of from 30 to 70° C. and more preferably from 40 to 65° C. When the glass transition temperature (Tg) is too low, the high temperature preservability of the toner deteriorates. In contrast, when the glass transition temperature is too high, the low temperature fixability of the toner deteriorates.

The penetration of the toner is preferably not less than 15 mm, and more preferably from 20 to 30 mm when the penetration is determined by a method based on JIS K2235-1991 incorporated by reference. When the penetration is too small, the preservability of the toner deteriorates.

The method for measuring the penetration based on JIS K2235-1991 is as follows.

(1) a sample is contained in a 50 ml container;
(2) the container is allowed to settle for 20 hours in a chamber heated to 50° C.;
(3) the toner in the container is cooled to room temperature; and
(4) the toner is subjected to a penetration test in which a needle is penetrated into the toner at a predetermined pressure and the length of the needle in the toner is measured.

With respect to the penetration, the larger penetration a toner has, the better preservability the toner has.

Low Temperature Fixability

The minimum fixable temperature of the toner of the present invention is preferably as low as possible as long as the hot offset temperature thereof is high. In order to impart a good combination of low temperature fixability and hot offset resistance to the toner, the minimum fixable temperature is preferably lower than 150° C. and the hot offset temperature is higher than 200° C.

The minimum fixable temperature is determined as follows.

(1) toner images are formed using an image forming apparatus while changing the fixing temperature;
(2) the fixed toner images are rubbed with a pad;
(3) the image densities of the images before and after the rubbing to determine the fixing rate FR:

$$FR=\{(ID2)/(ID1)\}\times 100\ (\%)$$

wherein ID1 represents the image density before rubbing and ID2 represents the image density after rubbing.

The minimum fixable temperature is defined as a temperature below which the fixed image has a fixing rate less than 70%.

The hot offset temperature is determined as follows.

(1) images each including yellow, magenta, cyan, black, red, blue and green colors therein are produced using a full color image forming apparatus while changing the fixing temperature; and
(2) the fixed images are carefully observed to determine whether a hot offset problem occurs.

The hot offset temperature is defined as the temperature above which the toner image on a receiving material adheres to a fixing member.

Thermal Properties

The toner of the present invention preferably has the following thermal property, i.e., softening point.

These thermal property can be measured using a flow tester CFT500 from Shimadzu Corp. Specifically, a sample (toner) is heated and melted under the following conditions of 1 mm in diameter of die, 20 kg/cm$^2$ in pressure, and 6° C./min in temperature rising speed while the melt flow property is graphed to determine the 1/2 temperature (F1/2 temperature) which is the midpoint of the flow starting point and flow ending point. The F1/2 temperature is defined as the softening point.

Specifically, the softening point of the toner is preferably not lower than 60° C., and more preferably from 80 to 170° C. When the softening point is too low, at least one of the high temperature preservability and low temperature preservability deteriorates.

Image Density

The image density of the fixed toner images is preferably not lower than 1.90, more preferably not lower than 2.00 and even more preferably not lower than 2.10 when measured with a spectrodensitometer X-RITE 938 from X-Rite. When the image density is too low, the image has poor image quality.

In the present application, the image density is determined as follows.

(1) a solid toner image having a weight of 1.00±0.05 mg/cm$^2$ is formed on a paper TYPE 6000<70W> using a copier IMAGIO NEO 450 from Ricoh Co., Ltd.;
(2) the toner image is fixed at a temperature of 160±2° C.; and
(3) the image densities of six points of the fixed solid toner image are measured with a spectrodensitometer X RITE 938 to obtain the average image density.

The toner of the present invention preferably has a circularity of from 0.900 to 1.000, and more preferably from 0.950 to 0.990. In addition, the content of toner particles having a circularity less than 0.940 is preferably not greater than 15%.

When the circularity is too small, there is a case where good transferability cannot be imparted to the toner, and the resultant toner images are scattered.

In the present application, the circularity of a toner is determined by the following method using a flow-type particle image analyzer FPIA-2100 from Sysmex Corp.:

(1) a suspension including toner particles to be measured is passed through a detection area formed on a plate in the measuring instrument; and (2) the particles are optically detected by a CCD camera and then the shapes thereof are analyzed with an image analyzer.

The circularity of a particle is determined by the following equation:

$$\text{Circularity}=Cs/Cp$$

wherein Cp represents the length of the circumference of the projected image of a particle and Cs represents the length of the circumference of a circle having the same area as that of the projected image of the particle.

The toner of the present invention is prepared by a method including the following process.

Chain Transfer Agent Removing Process

In the chain transfer agent removing process of the method for preparing a particulate image forming material of the present, the particulate image forming material prepared above is contacted with a supercritical fluid or a sub-critical fluid to remove the chain transfer agent present on or in the surface of the particulate image forming material. Therefore, the bad smell due to the chain transfer agent emitted in the fixing process of the image forming material can be removed.

Mixing of External Additive

The particulate image forming material from which the chain transfer agent has been removed is typically mixed with an inorganic material, which serves as an external additive and which improves the fluidity, developability and chargeability of the particulate image forming material. Suitable inorganic materials for use as the external additive include inorganic materials having a primary particle diameter of from 5 nm to 2 μm and preferably from 5 nm to 500 nm, and a BET specific area of from 20 to 500 $m^2/g$.

Specific examples of the inorganic materials include silica, alumina, titanium oxide, barium titanate, magnesium titanate, calcium titanate, strontium titanate, zinc oxide, tin oxide, quartz sand, clay, mica, sand lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, particulate polymers can also be used as the external additive. Specific examples of the particulate polymers include resins (e.g., polystyrene and (meth)acrylate copolymers), which are prepared by a polymerization method such as soap free emulsion polymerization methods, suspension polymerization methods, and dispersion polymerization methods, and other resins such as polycondensation resins and/or thermosetting resins (e.g., silicone resins, benzoguanamine resins, and nylon resins).

The surface of such external additives (i.e., fluidity improving agents) is preferably subjected to a hydrophobic treatment so that the resultant image forming material has good fluidity and chargeability even under high humidity conditions.

Specific examples of the surface treatment agents include silane coupling agents, silylating agents, silane coupling agents having a fluoroalkyl group, organic titanate coupling agents, aluminum coupling agents, silicone oils, modified silicone oils, etc.

When a first inorganic material is used as the dispersion stabilizer and a second inorganic material is used as an external additive, the second inorganic material is preferably the same kind of the first inorganic material.

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agent include fatty acids and their metal salts such as stearic acid, zinc stearate, and calcium stearate; and particulate polymers such as polymethylmethacrylate and polystyrene, which are manufactured by a method such as soap-free emulsion polymerization methods.

Particulate resins having a relatively narrow particle diameter distribution and a volume average particle diameter of from 0.01 μm to 1 μm are preferably used as the cleanability improving agent.

When an external additive is mixed with the particulate image forming material, any mixers which can seal the axis portion thereof using a gas and in which the agitation blade can be rotated at a high speed and the vessel can be cooled or heated can be used. Specific examples of such mixers include HENSCHEL MIXERS (from Mitsui Mining Co., Ltd.), SUPER MIXERS (from Kawata), etc. Specific examples of the sealing gases include rare gases such as helium and argon, nitrogen and dried air.

When the particulate image forming material is mixed with an external additive using such a mixer as mentioned above, the added amount of the particulate image forming material to be treated in the vessel of the mixer is preferably from 0.05 to 0.4 kg, preferably from 0.1 to 0.3 kg, per the unit volume (i.e., 1 liter) of the vessel. When the added amount is too small, the productivity of the product is low. In contrast, when the added amount is too large, the image forming material is discharged from the vessel, resulting in deterioration of the yield of the particulate image forming material. The mixing ratio (E/P) of the external additive (E) to the particulate image forming material (P) is generally from 0.1 to 6 parts by weight, preferably from 0.3 to 5 parts by weight, and more preferably from 0.5 to 3 parts by weight, per 100 parts by weight of the image forming material to be treated.

After the external additive mixing process, the resultant particulate image forming material can be subjected to filtering to remove therefrom coarse particles, fused particles caused by heat generated by the mixing operation, and agglomerated particles caused by van der Waals force of the particulate image forming material. For example, a sieve having openings with a diameter of from 100 to 250 μm is used for the filtering. Specific examples of the devices having a sieve include multistage gyro-shifters. Specific examples of the methods for vibrating a sieve include mechanical vibrating methods and vibration methods using ultrasonic waves.

Developer

The developer of the present invention includes at least the particulate image forming material of the present invention and optionally includes other materials such as carriers. The developer of the present invention may be a one-component developer or a two-component developer including a carrier. When the developer is used for high speed image forming apparatus such as printers, the two-component developer is preferably used because of having a long life.

When the particulate image forming material is used as a one component developer while a fresh developer is replenished, the average particle diameter of the developer hardly changes. In addition, the developer hardly causes a fusion problem in that the developer adheres to the surface of a developing roller and/or a blade which is used for forming a thin developer layer on the surface of the developing roller. Therefore, the one component developer can stably produce high quality images even when used for a long period of time. When the particulate image forming material is used for a two-component developer while a fresh toner is replenished, the particle diameter of the toner hardly changes even when used for a long period of time. Therefore, the toner can stably produce high quality images even when agitated in a developing device for a long period of time.

Carrier

The carrier for use in the two component developer of the present invention is not particularly limited, and one or more proper carriers are chosen while considering the usage of the developer. However, it is preferable to use a carrier in which a core material is coated with a resin.

Suitable materials for use as the core material include manganese-strontium materials and manganese-magnesium materials, which have a saturation magnetization of from 50 to 90 $Am^2/kg$ (90 emu/g). In view of image density, iron powders (having a a saturation magnetization not less than 100 $Am^2/kg$ (100 emu/g) and magnetite having a saturation magnetization of from 75 to 120 $Am^2/kg$ (75 to 120 emu/g) are preferably used. In addition, copper-zinc materials having a saturation magnetization of from 30 to 80 $Am^2/kg$ (30 to 80 emu/g) can be preferably used because the impact of the magnetic brush against the photoreceptor is relatively weak and high quality images can be produced.

These carrier materials can be used alone or in combination.

The core material of the carrier preferably has a volume average particle diameter ($D_{50}$) of from 10 to 150 μm, and more preferably from 40 to 1001m. When the volume average particle diameter is too small, a carrier scattering problem tends to occur because the particles have weak magnetization. When the particle diameter is too large, the surface area of the carrier per unit weight decreases and thereby a toner scattering problem tends to occur. In addition, another problem in that uneven solid images are formed tends to occurs particularly when the carrier is used for forming color images.

Specific examples of such resins to be coated on the carriers include amino resins, vinyl or vinylidene resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, silicone resins, epoxy resins.

Specific examples of the amino resins include urea-formaldehyde resins, melamine resins, benzoguanamine resins, urea resins, and polyamide resins. Specific examples of the vinyl or vinylidene resins include acrylic resins, polymethylmethacrylate resins, polyacrylonitirile resins, polyvinyl acetate resins, polyvinyl alcohol resins, polyvinyl butyral resins, etc. Specific examples of the polystyrene resins include polystyrene resins and styrene-acrylic copolymers. Specific examples of the halogenated olefin resins include polyvinyl chloride resins. Specific examples of the polyester resins include polyethyleneterephthalate resins and polybutyleneterephthalate resins.

If desired, an electroconductive powder can be included in the resin layer of the carrier. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the coating layer.

The resin layer can be formed by coating a resin solution which is prepared by dissolving a resin in a solvent on a core material using any known coating method, followed by drying and baking. Suitable coating methods include dip coating methods, spray coating methods, brush coating methods, etc.

Specific examples of the solvent include toluene, xylene, methyl ethyl ketone, methyl isobutyl ketone, cellosolve butyl acetate, etc.

The method for baking is not particularly limited, and external heating methods and internal heating methods can be used. For example, methods using a heating device such as fixed electric furnaces, fluid electric furnaces, rotary electric furnaces, and burner furnaces, and methods using microwave, are preferably used.

The coated amount of the resin is preferably 0.01 to 5.0% by weight based on the weight of the carrier. When the coated amount is too small, a uniform resin layer cannot be formed. When the coated amount is too large, the carrier particles aggregates, and thereby the toner cannot be uniformly charged.

The weight ratio of the toner to the carrier in the two component developer is from 10/90 to 2/98, and preferably from 7/93 to 3/97.

Since the developer of the present invention includes the particulate image forming material of the present invention, occurrence of a bad smell problem in a fixing process can be prevented. In addition, the developer (toner) has good low temperature fixability and releasability and can stably produce high quality images.

The particulate image forming material of the present invention can be used for known developing methods using a one-component magnetic developer, a one-component non-magnetic developer, or a two-component developer. The particulate image forming material of the present invention can be preferably used for the toner container, toner cartridge, process cartridge and image forming apparatus and method of the present invention, which will be explained below.

Toner Container

The toner container of the present invention contains the toner of the present invention, which is an embodiment of the particulate image forming material of the present invention. The container is not particularly limited, and a proper container is used depending on the image forming apparatus for which the toner is used. For example, combinations of a toner container and a cap are preferably used.

The shape of the toner container is not particularly limited, and cylindrical containers, etc. can be used. The containers can include a spiral groove on the inner surface of the container to smoothly discharge the toner therein when rotated. Containers with a groove which can be folded like an accordion can be preferably used.

Toner Cartridge

The toner container of the present invention can have such a shape as to be used as a toner cartridge, which is detachably attached to an image forming apparatus.

Suitable materials for use as the toner container and toner cartridge include resins having good dimension stability. Specific examples thereof include polyester resins, polyethylene resins, polypropylene resins, polystyrene resins, polyvinyl chloride resins, acrylic resins, polycarbonate resins, ABS resins, polyacetal resins, etc.

The toner container and cartridge of the present invention have good preservation property, transporting property, and handling property, and are used by being detachably set in the image forming apparatus and process cartridge of the present invention. The toner contained in the toner container or the toner cartridge is supplied to the developing device of the process cartridge and image forming apparatus of the present invention.

Process Cartridge

The process cartridge of the present invention includes at least an image bearing member and a developing device configured to develop an electrostatic latent image formed on the image bearing member. The process cartridge may include other devices such as a charging device configured to charge the surface of the image bearing member, and a cleaner configured to clean the surface of the image bearing member.

The developing device includes at least a developer container configured to contain the developer of the present invention, a developer bearing member configured to bear and transport the developer contained in the developer container, and optionally includes a regulating member configured to form a thin developer layer on the surface of the developer bearing member. The process cartridge of the present invention can be detachably set in an electrophotographic image forming apparatus, and is preferably set in the image forming apparatus of the present invention.

Image Forming Apparatus

The image forming apparatus of the present invention includes at least an image bearing member, an electrostatic latent image forming device, a developing device, a transferring device, and a fixing device, and optionally includes a discharger (a quencher), a cleaner, a toner recycling device, a controller and other devices.

The image forming method of the present invention includes at least an electrostatic latent image forming process, a developing process, an image transferring process, and a fixing process, and optionally includes a discharging process, a cleaning process, and a toner recycling process.

Then each of the image forming processes and devices therefor will be explained.

(1) Latent Image Forming Process and Image Bearing Member

In the latent image forming process, an electrostatic latent image is formed on an image bearing member.

The image bearing member (hereinafter sometimes referred to as a photoconductive insulator or photoreceptor) for use in the image forming apparatus of the present invention is not particularly limited with respect to the constitution materials, shape, size, etc. Namely, known image bearing members can be used. Among the image forming members, drum-form photoreceptors including a photosensitive material such as inorganic photosensitive materials (e.g., amorphous silicon and selenium) and organic photosensitive materials (e.g., polysilane, phthalopolymethine, organic photoconductors, combinations of charge generation materials and charge transporting materials, etc.) are preferably used. Among these photosensitive materials, amorphous silicon is preferably used because of having long life.

In the latent image forming process, an electrostatic latent image is formed by uniformly charging the entire surface of a photoreceptor using a charger, and irradiating the charged photoreceptor with imagewise light using an light irradiator.

Charging is performed by applying a voltage to the photoreceptor using a charger. Known chargers can be used for charging the photoreceptor. For example, contact chargers having a semi-conductive charging element such as rollers, brushes, films and rubber blades; and non-contact chargers such as corotrons and scorotrons can be used.

Image irradiation is performed by irradiating the charged photoreceptor with imagewise light using a light irradiating device. Known light irradiators can be used and a proper light irradiator is chosen and used for the image forming apparatus for which the toner of the present invention is used. Specific examples thereof include optical systems for use in reading images in copiers; optical systems using rod lens arrays; optical systems using laser; and optical systems using a liquid crystal shutter.

It is possible to irradiate the photoreceptor from the backside of the photoreceptor.

(2) Developing Process and Image Developing Device

In the developing process, the electrostatic latent image formed on the image bearing member is developed with the toner (or the developer) of the present invention mentioned above to visualize the electrostatic latent image using a developing device.

Known developing devices can be used in the image forming apparatus of the present invention as long as the toner (or the developer) of the present invention is used therefor. For example, developing devices containing the toner or developer therein and having a developing element which supplies the toner to the photoreceptor while contacting or not contacting the photoreceptor can be used. The developing device preferably has the toner container mentioned above.

The developing device is a dry developing device which includes one or more developing sections to develop one or more color images. The developing device includes an agitator configured to agitate the toner or developer to charge the toner, and a developer bearing member bearing the toner or developer to supply the toner to the photoreceptor.

In the developing device, the toner and a carrier are agitated so that the toner is charged. The toner and carrier are then fed to the developer bearing member and form a magnetic brush on the surface of the developer bearing member. The toner in the magnetic brush is electrostatically attracted by the electrostatic latent image, resulting in transferring of the toner to the latent image. Thus, the latent image is developed with the toner, resulting in formation of a toner image.

The developer contained in the developing device may be a one-component developer which includes the toner of the present invention and does not include a carrier, or a two-component developer which includes the toner of the present invention and a carrier (i.e., the two-component developer of the present invention).

(3) Transferring Process and Image Transferring Device

In the transferring process, the toner image formed on the image bearing member is transferred to a receiving material optionally via an intermediate transfer medium. When multiple color images and full color images are formed using two or more color toners, it is preferable that plural color toner images are transferred to an intermediate transfer medium one by one (first transfer process), and the plural toner images on the intermediate transfer medium is transferred to a receiving material at the same time (second transfer process).

It is preferable that toner images are transferred while applying a voltage to the image bearing member and/or the transferring element. When an intermediate transfer medium is used, the transferring device includes a first transferring member which transfers the toner image on the photoreceptor to the intermediate transfer medium and a second transferring member which transfers the toner image on the intermediate transfer medium to a receiving material.

The intermediate transfer medium for use in the image forming apparatus is not particularly limited, and known intermediate transfer media can be used. Specific examples thereof include belt-form intermediate transfer media.

Suitable transfer members for use in the (first and second) transfer devices to easily transfer the toner images to a receiving material include corona chargers, transfer belts, transfer rollers, pressure transfer rollers, adhesive transfer members.

The receiving material is not particularly limited and known receiving materials such as papers can be used.

(4) Fixing Process and Fixing Device

In the fixing process, the toner image transferred to a receiving material is fixed using a fixing device. When plural toner images are transferred, the fixing operation can be made to each of the toner images transferred on the receiving material one by one, or all the toner images transferred on the receiving material at the same time.

The fixing device is not particularly limited, and a proper fixing device is chosen and used for the image forming apparatus for which the toner of the present invention is used. Suitable fixing devices include heat fixing devices which heat toner images while applying a pressure thereto. Specific examples thereof include combinations of a heat roller and a pressure roller, and combinations of a heat roller, a pressure roller and an endless belt.

When a heat fixing device is used, the fixing temperature is preferably from 80 to 200° C.

It is possible to use a fixing device which fixes toner images using light.

(5) Discharging (Quenching) Process and Discharging Device

In the discharging process, charges remaining on the photoreceptor even after the toner image thereon is transferred from the photoreceptor to a receiving material are discharged by applying a bias voltage to the photoreceptor or irradiating the photoreceptor with light, using a discharging device.

Known discharging devices can be used. Specific examples thereof include discharging lamps.

(6) Cleaning Process and Cleaning Device

In the cleaning process, toner particles remaining on the surface of the photoreceptor even after the toner image thereon is transferred on a receiving material are removed therefrom using a cleaning device.

Known cleaners can be used as the cleaning device. Specific examples thereof include magnetic brush cleaners, electrostatic brush cleaners, magnetic roller cleaners, blade cleaners, brush cleaners, and web cleaners.

(7) Toner Recycling Process and Recycling Device

In the toner recycling process, the toner collected by the cleaners are returned to the developing device using a recycling device to be reused for developing electrostatic latent images.

Known powder feeding devices can be used as the recycling device.

(8) Controlling Process and Controller

The above-mentioned processes are controlled by a controller such as sequencers, and computers.

The image forming processes and image forming apparatus will be explained in detail referring to drawings.

FIG. 1 is a schematic view illustrating an embodiment of the image forming apparatus of the present invention.

In FIG. 1, an image forming apparatus 100 includes a photoreceptor drum 10 (hereinafter referred to as a photoreceptor 10) serving as the image bearing member; a charging roller 20 serving as the charging device; a light irradiator which serves as the latent image forming device and irradiates imagewise light 30; a developing device 40 serving as the image developing device; an intermediate transfer medium 50; a cleaner 61 serving as the cleaning device and including a cleaning blade; and a discharging lamp 70 serving as the discharging device.

The intermediate transfer medium 50 is an endless belt which is rotated in a direction indicated by an arrow by three rollers 51 arranged therein while tightly stretched by the rollers. At least one of the three rollers 51 applies a transfer bias (first transfer bias) to the intermediate transfer medium 50. A cleaner 90 is provided to clean the surface of the intermediate transfer medium 50.

On the right side of the intermediate transfer medium 50, a transfer roller 80 is provided which applies a transfer bias (a second transfer bias) to a receiving material 95 on which a toner image is to be transferred. In addition, a corona charger 52 is provided to charge the toner image on the intermediate transfer medium 50 before the toner image is transferred to the receiving material 95.

A developing device 40 includes a developing belt 41, and a black developing unit 45K; a yellow developing unit 45Y; a magenta developing unit 45M; and a cyan developing unit 45C, which are arranged in the vicinity of the developing belt 41. Each of the developing units includes a developer containing portion 42 (42K, 42Y, 42M or 42C), a developer supplying roller 43 (43K, 43Y, 43M or 43C), and a developing roller 44 (44K, 44Y, 44M or 44C). The developing belt 41 is an endless belt which is rotated while tightly stretched by plural rollers.

In the image forming apparatus 100, the surface of the photoreceptor 10 is uniformly charged with the charging roller 20. The light irradiator irradiates the charged surface of the photoreceptor 10 with imagewise light 30 to form an electrostatic latent image on the photoreceptor 10. The developing device 40 develops the latent image with color toners, each of which is the toner of the present invention, to sequentially form color toner images on the photoreceptor 10. The color toner images are transferred to the intermediate transfer medium 50 (first transfer) to for a toner image (e.g., a full color toner image) while at least one of the rollers 51 applies a transfer bias thereto. The toner image formed on the intermediate transfer medium 50 is then transferred to the receiving material 95 (second transfer). Toner particles remaining on the photoreceptor 10 are removed with the cleaner 63 and charges remaining on the photoreceptor 10 are removed by irradiating the photoreceptor 10 with light using the discharging lamp 70.

Figure 2:
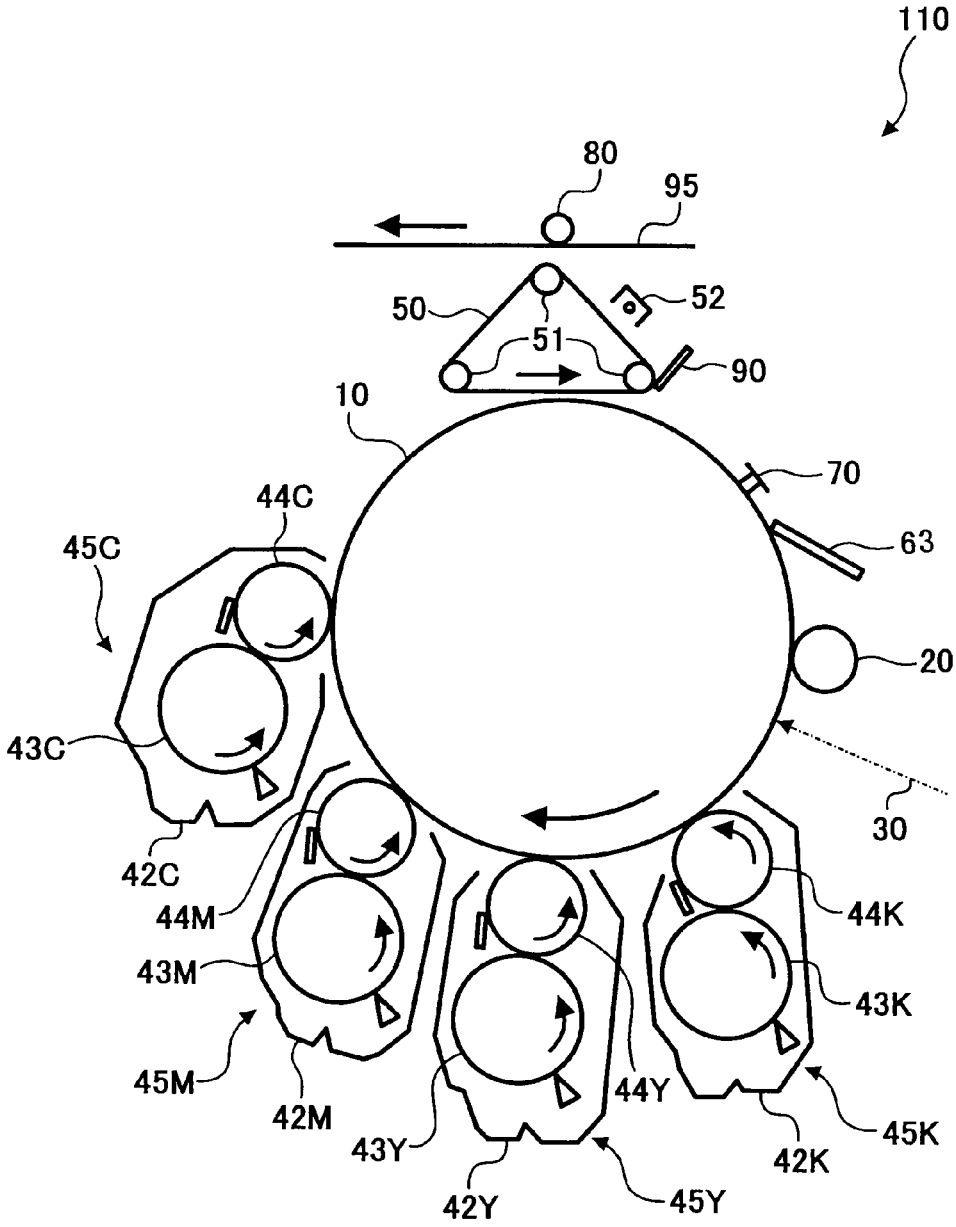
FIG. 2 is a schematic view illustrating another embodiment of the image forming apparatus of the present invention.

FIG. 2 illustrates another embodiment of the image forming apparatus of the present invention. The image forming apparatus has the same configuration as that of the image forming apparatus illustrated in FIG. 1 except that the black, yellow, magenta and cyan developing units 45K, 45Y, 45M and 45C are directly contacted with the photoreceptor 10 without using the developing belt 41. The action of the image forming apparatus is also the same as that of the image forming apparatus illustrated in FIG. 1.

The image forming operations will be explained referring to FIG. 3.

Figure 3:
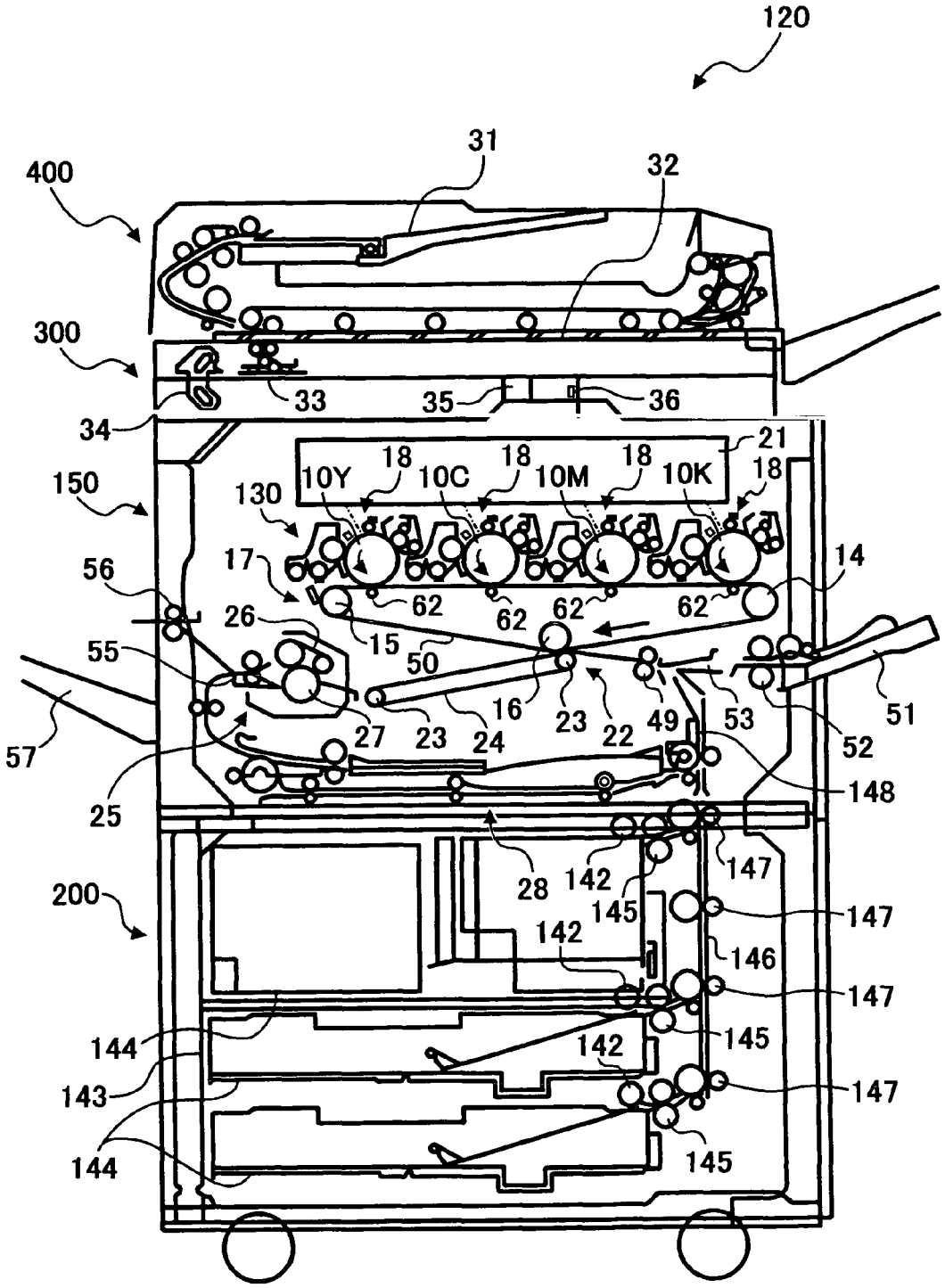
FIG. 3 is a schematic view illustrating yet another embodiment of the image forming apparatus of the present invention.

FIG. 3 is the overview of an embodiment of the image forming apparatus of the present invention, which is a tandem-type color image forming apparatus.

In FIG. 3, a tandem-type color image forming apparatus 120 includes an image forming section 150, a paper feeding section 200, a scanner 300 and an automatic document feeder 400.

The image forming section 150 includes an endless intermediate transfer medium 50 which is provided in the center of the image forming section 150. The intermediate transfer medium 50 is rotated in the clockwise direction by rollers 14, 15 and 16 while tightly stretched by the rollers. A cleaner 17 is provided near the roller 15 to remove toner particles remaining on the surface of the intermediate transfer medium.

Four image forming units 18 for forming yellow, magenta, cyan and black toner images are arranged side by side on the intermediate transfer medium 50. The image forming units 18 include respective photoreceptors 10Y, 10M, 10C and 10K. Numeral 130 denotes a tandem type developing device. The developing device 130 includes four developing devices arranged in the respective four image forming units 18. A light irradiator 21 is arranged at a location over the image forming units 18.

A second transfer device 22 is provided below the intermediate transfer medium 50. The second transfer device 22 includes an endless belt 24 which is rotatably stretched a pair of rollers 23. The endless belt 24 feeds a receiving material so that the toner images on the intermediate transfer medium 50 are transferred to the receiving material while sandwiched by the intermediate transfer medium 50 and the endless belt 24.

A fixing device 25 is arranged at a position near the second transfer device 22. The fixing device 25 includes an endless fixing belt 26 and a pressure roller 27 which presses the fixing belt 26.

In addition, a sheet reversing device 28 configured to reverse the receiving material is provided at a position near the fixing device 25, to produce double-sided copies.

Then the full color image forming operation using the tandem-type color image forming apparatus 500 will be explained.

An original to be copied is set on an original table 31 of the automatic document feeder 400. Alternatively, the original is directly set on a glass plate 32 of the scanner 300 after the automatic document feeder 400 is opened, followed by closing of the automatic document feeder 400. When a start button (not shown) is pushed, the color image on the original on the glass plate 32 is scanned with a first traveler 33 and a second traveler 34 which move in the right direction. In the case where the original is set on the table 31 of the automatic document feeder 400, at first the original is fed to the glass plate 32, and then the color image thereon is scanned with the first and second travelers 33 and 34. The first traveler 33 irradiates the color image on the original with light and the second traveler 34 reflects the light reflected from the color image to send the color image light to a sensor 36 via a focusing lens 35. Thus, color image information (i.e., black, yellow, magenta and cyan color image data) is provided.

The black, yellow, magenta and cyan color image data are sent to the respective black, yellow, magenta and cyan color image forming units 18, and black, yellow, magenta and cyan color toner images are formed on the respective photoreceptors 10K, 10Y, 10M and 10C.

Figure 4:
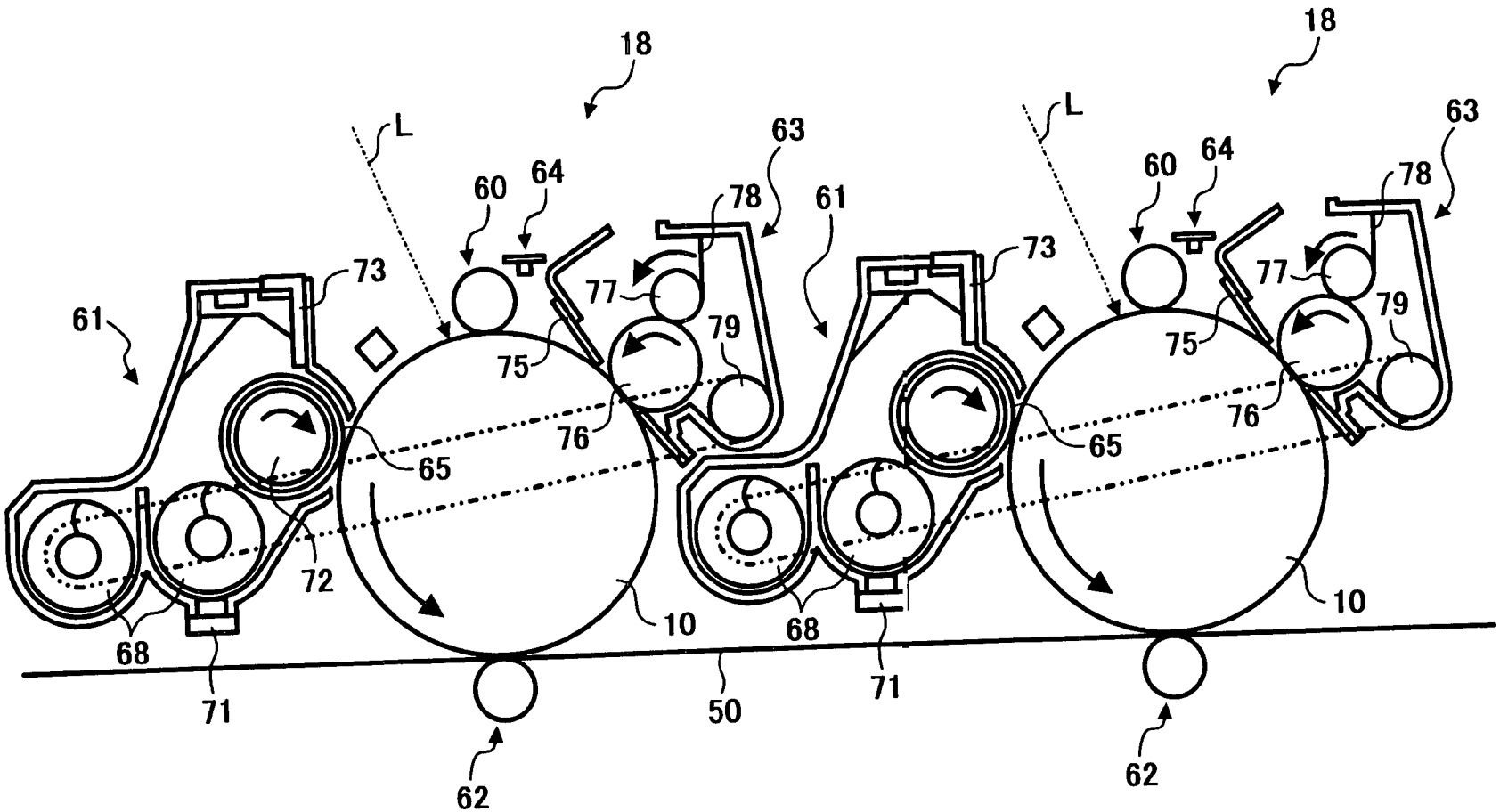
FIG. 4 is an enlarged view of the image forming section of the image forming apparatus illustrated in FIG. 3.

FIG. 4 is a schematic view illustrating a part of the image forming units 18.

Numeral 60, 61, 62, 63 and 64 denote a charger, a developing device, a transfer roller, a cleaner and a discharger.

The developing device 61 includes agitators 68, a developing roller 72, and a regulating blade 73 configured to forming a developer layer 65 on the surface of the developing roller 72. Numeral 71 denotes a toner sensor configured to determine the toner concentration. Character L denotes imagewise light.

The cleaner 63 includes cleaning blade 75, a cleaning brush 76, a roller 77, a blade 78 and a toner recycling device 79 configured to feed the collected toner particles to the developing device 61.

Referring back to FIG. 3, the thus prepared black, yellow, magenta and cyan color toner images are transferred one by one to the intermediate transfer medium 50 which is rotated by the rollers 14, 15 and 16, resulting in formation of a full color toner image on the intermediate transfer medium 50. Numeral 62 denotes a transfer charger.

In the paper feeding section 200, one of paper feeding rollers 142 is selectively rotated to feed the top paper sheet of paper sheets stacked in a paper cassette 144 in a paper bank 143 while the paper sheet is separated one by one by a separation roller 145 when plural paper sheets are continuously fed. The paper sheet is fed to a passage 148 in the image forming section 150 through a passage 146 in the paper feeding section 200, and is stopped once by a registration roller 49. Numeral 147 denotes feed rollers. A paper sheet can also be fed from a manual paper tray 51 to a passage 53 by a separation roller and a pair of rollers 52. The thus fed paper sheet is also stopped once by the registration roller 49. The registration roller 49 is generally grounded, but a bias can be applied thereto to remove paper dust therefrom.

The thus prepared full color toner image on the intermediate transfer medium 50 is transferred to the paper sheet, which is timely fed by the registration roller 49, at the contact point of the second transfer device 22 and the intermediate transfer medium 50. Toner particles remaining on the surface of the intermediate transfer medium 50 even after the second image transfer operation are removed therefrom by the cleaner 17.

The paper sheet having the full color toner image thereon is then fed by the second transfer device 22 to the fixing device 25, and the toner image is fixed on the paper sheet upon application of heat and pressure. Then the paper sheet is discharged from the image forming section 150 by a discharge roller 56 while the path is properly selected by a paper path changing pick 55. Thus, a copy is stacked on a tray 57. When a double sided copy is produced, the paper sheet having a toner image on one side thereof is fed to the sheet reversing device 28 to be reversed. Then the paper sheet is fed to the second transfer device 24 so that an image is transferred to the other side of the paper sheet. The image is also fixed by the fixing device 25 and then the copy is discharged to the tray 57 by the discharge roller 56.

When an electrostatic latent image is developed with the particulate image forming material (i.e., the toner in this case), a voltage (preferably an Ac voltage) is applied to the developing roller.

Figure 7:
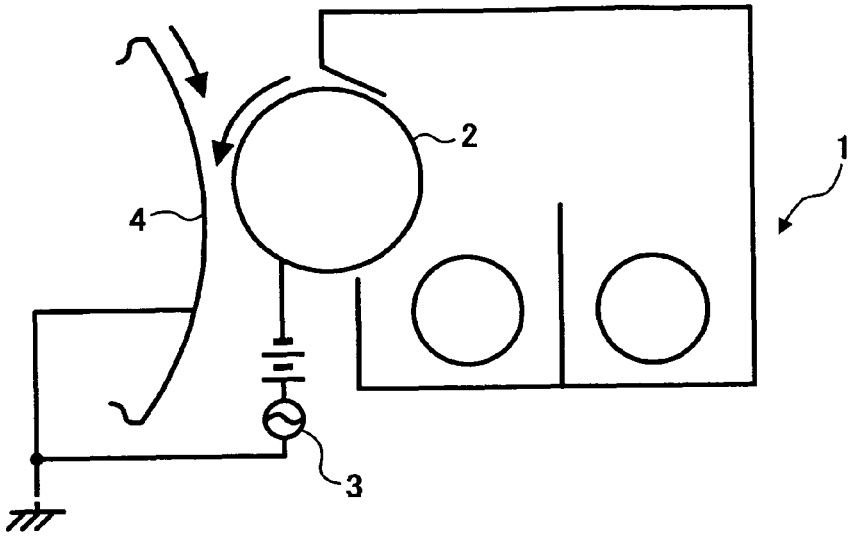
FIG. 7 is a schematic view illustrating a developing device for use in the image forming apparatus of the present invention.

FIG. 7 is a schematic view illustrating a developing device having a developing roller to which an AC voltage is applied. Specifically, a developing device 1 has a developing sleeve 2 to which a DC voltage overlapped with an AC voltage (i.e., a vibration bias voltage) is applied by an electric source 3 as a developing bias. Since the potentials of the background area (i.e., the non-image area) and the image area are located between the maximum voltage and minimum voltage of the vibration bias voltage, an alternate electric field is formed on the developing section. In the thus formed alternate electric field, the toner and carrier in the developer are violently vibrated. Therefore, the toner particles on the developing sleeve 2 jump to the photoreceptor drum 4 because the vibration energy becomes greater than the electrostatic attraction of the carrier particles and the developing sleeve 2.

The difference (i.e., peak-to-peak voltage) between the maximum and minimum of the vibration bias voltage is preferably from 0.5 to 5 kV. The frequency of the vibration bias voltage is preferably from 1 to 10 KHz. Specific examples of the waveform of the vibration bias voltage includes rectangular forms, sinusoidal forms, and triangle forms. The voltage of the DC component of the vibration bias voltage is set to be between the potential of the image area and the potential of the background area (i.e., the non-image area), and is preferably near to the potential of the background area to prevent occurrence of the background development problem.

When the vibration bias voltage has a rectangular waveform, the duty ratio is preferably not greater than 50%. The duty ratio is defined as the ratio (t1/t0) of the time period (t1) in one cycle of the vibration bias, during which such a force as to allow toner particles to jump to the photoreceptor is applied, to the time period t0 of the one cycle. By properly setting the duty ratio, the difference between the peak voltage at which the toner particles are allowed to jump to the photoreceptor and the average voltage of the vibration bias can be increased, and thereby the toner particles can be actively moved. Therefore, the electrostatic latent images are faithfully developed with the toner particles, resulting in formation of high resolution toner images. In addition, the difference between the peak voltage at which the carrier particles are allowed to jump to the photoreceptor and the average voltage of the vibration bias can be decreased, and thereby the problem in that the carrier particles are adhered to a non-image area can be avoided.

By applying a vibration bias voltage to the developing section (i.e., the developing member and the photoreceptor), high resolution toner images can be produced.

The image forming apparatus of the present invention preferably uses a fixing device including a heating member having a heater, a film contacting the heating member, and a pressing member pressing the film to the heating member, wherein a receiving material bearing a toner image thereon is passed through the nip between the film ant the pressing member to fix the toner image on the receiving material.

Figure 8:
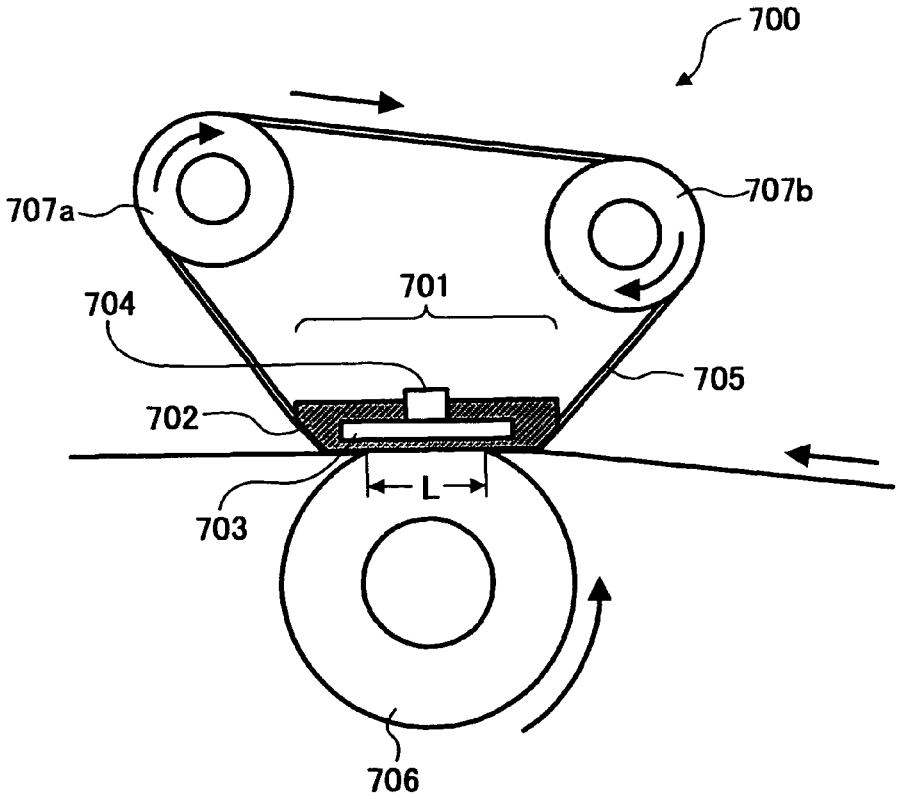
FIG. 8 is a schematic view illustrating a fixing device for use in the image forming apparatus of the present invention.

An example of such a fixing device is illustrated in FIG. 8. In FIG. 8, a fixing device 700 includes a heating member 701 having a plate 702, a heater 703 and a temperature sensor 704; a film 705 which is rotated by a driving roller 707*a* and a driven roller 707*b* in a direction indicated by an arrow; and a pressure roller 706 rotating in a direction indicated by an arrow. Character L represents the fixing nip.

The film 705 is an endless heat resistant film, and is rotated while tightly stretched by the driving roller 707*a*, the driven roller 707*b* and the heating member 701.

The driving roller 707*a* serves as a tension roller configured to apply a tension to the film 705, and thereby the film 705 is clockwise rotated by the rotation of the driving roller 707*a*. The rotation speed of the film 705 is set so as to be the same as that of the receiving material at the fixing nip L.

The pressure roller 706 has an elastic rubber layer, which is typically made of a rubber having good releasability such as silicone rubbers, on the surface thereof. The pressure roller 706 counterclockwise rotates, and presses the film 705 to the heating member 701 at a pressure of from 4 to 10 kg.

The film is preferably made of a material having a good combination of heat resistance, releasability and durability, and has a total thickness not greater than 100 μm, and more preferably not greater than 40 μm. Specific examples of the film include films of a heat resistant material such as polyimide, polyetherimide, polyether sulfide (PES), and perfluoroethylene-perfluoroalkylvinylether copolymers (PFA). The film may be a multi-layered complex film in which a release layer having a thickness of about 10 μm including a fluoro resin (such as PTFE (polytetrafluoroethylene) and PFA) and an electroconductive material or an elastic layer including a material (such as fluorine-containing rubbers and silicone rubbers) is formed on one side of a film having a thickness of about 20 μm, so that the release layer or the elastic layer contacts the toner images to be fixed.

In the fixing device illustrated in FIG. 8, the heating member includes the plate 702 and heater 703. The plate 702 is made of a material having a high heat conductivity and a high electric resistivity, such as alumina. The heater 703 which includes a resistive heater is included in the surface portion of the plate 702 so as to heat the film 705 while extending in the longitudinal direction of the plate 702. The heater 703 is typically made by forming lines or bands of an electric resistive material such as Ag/Pd and $Ta_2N$ on the plate 702 by a coating method such as screen printing methods.

The information on the temperature of the plate 702 which is detected by the temperature sensor 704 is sent to a controller (not shown) and the controller controls the electric power supplied to the heater 703 on the basis of the temperature information to control the temperature of the heater 703.

By using such a fixing device, the warm-up time of the image forming apparatus can be shortened.

Since the image forming apparatus of the present invention produces images using the particulate image forming material (i.e., a toner in this case) of the present invention, high quality images can be produced without emitting bad smell in the fixing process.

Then the process cartridge of the present invention will be explained.

The process cartridge of the present invention includes at least an image bearing member, and a developing device configured to develop electrostatic latent images with the particulate image forming material (i.e., a toner in this case) of the present invention, and optionally includes one or more devices selected from chargers, and cleaners.

Figure 5:
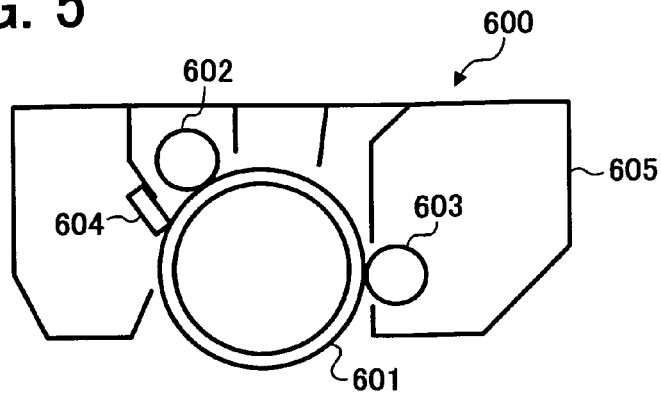
FIG. 5 is a schematic view illustrating an embodiment of the process cartridge of the present invention.

FIG. 5 is a schematic view illustrating an embodiment of the process cartridge of the present invention.

Numeral 600 denotes the process cartridge. The process cartridge 600 includes a photoreceptor 601, a charger 602; a developing device 603, a cleaner 604 and a housing 605.

The process cartridge 600 can be detachably set in an image forming apparatus such as copiers and printers. The process cartridge of the present invention can produce the same effects as those of the image forming apparatus of the present invention.

The image forming apparatus including such a process cartridge can perform image forming operations similar to those mentioned above (i.e., the operations such as charging, irradiating, developing, transferring, fixing, cleaning, etc.).

Then the photoreceptor serving as an image bearing member in the image forming apparatus of the present invention will be explained.

Amorphous Silicon Photoreceptor

Suitable photoreceptors for use as the image bearing member include amorphous silicon photoreceptors. The photoreceptors can be prepared, for example, by forming an amorphous silicon film, which serves as a photosensitive layer, on an electroconductive substrate heated to a temperature of from 50 to 400 CC by a method such as vapor-phase growth methods, e.g., vacuum vapor deposition methods, sputtering methods, plasma CVD methods, heat CVD methods, light CVD methods, and ion plating methods. Among these methods, plasma CVD methods in which a raw material gas is decomposed by DC, high frequency wave or micro wave glow discharge to deposit amorphous silicon film on a substrate are preferably used.

FIGS. 6A-6D illustrates schematic cross sections of several photoreceptors for use in the image forming apparatus of the present invention.

Figure 6A:
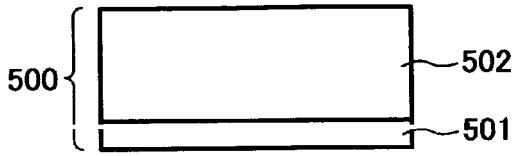
FIGS. 6A-6D are schematic views illustrating embodiments of the photoreceptor for use in the image forming apparatus of the present invention.
Figure 6B:
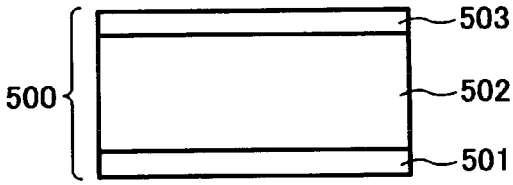

A photoreceptor 500 illustrated in FIG. 6A has a support 501 and a photosensitive layer 502 including amorphous Si:H formed on the support 501. A photoreceptor 500 illustrated in FIG. 6B has a support 501, a photosensitive layer 502 including amorphous Si:H formed on the support 501, and an amorphous silicon based surface layer 503 formed on the photosensitive layer 502.

Figure 6C:
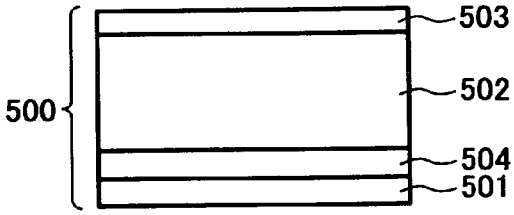
Figure 6D:
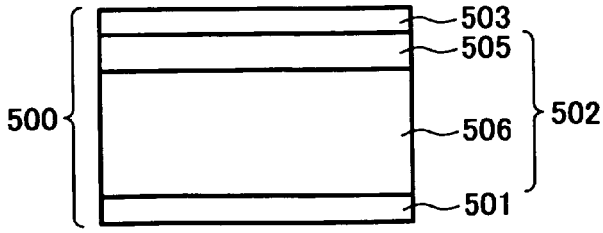

A photoreceptor 500 illustrated in FIG. 6C has a support 501, a photosensitive layer 502 including amorphous Si:H formed on the support 501, an amorphous silicon based surface layer 503 formed on the photosensitive layer 502, and an amorphous silicon based charge injection preventing layer 504 formed on the surface layer 503. A photoreceptor 500 illustrated in FIG. 6D has a support 501, a photosensitive layer 502 including a charge generation layer 505 including amorphous Si:H and a charge transport layer 506, and an amorphous silicon based surface layer 503.

Support of Photoreceptor

Electroconductive materials and insulating materials can be used as the support of the photoreceptor for use in the present invention. Specific examples of the electroconductive materials for use in the support include metals such as Al, Cr, Mo, Au, In, Nb, Te, V, Ti, Pt, Pd, Fe, etc., and alloys of the metals (e.g., stainless steel). Specific examples of the insulating materials for use in the support include films and sheets of resins such as polyester, polyethylene, polycarbonate, cellulose acetate, polypropylene, polyvinyl chloride, polystyrene, polyamide, etc.; glass, ceramics, etc. An electroconductive layer is preferably formed on at least one side of the films and sheets, on which the photosensitive layer is to be formed.

The support can have a form such as cylindrical forms, sheet forms and endless belt forms, which can have a smooth or rough peripheral surface. The thickness of the support is not particularly limited, and is properly determined such that the resultant photoreceptor can be used for the targeted image forming apparatus without causing any problem. In general, the thickness is preferably not less than 10 μm from the viewpoint of productivity, handling and mechanical strength of the photoreceptor.

Charge Injection Preventing Layer

The amorphous silicon photoreceptor for use in the present invention preferably has the charge injection preventing layer 504 between the support and the photosensitive layer to prevent injection of charges from the support to the photosensitive layer. Specifically, when the surface of the photoreceptor is charged so as to have a predetermined polarity, the charge injection preventing layer prevents injection of charges from the support to the photosensitive layer. However, when the photoreceptor is charged so as to have the opposite polarity, the charge injection preventing layer does not function, i.e., the charge injection preventing layer has charge polarity dependence. In order to impart such a property to the charge injection preventing layer, an atom capable of controlling the electroconductivity is added to the layer in a relatively large amount compared to the photosensitive layer.

The thickness of the charge injection preventing layer is determined while considering the targeted electrophotographic properties of the photoreceptor and manufacturing costs, but is generally from 0.1 to 5 μm, preferably from 0.3 to 4 am, and more preferably from 0.5 to 3 μm.

Photosensitive Layer

The photosensitive layer 502 is formed on a support with an optional undercoat layer therebetween. The thickness of the photosensitive layer is determined depending on the targeted electrophotographic properties and manufacturing costs of the photosensitive layer, and is preferably from 1 to 100 μm, more preferably from 20 to 50 μm, and even more preferably from 23 to 45 μm.

Charge Transport Layer

The charge transport layer is one layer of functionally separated photosensitive layer having a function of transporting charges. The charge transport layer includes at least a silicon atom, a carbon atom and a fluorine atom, and optionally includes a hydrogen atom and an oxygen atom (i.e., amorphous SiC (H, F, O)). This charge transport layer has a good photoconductive property, i.e., a good combination of charge retaining property, charge generation property and charge transport property. In the photoreceptor for use in the present invention, the charge transport layer preferably includes an oxygen atom.

The thickness of the charge transport layer is determined while considering the target electrophotographic properties and manufacturing costs of the layer, and is preferably from 5 to 50 μm, more preferably from 10 to 40 μm, and even more preferably from 20 to 30 μm.

Charge Generation Layer

The charge generation layer is one layer of functionally separated photosensitive layer having a function of generating charges. The charge generation layer includes at least a silicon atom, and includes substantially no carbon atom. The layer optionally includes a hydrogen atom. Namely, the charge generation layer includes amorphous Si:H. This charge generation layer has a good photoconductive property, i.e., a good combination of charge generation property and charge transport property.

The thickness of the charge generation layer is determined while considering the target electrophotographic properties and manufacturing costs of the layer, and is preferably from 0.5 to 15 μm, more preferably from 1 to 10 μm, and even more preferably from 1 to 5 μm.

Surface Layer

An amorphous silicon surface layer is preferably formed on the amorphous silicon photosensitive layer to improve the moisture resistance, electric resistance, environmental stability and durability of the photoreceptor.

The thickness of the surface layer is generally from 0.01 to 3 μm, preferably from 0.05 to 2 μm, and more preferably from 0.1 to 1 μm. If the layer is too thin, the layer tends to be easily abraded when used for a long period of time. When the layer is too thick, the photoreceptor has a high residual potential, and a background development problem in that background area of the resultant images is soiled with toner particles occurs.

The amorphous silicon photoreceptor has the following advantages:

(1) having a hard surface;

(2) having high sensitivity to semiconductor laser light having a relatively long wavelength ranging from 770 to 800 nm; and (3) having good durability.

Therefore, the photoreceptor can be preferably used for high speed copiers and laser beam printers.

Having generally described this invention, further understanding can be obtained by reference to certain-specific examples which are provided herein for the purpose of illustration only and are not intended to be limiting. In the descriptions in the following examples, the numbers represent weight ratios in parts, unless otherwise specified.

EXAMPLES

Preparation of Toner

At first, particles for the toner which is one example of the particulate image forming material of the present invention were prepared.

Toner Preparation Example 1

[Preparation of Particulate Polymer Liquid]

The following components were mixed to prepare a monomer mixture.

| | |
|---|---|
| Styrene | 108 parts |
| n-Butyl acrylate | 39 parts |
| Methacrylic acid | 9.6 parts |

Then 64 parts of an ester wax was added to the monomer mixture and the mixture was heated to 80° C. to dissolve the wax in the monomer mixture, resulting in preparation of a monomer solution.

On the other hand, 7.0 parts of sodium dodecylbenzenesulfonate was dissolved in 2400 parts of ion-exchange water in a 3.0-liter separable flask equipped with an agitator, a temperature sensor, a condenser and a nitrogen feed pipe to prepare an aqueous surfactant solution. The mixture was heated to 80° C. while agitated by the agitator at a revolution of 360 rpm under a nitrogen gas flow.

The monomer solution prepared above, which was heated to 80° C., was dispersed in the surfactant solution, which was also heated to 80° C., using a mechanical dispersing machine of circulating type to prepare an emulsion in which drops of the monomer mixture having a uniform particle diameter are dispersed in the surfactant solution. Then an initiator solution which had been prepared by dissolving 0.8 parts of potassium persulfate in 200 parts of ion-exchange water was added to the emulsion. Then the mixture was heated for 3 hours at 80° C. to perform a first reaction. Thus, a particulate polymer liquid No. 1 was prepared.

Another initiator solution which had been prepared by dissolving 7.7 parts of potassium persulfate in 240 parts of ion-exchange water was added to the particulate polymer liquid No. 1 while agitated. Then a second monomer mixture including 380 parts of styrene, 137.5 parts of n-butyl acrylate, 36 parts of methacrylic acid and 14.5 parts of t-dodecylmercaptan was dropped to the mixture over 2 hours while the mixture was agitated. After completion of the dropping operation, the mixture was heated while agitated to perform a second reaction, followed by cooling to 40° C. Thus, a particulate polymer liquid No. 2 was prepared.

Preparation of Colorant Dispersion

At first, 9.6 parts of sodium n-dodecylsulfate was dissolved in 160 parts of ion-exchange water. Then 20 parts of a carbon black (#25B from Mitsubishi Chemical Corporation) was gradually added thereto while the mixture was agitated. Then the mixture was subjected to a dispersion treatment using a high shearing force type mixer, TK HOMOMIXER manufactured by Tokushu Kika Kogyo Co., Ltd. Thus, a colorant dispersion was prepared.

Preparation of Agglomerated Particles

At first, 1200 parts of the particulate polymer liquid No. 2, 2000 parts of ion-exchange water and 189.6 parts of the colorant dispersion prepared above were mixed in a 5-liter four-neck flask equipped with a temperature sensor, a condenser, a nitrogen feed pipe and an agitator.

After the temperature of the mixture was controlled to be 30° C., a 5N sodium hydroxide was added to the mixture to control the pH of the mixture to be 10.0. Then an aqueous solution which had been prepared by dissolving 52.5 parts of magnesium chloride hexahydrate in 72 parts of ion-exchange water was gradually added to the mixture over 10 minutes while the mixture was agitated and the temperature was controlled to be 30° C. After being allowed to settle for 5 minutes, the mixture was heated to 90° C. over 10 minutes at a heating speed of 10° C./min to prepare a dispersion including agglomerated particles. This operation was performed while the average particle diameter of the agglomerated particles was measured with an instrument COULTER COUNTER TA II from Beckman Coulter Inc. When the agglomerated particles had a volume average particle diameter of 6.0 μm, an aqueous solution which had been prepared by dissolving 115 pars of sodium chloride in 700 parts of ion-exchange water was added thereto to stop the particle growth. Then the dispersion was heated at a temperature of 90±2° C. for 6 hours while agitated to fuse the agglomerated particles. Then the dispersion was cooled to 30° C. at a cooling speed of 6° C./min. Then sulfuric acid was added to the thus prepared dispersion including agglomerated particles while the mixture was agitated so that the dispersion has a pH not higher than 4.0. Thus the agglomerated particles were subjected to an acid washing treatment for 10 minute at 25° C. After water was removed from the dispersion by filtering, 500 parts of ion-exchange water was added to the agglomerated particles to wash the agglomerated particles.

After the filtering and washing operations were repeated several times, solid components were obtained by filtering. The solid components were dried at 45° C. for 24 hours. Thus, a toner No. 1 which is one example of the particulate image forming material was prepared. It was confirmed that the toner has a volume average particle diameter (Dv) of 6.0 μm and a particle diameter ratio (Dv/Dn) of 1.23.

Toner Preparation Example 2

Preparation of Monomer Composition for Core Material

At first, 12 parts of styrene, 7 parts of a carbon black (#25 from Mitsubishi Chemical Corporation) and 1 part of a charge controlling agent (SPIRON BLACK TRH from Hodogaya Chemical Co., Ltd.) were mixed and the mixture was subjected to a dispersion treatment for 12 hours using a sand mill manufactured by Kansai Paint Co., Ltd. The dispersion was mixed with a mixture of 60 parts of styrene, 18 parts of n-butyl acrylate, 0.3 parts of divinylbenzene, 0.6 parts of t-dodecylmercaptan, 10 parts of pentaerythritol tetrastearate (the purity of stearic acid is about 60%) and 6 parts of an ester wax using a high shearing force type mixer, TK HOMOMIER manufactured by Tokushu Kika Kogyo Co., Ltd., which was rotated at a rotation speed of 11000 rpm.

Thus, a monomer composition for a core material of a core-shell type toner was prepared.

Preparation of Monomer Composition of Shell Material

Five (5) parts of methyl methacrylate was finely dispersed in 100 parts of water using an emulsifying machine (TK HOMOMIER manufactured by Tokushu Kika Kogyo Co., Ltd.). Thus, a monomer composition for a shell material of the toner was prepared.

Preparation of Aqueous Dispersion Medium

An aqueous solution prepared by dissolving 7 parts of sodium hydroxide in 50 parts of ion-exchange water was gradually added to another aqueous solution prepared by dissolving 10 parts of magnesium hydroxide in 250 parts of ion-exchange water while the mixture was agitated. Thus, an aqueous dispersion medium was prepared.

Preparation of Core-shell Type Particulate Polymer (i.e., Toner)

At first, the monomer composition for core material was mixed with the aqueous dispersion medium, and 4 parts of t-butylperoxy-2-ethylhexanoate was added thereto. The mixture was subjected to a high shearing force dispersion treatment using a TK HOMOMIXER which was rotated at a rotation speed of 11000 rpm to prepare an emulsion in which liquid particles of the monomer composition for core material are dispersed in the aqueous dispersion medium. The emulsion was heated at 90° C. in a reaction vessel equipped with an agitator to perform a polymerization reaction. When the monomers were converted to a polymer at a rate of about 100%, the monomer composition for shell material and 1 part of 1% aqueous solution of potassium persulfate were added thereto. After the polymerization reaction was performed for 5 hours, the reaction was stopped. Thus, an aqueous dispersion including core-shell type particulate polymer was prepared.

Then sulfuric acid was added to the thus prepared dispersion while the mixture was agitated so that the dispersion has a pH not higher than 4.0. Thus the core-shell type polymer particles were subjected to an acid washing treatment for 10 minute at 25° C. After water was removed from the dispersion by filtering, 500 parts of ion-exchange water was added to the core-shell polymer particles to wash the polymer particles.

After the filtering and washing operations were repeated several times, solid components were obtained by filtering. The solid components were dried at 45° C. for 24 hours. Thus, a toner No. 2 which is one example of the particulate image forming material was prepared. It was confirmed that the toner has a volume average particle diameter (Dv) of 6.2 μm and a particle diameter ratio (Dv/Dn) of 1.22.

Toner Preparation Example 3

Preparation of Hydrophilic Organic Liquid

Two thousand (2000) parts of methanol and 100 parts of polyvinyl pyrrolidone were contained in a reaction vessel. After the vessel was closed, the vessel was rotated in a constant temperature water bath. The mixture in the vessel was agitated at room temperature for about one hour. Thus, a hydrophilic organic liquid was prepared. It was confirmed that the polyvinyl pyrrolidone is perfectly dissolved in the liquid.

Preparation of Monomer Composition and Polymerization Reaction

At first, 250 parts of a methanol solution of a dispersion stabilizer was fed into a reaction vessel. After the vessel was closed, the vessel was rotated in a constant temperature water bath. Then 53.08 parts of styrene, 43.42 parts of methyl acrylate, 3.0 parts of 1,3-butanediol dimethacrylate, and 0.5 parts of t-dodecylmercaptan were added to the methanol solution. A nitrogen gas was fed into the vessel to replace the air inside the vessel with the nitrogen gas while the vessel was rotated and then the vessel was closed.

The vessel was rotated for one hour at a revolution of 100 rpm in a constant temperature water bath heated to 60° C. One part of 2,2'-azobisisobutyronitrile was added thereto while a nitrogen gas was fed into the vessel. After the vessel was closed, the vessel was rotated for 6 hours at a revolution of 100 rpm in a constant temperature water bath of 60° C. Further, 8 parts of methanol, 1.5 parts of 1,3-butanediol dimethacrylate, and 0.25 parts of t-dodecylmercaptan were added thereto. After the vessel was closed, the vessel was rotated for 18 hours at a revolution of 100 rpm in a constant temperature water bath of 60° C. Thus, a polymer dispersion was prepared.

Coloring of Polymer

Thirty (30) parts of OIL BLACK 860 was mixed with 20 parts of methanol and the mixture was heated to prepare a solution. After being cooled, the solution was filtered using a micro filter having an opening of 1 μm. Thus, an oil black solution was prepared.

Then 135 parts of the polymer dispersion was mixed with 10 parts of the oil black solution and the mixture was heated to 50° C. while agitated for one hour. After being cooled to room temperature, the dispersion was subjected to a centrifugal separation treatment. After the supernatant was removed, the precipitate was dispersed in a mixture solvent of 50 parts of methanol and 50 parts of water, and then the dispersion was filtered. This washing operation was repeated three times. The thus washed precipitate was dried at room temperature, followed by reduced-pressure drying at 40° C. for 6 hours. Thus, a particulate polymer colored with OIL BLACK 860 was prepared.

Fixation of Charge Controlling Agent

One hundred (100) parts of the colored particulate polymer and 0.5 parts of a charge controlling agent (SPIRON BLACK THR from Hodogaya Chemical Co., Ltd.) were mixed for 5 hours using a HENSCHEL MIXER (from Mitsui Miike Machinery Co., Ltd.), and then the mixture was subjected to a treatment for 5 minutes using a HYBRIDIZATION NHS-1 manufactured by Nara Machinery Co., Ltd. at a revolution of 7000 rpm. Thus, a toner No. 3 was prepared. It was confirmed that the toner has a volume average particle diameter (Dv) of 6.2 μm and a particle diameter ratio (Dv/Dn) of 1.02.

Toner Preparation Example 4

The procedure for preparation of the toner No. 1 was repeated except that the chain transfer agent (i.e., t-dodecylmercaptan) was replaced with pentaerythritol tetrakis(3-mercaptopropionate). Thus, a toner No. 4 was prepared. It was confirmed that the toner has a volume average particle diameter (Dv) of 6.0 μm and a particle diameter ratio (Dv/Dn) of 1.24.

Toner Preparation Example 5

The procedure for preparation of the toner No. 2 was repeated except that the chain transfer agent (i.e., t-dodecylmercaptan) was replaced with pentaerythritol tetrakis(3-mercaptopropionate). Thus, a toner No. 5 was prepared. It was confirmed that the toner has a volume average particle diameter (Dv) of 6.1 μm and a particle diameter ratio (Dv/Dn) of 1.20.

Toner Preparation Example 6

The procedure for preparation of the toner No. 3 was repeated except that the chain transfer agent (i.e., t-dodecylmercaptan) was replaced with pentaerythritol tetrakis(3-mercaptopropionate). Thus, a toner No. 6 was prepared. It was confirmed that the toner has a volume average particle diameter (Dv) of 6.2 μm and a particle diameter ratio (Dv/Dn) of 1.02.

Toner Preparation Example 7

The procedure for preparation of the toner No. 0.1 was repeated except that the chain transfer agent (i.e., t-dodecylmercaptan) was replaced with diisopropylxanthogen disulfide. Thus, a toner No. 7 was prepared. It was confirmed that the toner has a volume average particle diameter (Dv) of 6.0 μm and a particle diameter ratio (Dv/Dn) of 1.22.

Toner Preparation Example 8

The procedure for preparation of the toner No. 2 was repeated except that the chain transfer agent (i.e., t-dodecylmercaptan) was replaced with diisopropylxanthogen disulfide. Thus, a toner No. 8 was prepared. It was confirmed that the toner has a volume average particle diameter (Dv) of 6.1 μm and a particle diameter ratio (Dv/Dn) of 1.22.

Toner Preparation Example 9

The procedure for preparation of the toner No. 3 was repeated except that the chain transfer agent (i.e., t-dodecylmercaptan) was replaced with diisopropylxanthogen disulfide. Thus, a toner No. 9 was prepared. It was confirmed that the toner has a volume average particle diameter (Dv) of 6.2 μm and a particle diameter ratio (Dv/Dn) of 1.02.

Example 1

Chain Transfer Agent Removing Process

In a pressure-resistant vessel, the toner No. 1 was treated with carbon dioxide which was used as a supercritical fluid. Specifically, the toner which was contained in the vessel under conditions of normal temperature and normal pressure (i.e., 0.10 MPa) was heated and pressed at rates of from 2 to 3° C./min and 0.2 MPa/min, respectively, to increase the temperature and pressure to 40° C. and 7.09 MPa (i.e., 70 atom). Then carbon dioxide was fed into the vessel at a flow rate of 5.0 liter/min (when measured under normal conditions) while the mixture was heated and pressed at rates of from 2 to 3° C./min and 10 MPa/min, respectively, to increase the temperature and pressure to 70° C. and 40.52 MPa (i.e., 400 atom). Thus, carbon dioxide achieved a supercritical state. The toner was treated with carbon dioxide achieving a supercritical state for 6 hours while carbon dioxide was flown at a flow rate of 5.0 liter/min (when measured under normal conditions). Then the inside of the vessel was cooled and decompressed at rates of from 2 to 3° C./min and from 3 to 5 MPa/min, respectively, while carbon dioxide was flown at a flow rate of from 1.0 to 3.0 liter/min (when measured under normal conditions) to decrease the temperature and pressure to normal temperature and 0.10 MPa (i.e., 1 atom).

When the toner was thus treated, the chain transfer agent was removed from the toner particles. Therefore, it is not necessary to subject the toner to drying and washing treatments. In addition, after the chain transfer agent was removed, the treatment can be completed only by reducing the pressure of the inside of the vessel (i.e., only by removing carbon dioxide). Therefore, toner particles can be effectively produced in a very short time. In addition, this treatment does not produce a waste liquid, namely this treatment is environment-friendly.

Preparation of Developer

One hundred (100) parts of the thus treated toner particles were mixed with 0.8 parts of a hydrophobized silica having an average particle diameter of 12 nm (RX200 from Nippon Aerosil Co.) using a HENSCHEL MIXER. Thus, a developer No. 1 was prepared.

Example 2

The procedure for preparation of the developer No. 1 in Example 1 was repeated except that the toner No. 1 was replaced with the toner No. 2. Thus, a developer No. 2 was prepared.

Example 3

The procedure for preparation of the developer No. 1 in Example 1 was repeated except that the toner No. 1 was replaced with the toner No. 3. Thus, a developer No. 3 was prepared.

Example 4

The procedure for preparation of the developer No. 1 in Example 1 was repeated except that the toner No. 1 was replaced with the toner No. 4. Thus, a developer No. 4 was prepared.

Example 5

The procedure for preparation of the developer No. 1 in Example 1 was repeated except that the toner No. 1 was replaced with the toner No. 5. Thus, a developer No. 5 was prepared.

Example 6

The procedure for preparation of the developer No. 1 in Example 1 was repeated except that the toner No. 1 was replaced with the toner No. 6. Thus, a developer No. 6 was prepared.

Example 7

The procedure for preparation of the developer No. 1 in Example 1 was repeated except that the toner No. 1 was replaced with the toner No. 7. Thus, a developer No. 7 was prepared.

Example 8

The procedure for preparation of the developer No. 1 in Example 1 was repeated except that the toner No. 1 was replaced with the toner No. 8. Thus, a developer No. 8 was prepared.

Example 9

The procedure for preparation of the developer No. 1 in Example 1 was repeated except that the toner No. 1 was replaced with the toner No. 9. Thus, a developer No. 9 was prepared.

Comparative Example 1

The procedure for preparation of the developer No. 1 in Example 1 was repeated except that the chain transfer agent removing operation using a supercritical fluid (i.e., carbon dioxide) was not performed. Thus, a developer No. 10 was prepared.

Comparative Example 2

The procedure for preparation of the developer No. 2 in Example 2 was repeated except that the chain transfer agent removing operation using a supercritical fluid (i.e., carbon dioxide) was not performed. Thus, a developer No. 11 was prepared.

Comparative Example 3

The procedure for preparation of the developer No. 3 in Example 3 was repeated except that the chain transfer agent removing operation using a supercritical fluid (i.e., carbon dioxide) was not performed. Thus, a developer No. 12 was prepared.

The thus prepared developers Nos. 1-12 were evaluated with respect to the smell in a heat fixing process.

The smell evaluating method is as follows.

In a closed room having a volume of 200 $m^3$ (10 m×10 m×2 m (height)), a running test in which 20,000 copies of a solid image each of which bears a fixed toner image having a weight of 1.00±0.05 mg/$cm^2$ are continuously produced using a copy paper (TYPE 6000<70W> from Ricoh Co., Ltd.) and a tandem color image forming apparatus (IMAGIO NEO 450 from Ricoh Co., Ltd.) while 20 graders were evaluating the smell in the room.

The graders graded the smell into the following four grades.

1. no smell
2. faint smell
3. strong smell
4. very strong smell

The results are shown in Table 1 below.

TABLE 1

| | Toner | The number of graders | | | |
|---|---|---|---|---|---|
| | | Grade 1 | Grade 2 | Grade 3 | Grade 4 |
| Ex. 1 | No. 1 | 18 | 2 | 0 | 0 |
| Ex. 2 | No. 2 | 19 | 1 | 0 | 0 |
| Ex. 3 | No. 3 | 19 | 1 | 0 | 0 |
| Ex. 4 | No. 4 | 19 | 1 | 0 | 0 |
| Ex. 5 | No. 5 | 19 | 1 | 0 | 0 |
| Ex. 6 | No. 6 | 20 | 0 | 0 | 0 |
| Ex. 7 | No. 7 | 19 | 1 | 0 | 0 |
| Ex. 8 | No. 8 | 19 | 1 | 0 | 0 |
| Ex. 9 | No. 9 | 20 | 0 | 0 | 0 |
| Com. Ex. 1 | No. 10 | 0 | 0 | 1 | 19 |
| Com. Ex. 2 | No. 11 | 0 | 0 | 2 | 18 |
| Com. Ex. 3 | No. 12 | 0 | 0 | 2 | 18 |

It is clear from Table 1 that the toner of the present invention hardly emits a smell in the heat fixing process whereas comparative toners emit a strong smell.

Example 10

Preparation of Resin

In a 8-liter autoclave manufactured by Toyo Koatsu Co., Ltd., 100 parts of ion-exchange water and 0.10 parts of a polyvinyl alcohol were mixed while agitated. Then 77 parts of styrene, 21 parts of methyl methacrylate, 2 parts of methacrylic acid, 0.10 parts of t-butylperoxy-2-ethylhexanoate, and 0.05 parts of t-dodecylmercaptan (i.e., a chain transfer agent) were added thereto and the mixture was heated at 90° C. for 10 hours to perform polymerization. In this case, the conversion rate was 97%. Then the polymerization product was further heated at 130° C. for 6 hours to complete the polymerization reaction. The thus prepared polymer particles were washed, followed by dewatering and drying, resulting in formation of a resin No. 1. Then pellets of the resin No. 1 were prepared using an extruder.

Chain Transfer Agent Removing Process

In a pressure-resistant vessel, the resin No. 1 was treated with carbon dioxide which was used as a supercritical fluid. Specifically, the resin which was contained in the vessel under conditions of normal temperature and normal pressure (i.e., 0.10 MPa) was heated and pressed at rates of from 2 to 3° C./min and 0.2 MPa/min, respectively, to increase the temperature and pressure to 40° C. and 7.09 MPa (i.e., 70 atom). Then carbon dioxide was fed into the vessel at a flow rate of 5.0 liter/min (when measured under normal conditions) while the mixture was heated and pressed at rates of from 2 to 3° C./min and 10 MPa/min, respectively, to increase the temperature and pressure to 80° C. and 40.52 MPa (i.e., 400 atom). Thus, carbon dioxide achieved a supercritical state. The toner was treated with carbon dioxide achieving a supercritical state for 6 hours while carbon dioxide was flown at a flow rate 5.0 liter/min (when measured under normal conditions). Then the inside of the vessel was cooled and decompressed at rates of from 2 to 3° C./min and from 3 to 5 MPa/min, respectively, while carbon dioxide was flown at a flow rate of from 1.0 to 3.0 liter/min (when measured under normal conditions) to decrease the temperature and pressure to normal temperature and 0.10 MPa (i.e., 1 atom).

Thus, a resin No. 1' from which the chain transfer agent was removed was prepared.

Molding Process

The thus prepared resin No. 1' was kneaded using a single-axis kneader, followed by drawing using a double-axis drawing machine to prepare a sheet having a thickness of 0.5 mm. Then a container having a dimension of 170 mm in length, 120 mm in width and 60 mm in height was prepared by a vacuum molding method using the sheet.

Thus, a container No. 1 was prepared.

Comparative Example 4

The procedure for preparation of the container in Example 10 was repeated except that the resin No. 1' was replaced with the resin No. 1. Thus, a container No. 2 was prepared.

As a result of evaluation of the containers, the properties (such as contamination of the rolls of the drawing machine, evenness of the film thickness, brittleness and impact strength) of the containers Nos. 1 and 2 are almost the same. However, the container No. 2 emitted a bad smell whereas the container No. 1 did not emit a bad smell. In addition, when cold rice contained in each of the containers Nos. 1 and 2 was heated for 2 minutes using an electric oven, the rice contained in the container No. 2 emitted a bad smell whereas the rice in the container No. 2 did not emit a bad smell.

Particulate Resin Preparation Example 1

At first, 7.0 parts of sodium dodecylbenzene sulfonate was dissolved in 2400 parts of ion-exchange water in a 3.0-liter separable flask equipped with an agitator, a temperature sensor, a condenser and a nitrogen feed pipe to prepare an aqueous surfactant solution. The mixture was heated to 80° C. while agitated by the agitator.

On the other hand, the following components were mixed to prepare a monomer mixture.

| | |
|---|---|
| Styrene | 108 parts |
| n-Butyl acrylate | 41 parts |
| Methacrylic acid | 10 parts |

The mixture was heated to 80° C.

The monomer mixture prepared above (which was heated to 80° C.) was dispersed in the surfactant solution (which was also heated to 80° C.) using a mechanical dispersing machine of circulating type to prepare an emulsion in which drops of the monomer mixture having a uniform particle diameter are dispersed in the surfactant solution. Then an initiator solution which had been prepared by dissolving 0.8 parts of potassium persulfate in 200 parts of ion-exchange water was added to the emulsion. Then the mixture was heated for 3 hours at 80° C. to perform a first reaction.

Another initiator solution which had been prepared by dissolving 7.8 parts of potassium persulfate in 280 parts of ion-exchange water was added to the first reaction product while agitated. Then a second monomer mixture of 380 parts of styrene, 137.5 parts of n-butyl acrylate, 36 parts of methacrylic acid and 14.5 parts of t-dodecylmercaptan was dropped to the mixture over 2 hours while the mixture was agitated. After completion of the dropping operation, the mixture was heated while agitated to perform a second reaction, followed by cooling to 40° C. Thus, a liquid including a particulate resin was prepared.

After water was removed from the dispersion by filtering, 500 parts of ion-exchange water was added to the resultant core-shell polymer particles to wash the particles. After filtering and washing operations were repeated several times, solid components were obtained by filtering. The solid components were dried at 45° C. for 24 hours. Thus, a particulate resin No. 1 was prepared.

Chain Transfer Agent Removing Process

In a pressure-resistant vessel, the particulate resin No. 1 was treated with carbon dioxide which was used as a supercritical fluid. Specifically, the toner which was contained in the vessel under conditions of normal temperature and normal pressure (i.e., 0.10 MPa) was heated and pressed at rates of from 2 to 3° C./min and 0.2 MPa/min, respectively, to increase the temperature and pressure to 40° C. and 7.09 MPa (i.e., 70 atom). Then carbon dioxide was fed into the vessel at a flow rate of 5.0 liter/min (when measured under normal conditions) while the mixture was heated and pressed at rates of from 2 to 3° C./min and 10 MPa/min, respectively, to increase the temperature and pressure to 70° C. and 45.59 MPa (i.e., 450 atom). Thus, carbon dioxide achieved a supercritical state. The toner was treated with carbon dioxide achieving a supercritical state for 6 hours while carbon dioxide was flown at a flow rate 5.0 liter/min (when measured under normal conditions). Then the inside of the vessel was cooled and decompressed at rates of from 2 to 3° C./min and from 3 to 5 MPa/min, respectively, while carbon dioxide was flown at a flow rate of from 1.0 to 3.0 liter/min (when measured under normal conditions) to decrease the temperature and pressure to normal temperature and 0.10 MPa (i.e., 1 atom).

Thus, a particulate resin No. 1B was prepared.

Particulate Resin Preparation Example 2

At first, 12 parts of styrene, and 1 part of a charge controlling agent (SPIRON BLACK TRH from Hodogaya Chemical Co., Ltd.) were mixed and the mixture was subjected to a dispersion treatment for 12 hours using a sand mill manufactured by Kansai Paint Co., Ltd. The dispersion was mixed with a mixture of 90 parts of styrene, 27 parts of n-butyl acrylate, 0.45 parts of divinylbenzene, and 1.0 part of t-dodecylmercaptan using a high shearing force type mixer, TK HOMOMIER from Tokushu Kika Kogyo Co., Ltd., which was rotated at a rotation speed of 11000 rpm. Thus, a monomer composition for a core material was prepared.

On the other hand, 5 parts of methyl methacrylate was finely dispersed in 100 parts of water using an emulsifying machine (TK HOMOMIER from Tokushu Kika Kogyo Co., Ltd.). Thus, a monomer composition for a shell material.

In addition, an aqueous prepared by dissolving 7 parts of sodium hydroxide in 50 parts of ion-exchange water was gradually added to another aqueous solution prepared by dissolving 35 parts of magnesium hydroxide in 500 parts of ion-exchange water while the mixture was agitated. Thus, an aqueous dispersion medium was prepared.

Then, 4 parts of t-butylperoxy-2-ethylhexanoate was added to a mixture of the monomer composition for the core material and the aqueous dispersion medium, and the mixture was subjected to a high shearing force dispersion treatment using a TK HOMOMIXER which was rotated at a rotation speed of 14000 rpm to prepare an emulsion in which liquid particles of the monomer composition for the core material are dispersed in the aqueous dispersion medium. The emulsion was heated at 90° C. in a reaction vessel equipped with an agitator to perform a polymerization reaction. When the monomers were converted to a polymer at a rate of about 100%, the monomer composition for the shell material and 1 part of 1% aqueous solution of potassium persulfate were added thereto. After the polymerization reaction was performed for 5 hours, the reaction was stopped. Thus, an aqueous dispersion including a core-shell type particulate polymer was prepared.

Then sulfuric acid was added to the thus prepared dispersion such that the dispersion has a pH not higher than 4.0 while the mixture was agitated. Thus the core-shell type particulate polymer was subjected to an acid washing treatment for 10 minute at 25° C.

After water was removed from the dispersion by filtering, 500 parts of ion-exchange water was added to the core-shell particulate polymer to wash the particulate polymer. After the filtering and washing operations were repeated several times, solid components were obtained by filtering. The solid components were dried at 45° C. for 24 hours. Thus, a particulate resin No. 2 was prepared.

The procedure of the chain transfer agent removing process in Particulate Resin Preparation Example 1 was repeated except that the particulate resin No. 1 was replaced with the particulate resin No. 2. Thus, a particulate resin No. 2B was prepared.

Particulate Resin Preparation Example 3

At first, 1840 parts of methanol, 160 parts of ion-exchange water and 75 parts of polyvinyl pyrrolidone were contained in a reaction vessel. After the vessel was closed, the vessel was rotated in a constant temperature water bath. The mixture in the vessel was agitated at room temperature for about one hour. Thus, a hydrophilic organic liquid was prepared. It was confirmed that the polyvinyl pyrrolidone is perfectly dissolved in the liquid.

On the other hand, 250 parts of a methanol solution of a dispersion stabilizer was fed into a reaction vessel. After the vessel was closed, the vessel was rotated in a constant temperature water bath. Then 53 parts of styrene, 43 parts of methyl acrylate, 3.0 parts of 1,3-butanediol dimethacrylate, and 0.5 parts of t-dodecylmercaptan were added to the methanol solution. A nitrogen gas was fed into the vessel to replace the air in the vessel with the nitrogen gas while the vessel was rotated and then the vessel was closed.

The vessel was rotated for one hour at a revolution of 120 rpm in a constant temperature water bath heated to 60° C. Then 0.8 parts of 2,2'-azobisisobutyronitrile was added thereto while a nitrogen gas was fed into the vessel. After the vessel was closed, the vessel was rotated for 6 hours at a revolution of 120 rpm in a constant temperature water bath of 60° C. Further, 8 parts of methanol, 1.5 parts of 1,3-butanediol dimethacrylate, and 0.35 parts of t-dodecylmercaptan were added thereto. After the vessel was closed, the vessel was rotated for 18 hours at a revolution of 120 rpm in a constant temperature water bath of 60° C. Thus, a liquid including a particulate resin was prepared.

After water was removed from the dispersion by filtering, 500 parts of ion-exchange water was added to the core-shell particulate polymer to wash the particulate polymer. After the filtering and washing operations were repeated several times, solid components were obtained by filtering. The solid components were dried at 45° C. for 24 hours. Thus, a particulate resin No. 3 was prepared.

The procedure of the chain transfer agent removing process in Particulate Resin Preparation Example 1 was repeated except that the particulate resin No. 1 was replaced with the particulate resin No. 3. Thus, a particulate resin No. 3B was prepared.

Particulate Resin Preparation Example 4

At first, 2000 parts of methanol, and 100 parts of polyvinyl pyrrolidone were contained in a reaction vessel which was closed and which was rotated in a constant temperature water bath. The mixture in the vessel was agitated at room temperature for about one hour. Thus, a hydrophilic organic liquid was prepared. It was confirmed that the polyvinyl pyrrolidone is perfectly dissolved in the liquid.

On the other hand, 250 parts of a methanol solution of a dispersion stabilizer was fed into a reaction vessel which was closed and which was rotated in a constant temperature water bath. Then 53 parts of styrene, 43 parts of methyl acrylate, 3.0 parts of 1,3-butanediol dimethacrylate, and 0.5 parts of t-dodecylmercaptan were added to the methanol solution. A nitrogen gas was fed into the vessel to replace the air in the vessel with the nitrogen gas while the vessel was rotated and then the vessel was closed.

The vessel was rotated for one hour at a revolution of 120 rpm in a constant temperature water bath heated to 60° C. Then 0.8 parts of 2,2'-azobisisobutyronitrile was added thereto while a nitrogen gas was fed into the vessel. After the vessel was closed, the vessel was rotated for 6 hours at a revolution of 120 rpm in a constant temperature water bath of 60° C. Further, 8 parts of methanol, 1.5 parts of 1,3-butanediol dimethacrylate, and 0.35 parts of t-dodecylmercaptan were added thereto. After the vessel was closed, the vessel was rotated for 18 hours at a revolution of 120 rpm in a constant temperature water bath of 60° C. Thus, a liquid including a particulate polymer was prepared.

After water was removed from the dispersion by filtering, 500 parts of ion-exchange water was added to the core-shell particulate polymer to wash the particulate polymer. After the filtering and washing operations were repeated several times, solid components were obtained by filtering. The solid components were dried at 45° C. for 24 hours. Thus, a particulate resin No. 4 was prepared.

The procedure of the chain transfer agent removing process in Particulate Resin Preparation Example 1 was repeated except that the particulate resin No. 1 was replaced with the particulate resin No. 4. Thus, a particulate resin No. 4B was prepared.

Each of the particulate resins Nos. 1-4 and 1B-4B was evaluated. Specifically each resin was set on each of hot plates heated to temperatures, 100° C., 140° C. and 180° C., respectively, to evaluate the smell and the shape of the heated resin. The method for evaluating the shape of the resin is as follows. Specifically, a weight was set on the heated resin, and the particles of the resin were observed with an electron microscope to determine the shape of the particles. The shape of the resin particles were classified into the following three ranks:

Rank A: the shape of the resin particles was not changed.

Rank B: the resin particles were deformed.

Rank C: the resin particles were melted.

The smell was evaluated as follows. A pipe having an inside diameter of 6 cm and a height of 30 cm was set on each of the hot plates such that the resin particles on the hot plates were surrounded by the pipe. The smell caused by the chain transfer agent was checked at the upper end of the pipe. The smell was classified into the following three ranks:

Rank A: no smell

Rank B: faint smell

Rank C: strong smell

The results are shown in Table 2.

| | 100° C. | | 140° C. | | 180° C. | |
|---|---|---|---|---|---|---|
| | Shape | Smell | Shape | Smell | Shape | Smell |
| Resin 1 | A | B | B | C | C | C |
| Resin 2 | A | B | B | C | C | C |
| Resin 3 | A | B | B | C | C | C |
| Resin 4 | A | A | B | C | C | C |
| Resin 1B | A | A | B | A | C | A |
| Resin 2B | A | A | B | A | C | A |
| Resin 3B | A | A | B | A | C | A |
| Resin 4B | A | A | B | A | C | A |

Example 11

Preparation of Particulate Resin

At first, 83 parts of styrene, 31 parts of n-butyl acrylate, 8.8 parts of methacrylic acid, and 64 parts of carnauba wax were mixed and the mixture was heated to 80° C. to prepare a monomer solution. On the other hand, in a 8-liter autoclave manufactured by Toyo Koatsu Co., Ltd., 1600 parts of ion-exchange water and 4.8 parts of sodium dodecylbenzenesulfonate were mixed and the aqueous medium including a surfactant was heated to 90° C. while agitated. After the monomer solution was added to the aqueous medium, an initiator solution which had been prepared by dissolving 0.8 parts of potassium persulfate in 200 parts of ion-exchange water. The mixture was heated to 90° C. and the mixture was polymerized for 10 hours. Thus, a dispersion of a particulate resin No. 5 was prepared.

Preparation of Colorant Dispersion

At first, 9.6 parts of sodium n-dodecylsulfate was dissolved in 160 parts of ion-exchange water. Then 20 parts of a carbon black (#25B from Mitsubishi Chemical Corporation) was gradually added thereto while the mixture was agitated. Then the mixture was subjected to a dispersion treatment using a high shearing force type mixer, TK HOMOMIXER from Tokushu Kika Kogyo Co., Ltd. Thus, a colorant dispersion was prepared.

Preparation of Agglomerated Particles

At first, 835 parts of the dispersion of the particulate resin No. 5, 2159 parts of ion-exchange water, and 4.2 parts of sodium dodecylbenzenesulfonate were mixed. Then the mixture was mixed with 200 parts of the particulate resin No. 1B, and 200 parts of the colorant dispersion prepared above in a 5-liter four-neck flask equipped with a temperature sensor, a condenser, a nitrogen feed pipe and an agitator while a high shearing force was applied thereto.

After the temperature of the mixture was controlled to 30° C., a 5N sodium hydroxide was added to the mixture to adjust the pH of the mixture to be 10.0. Then an aqueous solution which had been prepared by dissolving 52.5 parts of magnesium chloride hexahydrate in 72 parts of ion-exchange water was gradually added to the mixture over 10 minutes while the mixture was agitated and the temperature was controlled to be 30° C. After being allowed to settle for 5 minutes, the mixture was heated to 90° C. over 10 minutes at a heating speed of 10° C./min to prepare a dispersion including agglomerated particles. This operation was performed while the particle diameter of the agglomerated particles was measured with an instrument COULTER COUNTER TA II from Beckman Coulter Inc. When the agglomerated particles had a volume average particle diameter of from 5.8 to 6.2 μm, an aqueous solution which had been prepared by dissolving 115 parts of sodium chloride in 700 parts of ion-exchange water was added thereto to stop the particle growth. Then the dispersion was heated at a temperature of 90±2° C. for 6 hours while agitated to fuse the agglomerated particles. Then the dispersion was cooled to 30° C. at a cooling speed of 6° C./min. Then sulfuric acid was added to the thus prepared dispersion including agglomerated particles such that the dispersion has a pH not higher than 4.0 while the mixture was agitated. Thus the agglomerated particles were subjected to an acid washing treatment for 10 minute at 25° C., After water was removed from the dispersion by filtering, 500 parts of ion-exchange water was added to the agglomerated particles to wash the agglomerated particles.

After the filtering and washing operations were repeated several times, solid components were obtained by filtering. The solid components were dried at 45° C. for 24 hours. Thus, a toner No. 13 which is one example of the particulate image forming material was prepared. It was confirmed that the toner has a volume average particle diameter (Dv) of 6.0 μm and a particle diameter ratio (Dv/Dn) of 1.20.

Example 12

The procedure for preparation of the toner in Example 11 was repeated except that the particle resin No. 1B was replaced with the dispersion of the particulate resin No. 2B. Thus, a toner No. 14 which is one example of the particulate image forming material was prepared. It was confirmed that the toner has a volume average particle diameter (Dv) of 5.8 μm and a particle diameter ratio (Dv/Dn) of 1.24.

Example 13

The procedure for preparation of the toner in Example 11 was repeated except the particle resin No. 1B was replaced with the dispersion of the particulate resin No. 3B. Thus, a toner No. 15 which is one example of the particulate image forming material was prepared. It was confirmed that the toner has a volume average particle diameter (Dv) of 6.1 μm and a particle diameter ratio (Dv/Dn) of 1.18.

Example 14

Thirty (30) parts of OIL BLACK 860 was mixed with 20 parts of methanol and the mixture was heated to prepare a solution. After being cooled, the solution was filtered using a micro filter having an opening of 1 μm. Thus, an oil black solution was prepared.

Then 12 parts of the particulate resin No. 4B prepared above, 50 parts of methanol, 50 parts of water, and the oil black solution were mixed and the mixture was heated to 50° C. while agitated for one hour. The dispersion was cooled to room temperature, and then subjected to a centrifugal separation treatment. After the supernatant was removed, the precipitate was dispersed in a mixture solvent of 50 parts of methanol and 50 parts of water, followed by filtering. This washing operation was repeated three times. The thus washed precipitate was dried at room temperature, followed by reduced-pressure drying at 40° C. for 6 hours. Thus, a particulate resin colored with OIL BLACK 860 was prepared.

Fixation of Charge Controlling Agent

One hundred parts of the colored particulate resin and 0.5 parts of a charge controlling agent (SPIRONBLACK THR from Hodogaya Chemical Co., Ltd.) were mixed for 5 minutes using a HENSCHEL MIXER (from Mitsui Miike Machinery Co., Ltd.), and then the mixture was subjected to a treatment for 5 minutes using a HYBRIDIZATION NHS-1 at a revolution of 7000 rpm. Thus, a toner No. 16 was prepared. It was confirmed that the toner has a volume average particle diameter (Dv) of 6.2 μm and a particle diameter ratio (Dv/Dn) of 1.02.

Comparative Example 5

The procedure for preparation of the toner in Example 11 was repeated except that the particle resin No. 1B was replaced with a dispersion of the particulate resin No. 1. Thus, a toner No. 17 which is one example of the particulate image forming material was prepared. It was confirmed that the toner has a volume average particle diameter (Dv) of 6.0 μm and a particle diameter ratio (Dv/Dn) of 1.20.

Comparative Example 6

The procedure for preparation of the toner in Example 11 was repeated except that the particle resin No. 1B was replaced with a dispersion of the particulate resin No. 2. Thus, a toner No. 18 which is one example of the particulate image forming material was prepared. It was confirmed that the toner has a volume average particle diameter (Dv) of 5.8 μm and a particle diameter ratio (Dv/Dn) of 1.24.

Comparative Example 7

The procedure for preparation of the toner in Example 11 was repeated except that the particle resin No. 1B was replaced with a dispersion of the particulate resin No. 3. Thus, a toner No. 19 which is one example of the particulate image forming material was prepared. It was confirmed that the toner has a volume average particle diameter (Dv) of 6.1 μm and a particle diameter ratio (Dv/Dn) of 1.18.

Comparative Example 8

The procedure for preparation of the toner in Example 14 was repeated except that the particulate resin 4B was replaced with the particulate resin 4 in the colored particulate resin preparing process. The thus prepared toner No. 20. It was confirmed that the toner has a volume average particle diameter (Dv) of 6.2 μm and a particle diameter ratio (Dv/Dn) of 1.02.

Then 100 parts of each of the thus prepared toners Nos. 13-20 was mixed with 0.8 parts of a hydrophobized silica (RX200 from Nippon Aerosil Co.) using a HENSCHEL MIXER. Thus, developers 13-20 were prepared. The developers were evaluated with respect to the smell in a heat fixing process. The smell evaluating method is as follows.

In a closed room having a volume of 200 $m^3$ (10 m×10 m×2 m (height)), a running test in which 20,000 copies of a solid image each of which bears a fixed toner image having a weight of 1.00±0.05 $mg/cm^2$ are continuously produced using a copy paper (TYPE 6000<70W> from Ricoh Co., Ltd.) and a tandem color image forming apparatus (IMAGIO NEO 450 from Ricoh Co., Ltd.) while 20 graders evaluated the smell in the room.

The fixing was performed at a fixing temperature 15° C. lower than the offset starting temperature of the toner.

The graders graded the smell into the following four grades.

1. no smell
2. faint smell
3. strong smell
4. very strong smell

The results are shown in Table 1 below.

TABLE 3

| | Toner | The number of graders | | | |
|---|---|---|---|---|---|
| | | Grade 1 | Grade 2 | Grade 3 | Grade 4 |
| Ex. 11 | No. 13 | 18 | 2 | 0 | 0 |
| Ex. 12 | No. 14 | 19 | 1 | 0 | 0 |
| Ex. 13 | No. 15 | 19 | 1 | 0 | 0 |
| Ex. 14 | No. 16 | 19 | 1 | 0 | 0 |
| Comp. Ex. 5 | No. 17 | 0 | 0 | 3 | 17 |
| Comp. Ex. 6 | No. 18 | 0 | 0 | 2 | 18 |
| Comp. Ex. 7 | No. 19 | 0 | 0 | 5 | 15 |
| Comp. Ex. 8 | No. 20 | 0 | 0 | 5 | 15 |

It is clear from Table 3 that the toner of the present invention hardly emits a smell in the heat fixing process whereas comparative toners emit a strong smell.

This document claims priority and contains subject matter related to Japanese Patent Application No. 2004-177499, filed on Jun. 15, 2004, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method for preparing a particulate image forming material, comprising:

having obtained a particulate material comprising a chain transfer agent, contacting the particulate material with at least one of a supercritical fluid and a sub-critical fluid to remove the chain transfer agent from the particulate material.

2. The method according to claim 1, wherein the at least one of the supercritical fluid and sub-critical fluid dissolves the chain transfer agent without dissolving other components of the particulate material.

3. The method according to claim 1, wherein the at least one of the supercritical fluid and sub-critical fluid comprises a material selected from the group consisting of carbon dioxide and organic solvents.

4. The method according to claim 1, further comprising:

depressurizing the at least one of a supercritical fluid and a sub-critical fluid including the chain transfer agent to separate the chain transfer agent from the at least one of a supercritical fluid and a sub-critical fluid.

5. The method according to claim 1, wherein the particulate material comprises a particulate polymer.

6. The method according to claim 1, wherein the particulate material providing step comprises any one of the following substep combinations (1)-(3):

(1) subjecting a radical-polymerizable monomer to emulsification polymerization in an aqueous medium in the presence of a water-soluble polymerization initiator and the chain transfer agent to prepare an emulsion comprising resin particles;

agglomerating or fusing the resin particles;

separating the resin particles from the aqueous medium; and washing the resin particles;

(2) dispersing a mixture comprising a radical-polymerizable monomer, a polymerization initiator, a colorant and a release agent in an aqueous medium including a suspension stabilizer to prepare a suspension;

polymerizing the mixture while agitating the suspension to prepare a particulate polymer; and adding a chain transfer agent to the suspension in at least one of the dispersing step and the polymerizing step; or (3)

mixing a hydrophilic organic solvent, a polymer dispersant which can be dissolved in the hydrophilic organic solvent, and a radical-polymerizable monomer which can be dissolved in the hydrophilic organic solvent;

polymerizing the radical-polymerizable monomer to prepare a particulate polymer which is hardly dissolved or swells in the hydrophilic organic solvent; and adding the chain transfer agent to the mixture in at least one of the mixing step and the polymerizing step.

7. The method according to claim 1, wherein the radical-polymerizable monomer comprises one or more vinyl monomers.

8. The method according to claim 7, wherein the radical-polymerizable monomer comprises at least one of styrene and methyl acrylate.

* * * * *